US007267418B2

(12) United States Patent
Hasebe et al.

(10) Patent No.: US 7,267,418 B2
(45) Date of Patent: Sep. 11, 2007

(54) INK JET PRINTER

(75) Inventors: Takashi Hasebe, Hachioji (JP); Saburo Shimizu, Hachioji (JP); Tetsu Sekine, Hachioji (JP); Shuta Hamada, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 362 days.

(21) Appl. No.: 10/896,076

(22) Filed: Jul. 22, 2004

(65) Prior Publication Data

US 2005/0122362 A1 Jun. 9, 2005

(30) Foreign Application Priority Data

| | | |
|---|---|---|
| Dec. 9, 2003 | (JP) | 2003-410570 |
| Dec. 9, 2003 | (JP) | 2003-410583 |
| Dec. 17, 2003 | (JP) | 2003-419353 |
| Dec. 25, 2003 | (JP) | 2003-430107 |
| Dec. 25, 2003 | (JP) | 2003-431218 |

(51) Int. Cl.
*B41J 29/393* (2006.01)

(52) U.S. Cl. ..... 347/19; 347/81

(58) Field of Classification Search ..... 347/19
See application file for complete search history.

(56) References Cited

U.S. PATENT DOCUMENTS

| | | | | |
|---|---|---|---|---|
| 4,835,435 A * | 5/1989 | Yeung et al. | ..... | 310/324 |
| 4,922,268 A * | 5/1990 | Osborne | ..... | 347/19 |
| 6,824,253 B2 * | 11/2004 | Hoisington et al. | ..... | 347/68 |

* cited by examiner

*Primary Examiner*—Lamson Nguyen
*Assistant Examiner*—Brian J. Goldberg
(74) *Attorney, Agent, or Firm*—Finnegan, Henderson, Farabow, Garrett & Dunner, L.L.P.

(57) ABSTRACT

An ink jet printer for recording an image on a recording medium by jetting ink from nozzles having: an ink jet section which is provided with the nozzles; and an ink droplet detection section for detecting an impact force generated when an ink droplet jetted from the nozzles lands with a piezoelectric element, which is provided ahead in an ink droplet jetting direction from the nozzles.

5 Claims, 35 Drawing Sheets

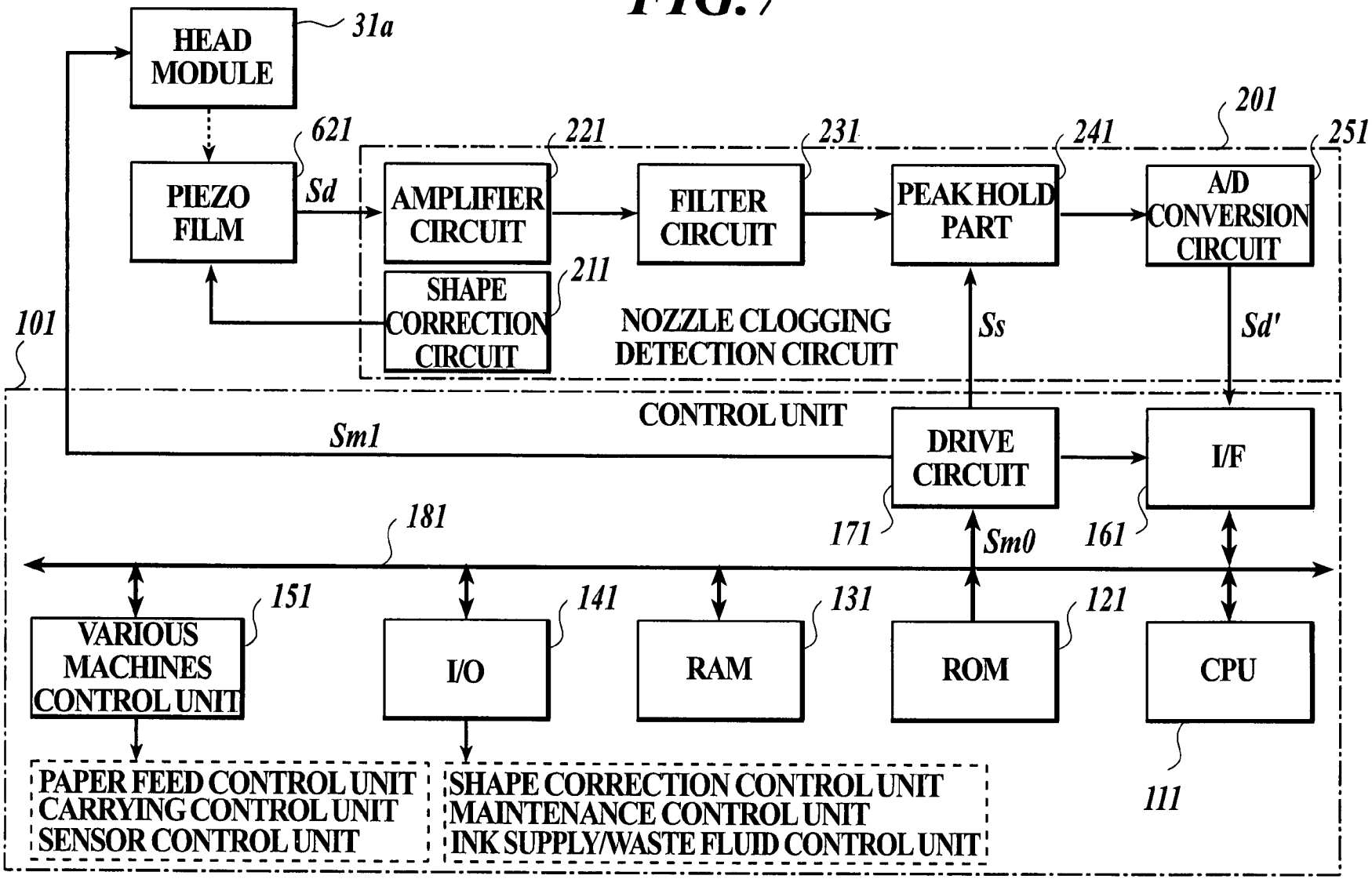
FIG. 7
HEAD MODULE
31a
PIEZO FILM
621
Sd
AMPLIFIER CIRCUIT
221
SHAPE CORRECTION CIRCUIT
211
FILTER CIRCUIT
231
PEAK HOLD PART
241
A/D CONVERSION CIRCUIT
251
201
Sd'
Ss
NOZZLE CLOGGING DETECTION CIRCUIT
CONTROL UNIT
101
Sm1
DRIVE CIRCUIT
171
Sm0
I/F
161
CPU
111
ROM
121
RAM
131
I/O
141
VARIOUS MACHINES CONTROL UNIT
151
181
PAPER FEED CONTROL UNIT
CARRYING CONTROL UNIT
SENSOR CONTROL UNIT
SHAPE CORRECTION CONTROL UNIT
MAINTENANCE CONTROL UNIT
INK SUPPLY/WASTE FLUID CONTROL UNIT Sa1
Sa2
622a
632
M

INK JET PRINTER

BACKGROUND OF THE INVENTION

1. Field of the Invention

The present invention relates to a detection or an improvement of a jet failure of a nozzle in an ink jet printer.

2. Description of the Related Art

In an earlier developed ink jet printer, an image is recorded by jetting ink droplets onto a recording medium from a plurality of nozzles which use a thermal system or a piezo system actuated according to jet signals based on image signals. In the ink jet printer, fixing of ink near nozzle jet openings or adhering of impurities (foreign particles) or the like to the nozzle jet openings due to drying or increased viscosity of ink in a case of being left for a long period of time without being used would cause clogging of the nozzles, which results in a failure of jetting ink droplets from the nozzle jet openings in spite of normally outputting ink jet signals from a drive circuit unit, that is, a jet failure of ink from the nozzles (hereinafter, referred as nozzle clogging). The nozzle clogging would cause a deterioration of print quality such as generating a blank in a printed character or image, which is recognized as a white stripe, or causing difference of reproduced color in each recorded image due to a lack of ink color material. Therefore, an optical detection section as a detection section for detecting such the nozzle clogging is disclosed.

For example, disclosed is an ink jetting condition detection method for detecting nozzle clogging by changing a detection timing with a photo sensor in which light emitting elements and light receiving elements are combined along a distance corresponding to the width of the head as a detection section of nozzle clogging of a carriage type ink jet printer in which ink is jetted from a head in a direction (main scanning direction) perpendicularly crossing a carrying direction of a paper (sub scanning direction) to form an image (JP-Tokukai-hei-11-188853A, hereinafter referred as "Patent Document 1").

Also, disclosed is an ink jet recording apparatus in which an opening is provided in an endless belt for performing a cleaning of a head of a line head type ink jet recording apparatus in a short period of time, and a maintenance operation is performed on a carrying path of a recording medium without moving the recording head (JP-Tokukai-2001-287377A, hereinafter referred as "Patent Document 2").

However, applying Patent Document 1 to a line head type ink jet printer could be causative factors of cost increase due to the needs to adjust the amount of light or the diameter of beam from the light emitting elements with high accuracy because one line head has a large length, and to move the detection section for nozzle clogging by using a positioning sensor with high accuracy. Also, the distance between the light emitting elements and the light receiving elements becomes large, which may cause misdetection due to dust or ink droplets in the form of mist.

Further, since a plurality of nozzles which need to be detected exist in one line head, it would raise a problem that time for detection become long.

Also, in a case of applying Patent Document 2 to a line head type ink jet printer, it is disclosed that the opening is provided in the carrying belt to perform cleaning and maintenance, however, there is no disclosure to detect nozzle clogging.

As described above, in the earlier technique, the nozzle clogging detected is solved by a maintenance section, and then the printing operation is performed. Therefore, after the maintenance operation by the maintenance section, no confirmation is performed whether the nozzle clogging is solved, thus, possibility would remain that the nozzle clogging still exist. Performing the printing operation in this state would deteriorate print quality and thereby decline reliability to the apparatus.

SUMMARY OF THE INVENTION

The present invention is developed in view of the above described problems, and an object of the present invention is to provide an ink jet printer capable of precisely detecting nozzle clogging by utilizing impact force generated when an ink droplet jetted from a nozzle lands, and also capable of improving accuracy of nozzle clogging detection, and efficiently performing detection and solving of nozzle clogging.

For solving the problems, in accordance with an aspect of the present invention, the ink jet printer for recording an image on a recording medium by jetting ink from nozzles comprises: an ink jet section which is provided with the nozzles; and an ink droplet detection section for detecting an impact force generated when an ink droplet jetted from the nozzles lands with a piezoelectric element, which is provided ahead in an ink droplet jetting direction from the nozzles.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein;

FIG. 7 is a control block diagram for controlling the ink jet printer 1A in the first embodiment;

DETAILED DESCRIPTION OF THE PREFERRED EMBODIMENTS

First Embodiment

Figure 1:
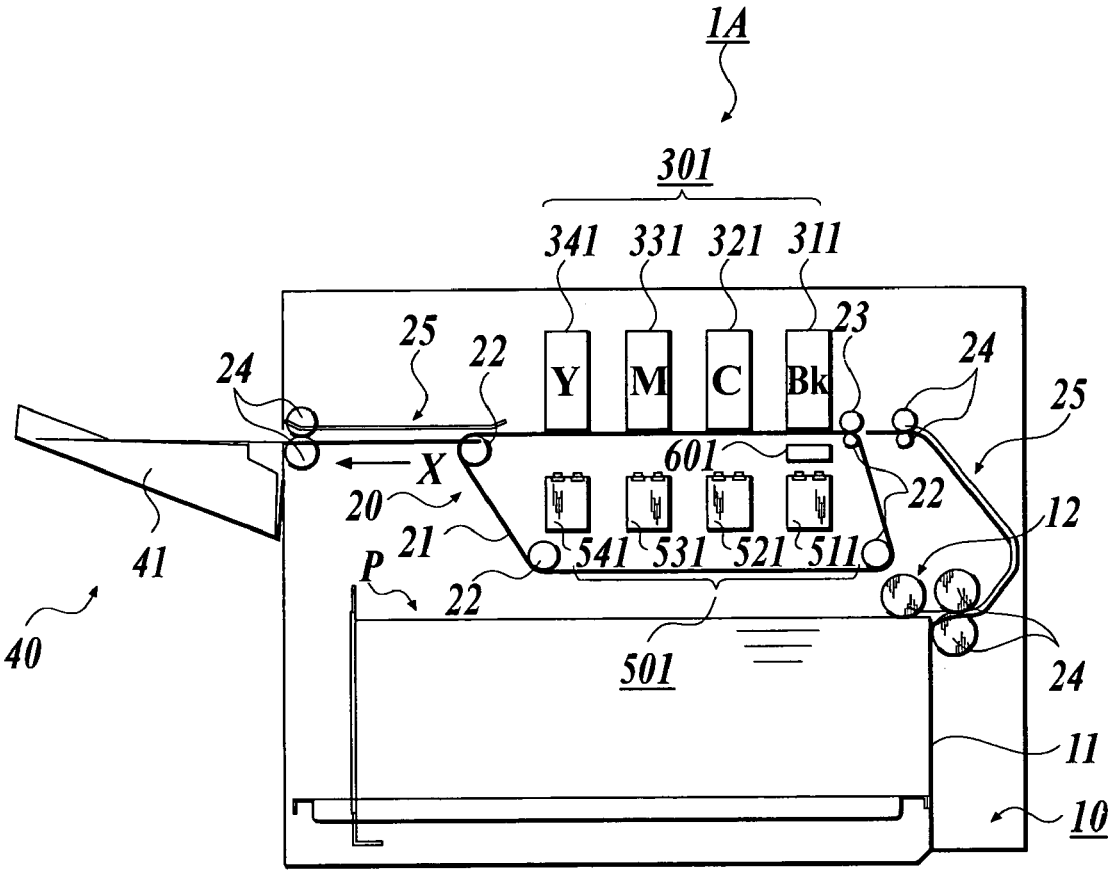
FIG. 1 is a schematic view of an inside of an ink jet printer 1A in the first embodiment.

The first embodiment of the present invention will be explained below referring to the drawings.

The configuration will be explained first.

FIG. 1 shows a schematic view of the inside of an ink jet printer 1A of a line head type in the first embodiment. As shown in FIG. 1, the ink jet printer 1A comprises a paper feed part 10, a carrying part 20, a head unit part 301, a paper discharge part 40, a maintenance part 501 as a maintenance section, a nozzle clogging detection part 601 or the like.

The paper feed part 10 is provided with a paper feed tray 11 for stacking and storing a plurality of recording mediums P at the lower side of the inside of the ink jet printer 1A. A paper pick up device 12 is provided at one end portion of an upper side of the paper feed tray 11 for picking up the recording medium P on which an image is to be recorded one by one from the paper feed tray 11.

The recording medium P to be applied includes various types of papers such as a plain paper, a recycled paper, a gloss paper or the like, and a cut sheet shaped recording medium made from a material such as various types of textiles, non-woven fabrics, resin, metal, glass or the like.

The carrying part 20 for carrying the recording medium P is provided on the upper side of the paper feed part 10. The carrying part 20 comprises a carrying belt 21, tension rollers 22, a pressure roller 23, carrying rollers 24, and a carrying path 25.

The carrying belt 21 is a circular shaped belt for carrying the recording medium P in a horizontal direction while supporting it in a plane state, and is movably tensioned by the plurality of tension rollers 22. The carrying belt 21 is provided with an opening part 21*a* so that a nozzle clogging detection part 601 to be described later is movable and a capping module covers nozzle jet openings. There are provided an encoder film and an encoder sensor at the end portion of the carrying belt 21 to enable the opening part 21*a* to be positioned at the lower side of the nozzle jet openings when judging nozzle clogging or performing maintenance operation, thereby the position of the opening part 21*a* can be detected based on the detection signal from the encoder sensor (not shown).

The pressure roller 23 is rotatably provided at a portion where the carrying belt 21 and the recording medium P start to contact with each other as a roller to put pressure onto the carrying belt 21 for carrying the recording medium P in a flat shape.

The carrying path 25 is a path for discharging the recording medium P which was fed from the paper feed tray 11 and carried along the periphery of the carrying belt 21 to a paper discharge part 40. The carrying rollers 24 are provided at a predetermined position of the carrying path 25 as a plurality pairs of rollers for carrying the recording medium P in a carrying direction X.

A head unit part 301 comprises line head type unit heads 311, 321, 331, 341 at the portion near the upper portion of the carrying belt 21, for jetting each ink color of black (Bk), cyan (C), magenta (M) and yellow (Y) onto the recording medium P in this order along the carrying direction X, each of which comprises a plurality of nozzle jet openings (not shown) and extends in the width direction of the carrying belt 21. Each head unit 311, 321, 331, 341 has a width larger than that of the recording medium P and is disposed to make nozzle-plates face the periphery of the carrying belt 21.

The recording medium P on which an image is formed by jetting ink droplets from each head unit 311, 321, 331, 341 is discharged from the paper discharge part 40 in order.

Each head unit 311, 321, 331, 341 extending in a direction approximately perpendicular to the carrying direction X of the recording medium P comprises a plurality of head modules arranged in parallel in a longitudinal direction. Each head module extends in the longitudinal direction of each head module 311, 321, 331, 341, and they are alternately arranged in parallel with each other at a predetermined interval in the carrying direction X of the recording medium P (staggered arrangement).

The paper discharge part 40 comprises a paper discharge tray 41 provided at the side portion of the ink jet printer 1A, and the recording medium P on which an image is formed is discharged therefrom in order.

The maintenance part 501 is provided at the lower side of the head unit 301 to face thereto across a portion near the lower portion of the upper surface of the carrying belt 21. The maintenance part 501 comprises a plurality of cap units 511, 521, 531, 541 for covering the nozzle jet openings, a suction pump which is not shown, and a waste ink tank.

Each cap unit 511, 521, 531, 541 comprise a plurality of capping modules (not shown), each of which corresponds to each head module of each head unit 311, 321, 331, 341. Each capping module is movable between a capping position for capping the nozzle jet openings of each head module corresponding thereto and a separated position where each capping module is separated from the nozzle jet openings. Coupled to each capping module is a suction pump and an air communicating valve or the like for suctioning fluid in a space which is formed after each capping module is moved to the capping position and the whole nozzle jet openings are covered by a rubber member or the like to shutter off the outside air and be sealed. That is, the air and the ink inside the space are suctioned by the suction pump. The ink suctioned by the suction pump is discharged to the waste ink tank. The configurations of the suction pump, the air communicating valve, the waste ink tank and the like are same as those of the earlier technique, therefore the detailed descriptions thereof are omitted here.

In the first embodiment, explanation will be made to an example, in which a suction operation which is a representative of a maintenance method is adopted as a method to solve nozzle clogging. However, a flashing operation may be adopted, in which electrical signals are given to the heads, jetting ink droplets, and flashing foreign materials or the like adhered to the nozzle jet openings and the nozzle-plates.

Further, a mechanism for performing a wiping operation to wipe unnecessary ink droplets adhered to the nozzle-plates after the suction operation or the flashing operation may be provided.

The nozzle clogging detection part 601 is provided at the lower portion of the head unit part 301 to face thereto across the portion near the lower portion of the upper surface of the carrying belt 21, and is movable to the predetermined position corresponding to each head unit 311, 321, 331, 341. A plurality of nozzle clogging detection parts 601 extends in the longitudinal direction of the head units and is alternately arranged in parallel with each other at a predetermined interval in the carrying direction X of the recording medium P, to correspond to each head module.

Figure 2B:
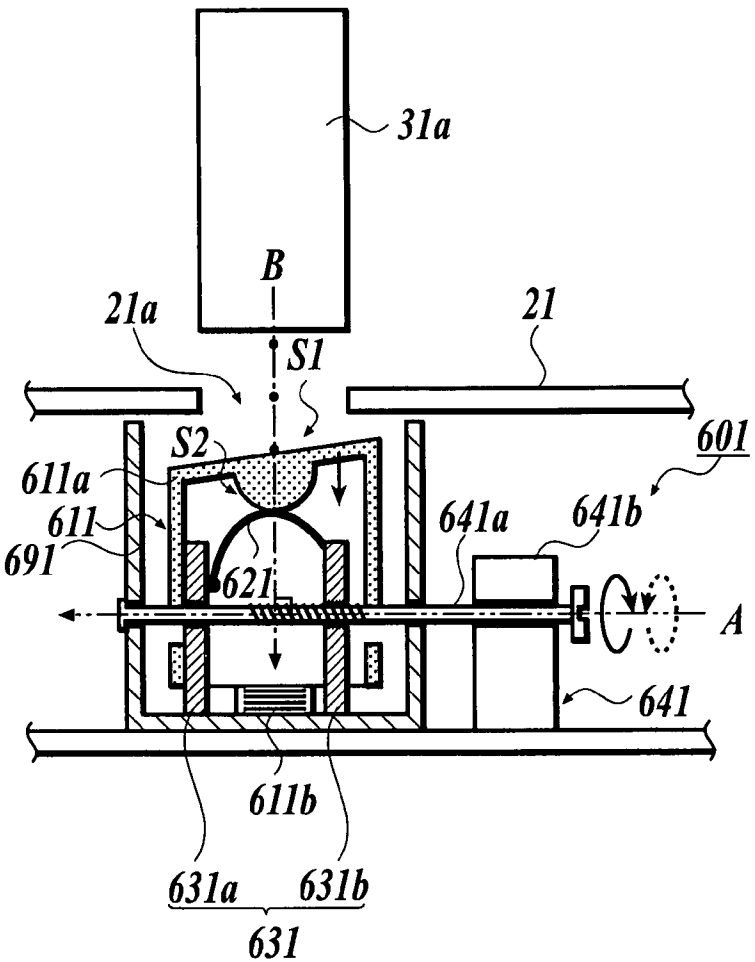
FIG. 2B is an end view of the nozzle clogging detection part 601 in an operating state.
Figure 2A:
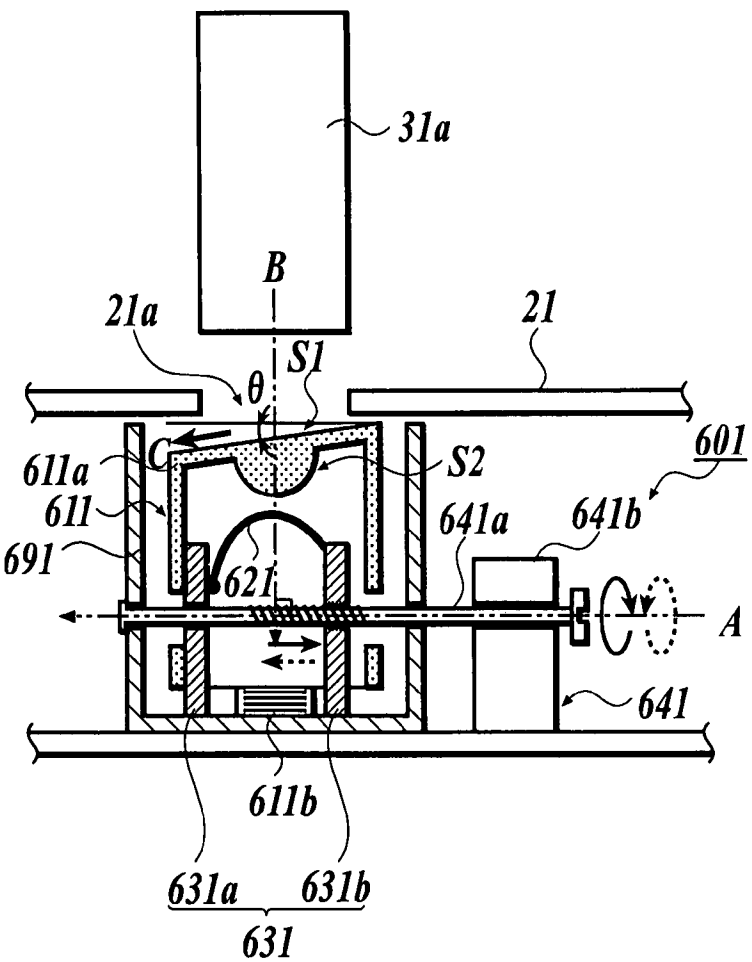
FIG. 2A is an end view of a nozzle clogging detection part 601 in an initial state.

FIGS. 2A and 2B show end views of the nozzle clogging detection part 601.

FIG. 2A shows a state where the nozzle clogging detection part 601 has not received an ink droplet from the head module 31*a* (initial state), and FIG. 2B shown a state where the nozzle clogging detection part 601 has received an ink droplet from the head module 31*a* (operating state).

As shown in FIGS. 2A and 2B, the nozzle clogging detection part 601 comprises an ink droplet receiving part 611 as an ink droplet receiving section, a piezo film 621 as an film like piezoelectric element, a supporting part 631 as a position adjusting section, an adjusting part 641 and the like.

The ink droplet receiving part 611 comprises a cover 611*a* and an elastic supporting member 611*b*, and transmits the impact force generated when ink droplets land onto the piezo film 621.

The cover 611*a* comprises an ink droplet landing surface S1 for receiving ink droplets and a contact surface S2 for transmitting the impact force by contacting with the piezo film 621 when ink droplets land on the ink droplet landing surface S1. The contact surface S2 is provided at a position to face the maximum projecting portion of the curved outer periphery of the piezo film 621, and comprises a projecting portion for transmitting the impact force generated when ink droplets land to the maximum projecting portion. This configuration is successful in improving sensitivity and directivity of the piezo film 621 (piezoelectric element).

Figure 3A:
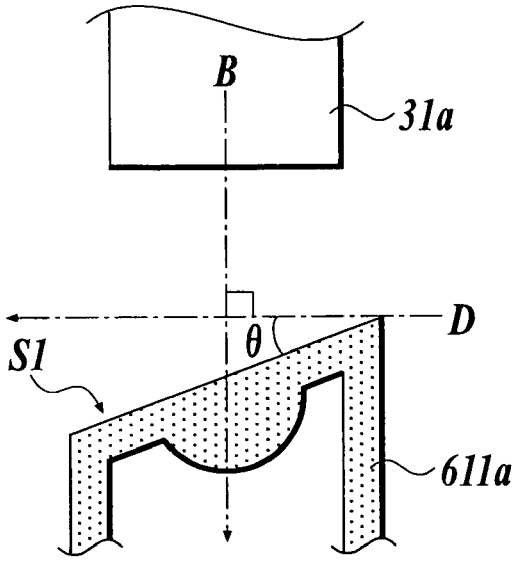
FIG. 3A is a schematic end view of an ink droplet landing surface S1 of a cover 611*a;*
Figure 3B:
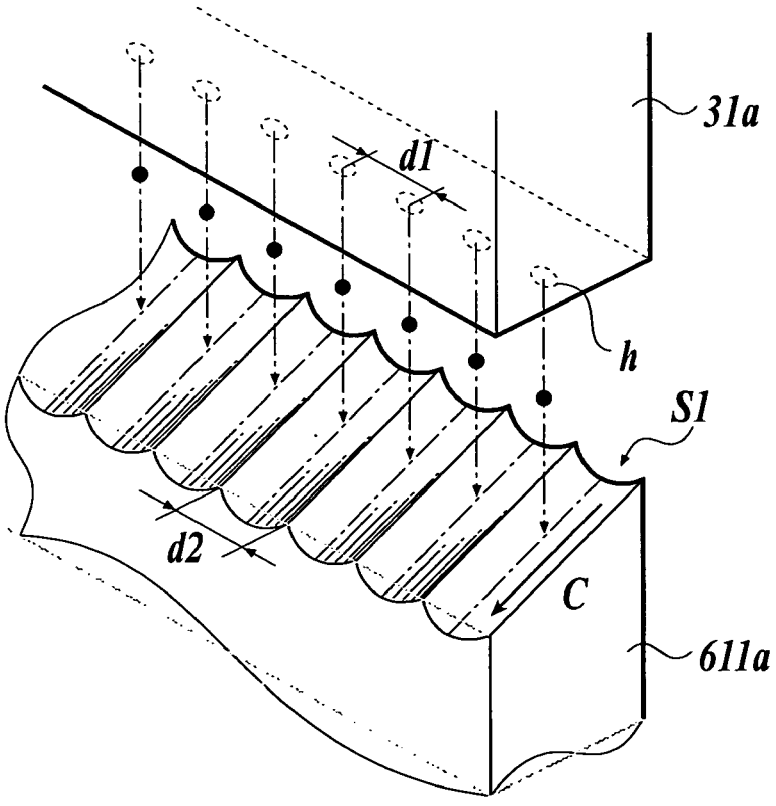
FIG. 3B is a perspective view of an example of a plurality of races formed on the ink droplet landing surface S1 of the cover 611*a;*

FIGS. 3A and 3B show the ink droplet landing surface S1 of the cover 611*a*.

FIG. 3A shows a schematic end view of the ink droplet landing surface S1 of the cover 611*a*, and FIG. 3B shows a perspective view of one example of a plurality of races formed on the ink droplet landing surface S1.

As shown in FIG. 3A, the ink droplet landing surface S1 is inclined at the predetermined tilt angle θ in one direction with respect to a direction D perpendicular to an ink droplet jetting direction B which is the same as the vertical direction. The tilt angle θ is preferably an angle where ink droplets can be removed without decreasing the response property of the piezo film 621 caused when the impact force is resolved.

In the first embodiment, the tilt angle θ of the ink droplet landing surface S1 is set to be between 3° and 30°.

When the tilt angle θ is larger than 3°, even though fluidity of the ink droplets landed onto the ink droplet landing surface S1 would be slightly different depending upon properties of the ink (viscosity, surface tension or the like), a forming material of the cover 611*a*, a method of surface treatment to the cover 611*a* or the like, the ink droplets landed onto the ink droplet landing surface S1 would not remain thereon, therefore, enabling to obtain an effect in removing ink droplets.

When the tilt angle θ is smaller than 30°, it is prevented that the impact force generated by the landing of ink droplets is resolved on the inclined ink droplet landing surface S1 to thereby make the impact force transmitted to the piezo film 621 small. Thus, the output voltage value (piezo vibration signal to be described later) output from the piezo film 621 does not become lower than the thresh level which is set for identifying noise from a disturbance such as an operating vibration of the apparatus itself or the like, so that the response property of the piezo film 621 is improved, thereby improving accuracy for detecting ink droplets.

As described above, since the ink droplet landing surface S1 of the cover 611*a* of the ink droplet receiving part 611, which is for receiving ink droplets jetted from nozzles, is inclined at the predetermined angle in one direction with respect to the direction D perpendicular to the ink droplet jetting direction B, ink droplets run off by their own weigh every time ink droplets land thereon, enabling to remove ink droplets from the ink droplet landing surface S1 without positively removing ink droplets landed thereon. Therefore, the impact force generated by the landing of ink droplets can be detected with high accuracy, and thereby improving judgment accuracy of a jet failure of the nozzles.

This is effective especially for the ink jet printer in which ink with relatively low viscosity at room temperature such as oil-based ink or water-based ink is used. Further, as a method for improving the effect, for example, in the ink jet printer in which water-based ink is used, the ink can be effectively removed by performing water repellent treatment to the surface of the cover 611*a* on which ink droplets landed.

The tilt angle θ of the ink droplet landing surface S1 is between 3° and 30°, so that the impact force generated when ink droplets land can be transmitted to the piezo film 621 without decreasing the impact force, and the ink droplets can be efficiently removed.

As shown in FIG. 3B, a plurality of races are formed to be parallel to one another on the ink droplet landing surface S1. Each race is opened on one end side in an longitudinal direction, and is inclined such that the opened portion at one end side in the longitudinal direction is positioned lower than the other end side in the vertical direction (that is, ink droplet jetting direction B). The arrangement pitch of the races d2 (hereinafter, referred as race pitch) is formed to be equal to that of the nozzles (hereinafter, referred as nozzle pitch) d1.

The cover 611*a* on which the races are formed is provided such that a bottom portion of each race corresponds to a position to which an ink droplet jetted from each nozzle jet opening h landed.

Providing such the races is successful in discharging ink droplets without positively removing the ink droplets landed onto the ink droplet landing surface S1 because the ink droplets run off along the inclination direction C of the races every time ink droplets land. Therefore, the impact force generated by landing of ink droplets can be detected with high accuracy, enabling to improve judgment accuracy of a jet failure of the nozzles.

Since the race pitch d2 is equal to the nozzle pitch d1, the races each of which corresponds to each nozzle jet opening h can be formed. Thus, ink droplets can be efficiently discharged. Also, since the bottom portion of each race corresponds to a position onto which ink droplets land, it can be prevented that the ink droplets hit the upper end of the races to disperse. Thus, the ink droplets can be efficiently discharged. Moreover, the impact force generated when ink droplets land can be efficiently received by the cover 611*a*.

The races in the first embodiment are effective in the ink jet printer in which ink with relatively low viscosity in room temperature such as oil-based ink or water-based ink. Further, as a method for improving the effect, for example, in the ink jet printer in which water-based ink is used, the ink can be effectively removed by performing water repellent treatment to the surface of the cover 611*a* on which ink droplets land.

The shape of cross section of each race in the first embodiment may be a curved shape other than an approximately semicircle shown in FIG. 3B, and the shape is not limited thereto as long as a shape is capable of efficiently discharging ink droplets and is easily formed.

The cover 611*a* extends in the longitudinal direction of the head module corresponding thereto to be interposed between the nozzles and the piezo film 621, so that the piezo film 621 can be protected from various ink droplets. Thus, the response property of the piezo film 621 can be protected. Specifically, in the ink jet printer in which a property (viscosity) of the ink to be jetted is changed depending upon the ink used, there is a case where the ink is heated to the temperature higher than room temperature, and the ink droplets with high temperature are detected. In such the ink jet printer, the temperature of the piezo film rises after receiving tens of ink droplets, which would cause a change to the response property of the piezo film. Thus, the cover 611*a* has a purpose to prevent such the change of the response property. When the ink to be used is electrically conductive ink, the cover 611*a* can prevent the piezo film from being damaged when the electrically conductive ink contacts the output signal terminals of the piezo film.

The cover 611*a* is kept in resting state by the elastic supporting member 611*b* provided on the bottom portion, and transmits small impact force generated when the ink droplets land onto the piezo film 621, so that it is preferable to use workpiece materials which are light in weight and can be formed to be an arbitrary shape such as plastic or the like.

The elastic supporting member 611*b* keeps the contact surface S2 of the cover 611*a* and the piezo film 621 in a non-contact state when the ink droplet landing surface S1 does not receive ink droplets, and supports the cover 611*a* to make the contact surface S2 of the cover 611*a* be in the contact state with the piezo film 621 when the ink droplet landing surface S1 receives ink droplets.

In the first embodiment, when the ink droplet landing surface S1 does not receive ink droplets, the contact surface S2 and the piezo film 621 are set to be in the non-contact state, however, both of them may contact with each other, that is, the present invention is not limited to this embodiment so long as the piezo film 621 and the contact surface S2 are in a stationary state while keeping a certain equilibrium state.

The piezo film 621 is curved into an approximately half cylinder ahead in the ink droplet jetting direction by the support part 631, and is supported to make the maximum projecting portion of the curved outer periphery direct to an ink droplet coming direction. The piezo film 621 extends corresponding to the longitudinal direction of the head module.

In the first embodiment, the landing of ink droplets is detected by using piezoelectric elements of the piezo film 621. To further improve sensitivity and directivity of the piezo film 621, the piezo film 621 is curved into an approximately half cylinder, and ink droplets from the ink droplet coming direction land onto the maximum projecting portion of the curved outer periphery (that is, the maximum projecting portion of the piezo film 621 which is curved into an approximately half cylinder contacts with the projecting portion of the contact surface S2).

The piezo film 621 used in the first embodiment may be any piezoelectric element as long as the piezoelectric element is formed in a film shape, which is easy to thin even when it has a large size, with piezoelectric effect and improved productivity, having excellent flexibility, impact-resistance, chemical stability or the like in comparison with an earlier developed piezoelectric ceramic or the like, and has a better output response to impact or shape changing, wide frequency characteristic or the like.

Figure 4A:
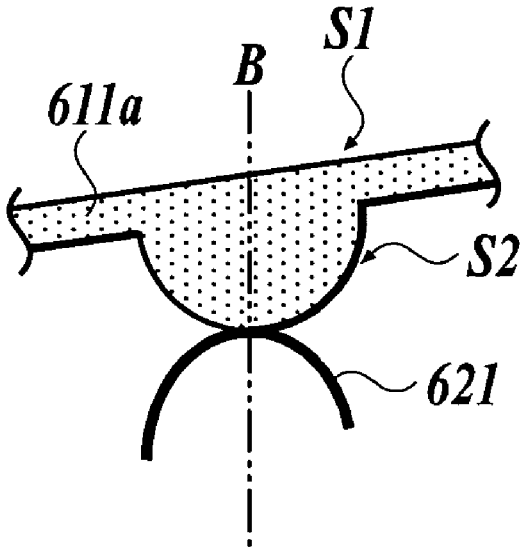
FIG. 4A is a view in which a maximum projecting of a contact surface S2 of the cover 611*a* contacts with a maximum projecting portion of a piezo film 621.
Figure 4B:
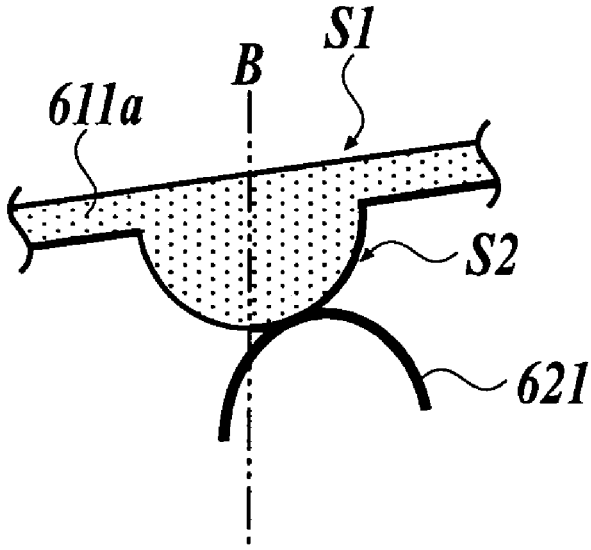
FIG. 4B is a view in which the contact surface S2 of the cover 611*a* contacts with the piezo film 621.

FIGS. 4A and 4B show sectional views of an example of a contact state of the contact surface S2 of the cover 611*a* and the piezo film 621. FIG. 4A shows a state that the maximum projecting portion of the contact surface S2 of the cover 611*a* having a projecting portion contacts with the maximum projecting portion of the piezo film 621, and FIG. 4B shows a state that the contact surface S2 of the cover 611*a* contacts with the piezo film 621.

As shown in FIG. 4A, in the case where the maximum projecting portion of the cover 611*a* contacts with the maximum projecting portion of the curved outer periphery of the piezo film 621, when ink droplets from the nozzle jet openings land on the ink droplet landing surface S1, a small impact force generated by the landing of the ink droplets onto the ink droplet landing surface S1 can be concentrated on the maximum projecting portion of the contact surface S2, thereby enabling the maximum projecting portion of the piezo film 621 to receive the impact force. Thus, the impact force by the ink droplets can efficiently be transmitted, so that high sensitivity and response property can be obtained.

As shown in FIG. 4B, in the case where the contact surface S2 contacts with the piezo film 621 at portions other than the maximum projecting portions, the impact force by the landing of ink droplets on the ink droplet landing surface S1 would be dispersed, and further the dispersed impact force would be received by the curved surface of the piezo film 621, thereby reducing the transmission efficiency of the force, which results in lowering the sensitivity and response property.

Thus, the position of the maximum projecting portion of the curved outer periphery of the piezo film 621 is adapted to be movable, and the nozzle clogging detection part 601 comprises the supporting part 631 and the adjusting part 641 for adapting the maximum projecting portion to the ink droplet landing position. Adaptation of the maximum projecting portion of the curved outer periphery of the piezo film 621 to the ink droplet landing position is successful in adjusting the shape of the piezo film, thereby enabling to adjust the response property of the piezo film 621.

The supporting part 631 curves the piezo film 621 into approximately half cylinder to support it. The supporting part 631 comprises a fixed supporting part 631*a* and a movable supporting part 631*b*. The facing surfaces of the fixed supporting part 631*a* and the movable supporting part 631*b* are provided to be perpendicular to a rotating axis A of a screw 641*a* which will be described later and in parallel with each other.

The piezo film 621 is fixed to the fixed supporting part 631*a* at one end side thereof in a curving direction, and the fixed supporting part 631*a* is provided not to move irrespective of the rotation of the screw 641*a*.

The movable supporting part 631*b* supports the other end side of the piezo film 621 opposing to the one end side of the piezo film 621 in the curving direction which is fixed to the fixed supporting part 631*a*. A female screw hole in which a male screw part of the screw 641*a* is screwed is formed in the movable supporting part 631*b*, so that the movable supporting part 631*b* is movable to be close to or separated from the fixed supporting part 631*b* corresponding to the rotation direction of the screw 641*a*.

The adjusting part 641 comprises the screw 641*a* and a supporting base 641*b*.

The screw 641*a* is disposed such that the rotating axis A of the screw 641*a* is perpendicular to the ink droplet jetting direction B, and is rotatably supported by the supporting base 641*b* and a casing 691. The screw 641*a* has the male screw part in a movable rage of the movable supporting part 631*a*, which is screwed in the female screw hole of the movable supporting part 631*a*.

For example, in FIG. 2A, when the screw 641*a* is rotated in a right-handed screw direction, the movable supporting part 631*b* is moved to the right side, and when the screw 641*a* is rotated in a left-handed screw direction, the movable supporting part 631*b* is moved to the left side.

Accordingly, the other end side of the piezo film 621 can be movably supported to be close to or separated from the one end of the piezo film 621 in the curving direction, and the position of the maximum projecting portion of the curved outer periphery is adapted to the ink droplet landing position, so that the position of the maximum projecting portion of the curved outer periphery can be adjusted right to left and up and down. Therefore, the adjustment of the response property of the piezo film 621 can be realized.

Figure 5:
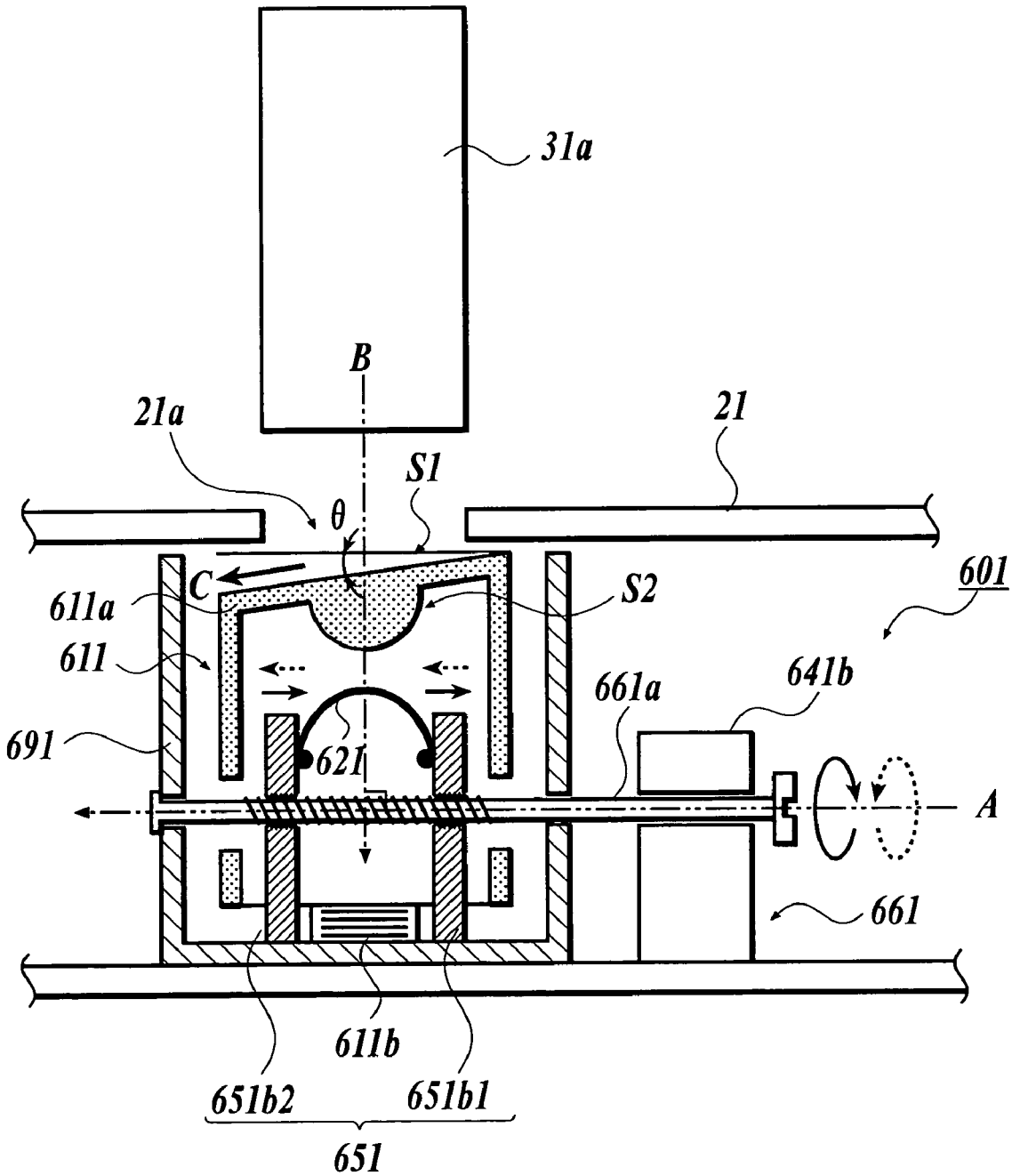
FIG. 5 is an end view of another example 1 of the nozzle clogging detection part 601 shown in FIG. 2A.
Figure 6:
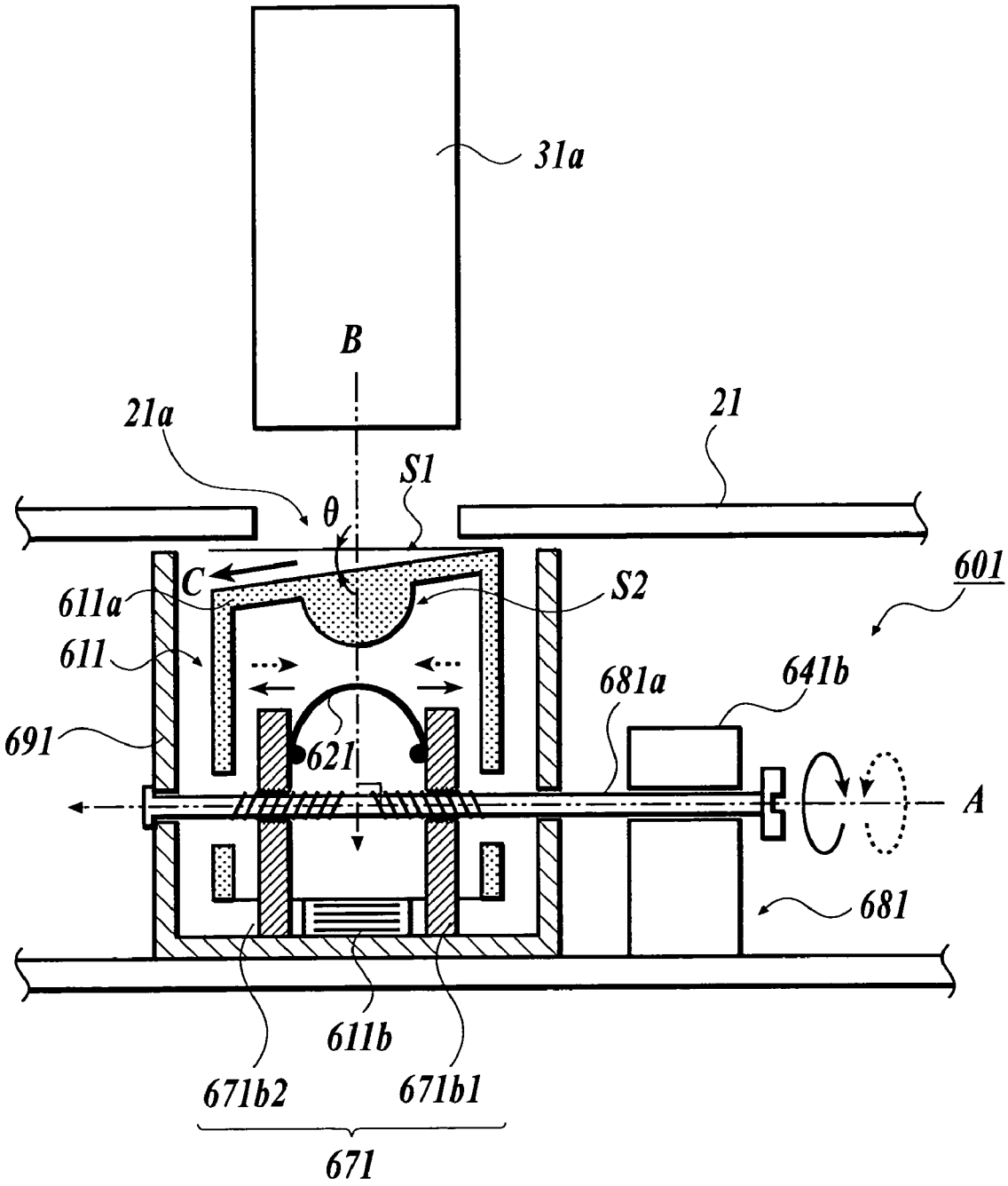
FIG. 6 is an end view of another example 2 of the nozzle clogging detection part 601 shown in FIG. 2A.

FIGS. 5 and 6 show end views of other examples 1 and 2 of the nozzle clogging detection part 601.

The nozzle clogging detection part 601 shown in FIGS. 5 and 6 has a configuration same as that in FIG. 2 excluding supporting parts 651, 671 and adjusting parts 661, 681 respectively provided instead of the supporting part 631 and the adjusting part 641, therefore the explanations thereof are omitted here.

The supporting part 651 shown in FIG. 5 curves the piezo film into approximately half cylinder and support it. The supporting part 651 comprises a first movable supporting part 651*b*1 and a second movable supporting part 651*b*2. The facing surfaces of the first movable supporting part 651*b*1 and the second movable supporting part 651*b*2 are provided to be perpendicular to a rotating axis A of a screw 661*a* which will be described later and in parallel with each other with an interval therebetween kept constant.

The piezo film 621 is fixed to the first movable supporting part 651*b*1 at one end side thereof in the curving direction, and a female screw hole in which a male screw part of the screw 661*a* to be described later is screwed is formed in the first movable supporting part 651*b*1, so that the first movable supporting part 651*b*1 is reciprocatingly movable in the direction of the rotating axis A corresponding to the rotation direction of the screw 661*a*.

The other end side of the piezo film 621 opposing to the one end side thereof in the curving direction which is fixed to the first movable supporting part 651*b*1 is fixed to the second movable supporting part 651*b*2. A female screw hole in which the male screw part of the screw 661*a* is screwed is formed in the second movable supporting part 651*b*2, so that the second movable supporting part 651*b*2 is reciprocatingly movable in the direction of the rotating axis A corresponding to the rotation direction of the screw 661*a*.

The adjusting part 661 comprises the screw 661*a* and the supporting base 641*b*.

The screw 661*a* is disposed such that the rotating axis A of the screw 661*a* is perpendicular to the ink droplet jetting direction B, and is rotatably supported by the supporting base 641*b* and the casing 691. The screw 661*a* has the male screw part in a movable rage of the first and the second movable supporting parts 651*b*1, 651*b*2, which is screwed in the female screw holes.

The first and the second movable supporting parts 651*b*1, 651*b*2 are moved in parallel in the same direction according to the direction of rotating axis A of the screw 661*a* with an interval therebetween kept constant.

For example, in FIG. 5, when the screw 661*a* is rotated in a right-handed screw direction, the first and the second movable supporting parts 651*b*1, 651*b*2 are moved in parallel to the right side with an interval therebetween kept constant, and when the screw 661*a* is rotated in a left-handed screw direction, the first and the second movable supporting part 651*b*1, 651*b*2 are moved in parallel to the left side.

Accordingly, the one end side of the piezo film 621 in the curving direction and the other end side thereof opposing to the one side can be supported to be movable in parallel in the same direction with an interval therebetween kept constant, and the position of the maximum projecting portion of the curved outer periphery is adapted to the ink droplet landing position, so that the position of the maximum projecting portion of the curved outer periphery can be adjusted right to left without changing the curved shape of the piezo film 621. Therefore, the adjustment of the response property of the piezo film 621 can be realized.

The supporting part 671 shown in FIG. 6 curves the piezo film into approximately half cylinder and support it. The supporting part 671 comprises a first movable supporting part 671*b*1 and a second movable supporting part 671*b*2. The facing surfaces of the first movable supporting part 671*b*1 and the second movable supporting part 671*b*2 are provided to be perpendicular to the rotating axis A of a screw 681*a* which will be described later and in parallel with each other.

The piezo film 621 is fixed to the first movable supporting part 671*b*1 at one end side thereof in the curving direction, and a female screw hole in which a male screw part of the screw 681*a* to be described later is screwed is formed in the first movable supporting part 671*b*1, so that the first movable supporting part 671*b*1 is movable in the direction of the rotating axis A to be relatively close to or separated from the second movable supporting part 671*b*2 corresponding to the rotation direction of the screw 681*a*.

The other end side of the piezo film 621 opposing to the one end side thereof in the curving direction which is fixed to the first movable supporting part 671*b*1 is fixed to the second movable supporting part 671*b*2. A female screw hole in which a male screw part of the screw 681*a* is screwed is formed in the second movable supporting part 671*b*2, so that the second movable supporting part 671*b*2 is movable in the direction of the rotating axis A to be relatively close to or separated from the first movable supporting part 671*b*1 corresponding to the rotation direction of the screw 681*a*.

The adjusting part 681 comprises the screw 681*a* and the supporting base 641*b*.

The screw 681*a* is disposed such that the rotating axis A of the screw 681*a* is perpendicular to the ink droplet jetting direction B, and is rotatably supported by the supporting base 641*b* and the casing 691. The screw 681*a* has male screw parts in movable rages of the first and second movable supporting part 671*b*1, 671*b*2, respectively, to oppose each other, and each male screw parts is screwed in each female screw hole. The first and the second movable supporting parts 671*b*1, 671*b*2 are moved to be relatively close to or separated from each other corresponding to the direction of the rotating axis A of the screw 681*a*.

For example, in FIG. 6, when the screw 681*a* is rotated in a right-handed screw direction, the first and the second movable supporting parts 671*b*1, 671*b*2 are moved in a direction to be separated from each other, and when the screw 681*a* is rotated in a left-handed screw direction, the first and the second movable supporting parts 617*b*1, 671*b*2 are moved to be close to each other.

Accordingly, the one end side of the piezo film 621 in the curving direction and the other end side thereof opposing to the one end can be supported to relatively move to be close to or separated from each other, and the position of the maximum projecting portion of the curved outer periphery is adapted to the ink droplet landing position, so that the position of the maximum projecting portion of the curved outer periphery can be adjusted up to down by changing the curved shape of the piezo film 621. Therefore, the adjustment of the response property of the piezo film 621 can be realized.

As described above, by providing the supporting part 631 and the adjusting part 641, the curvature of the curved piezo film 621 can be changed to adjust the position of the maximum projecting portion of the curved outer periphery, thus, the distance between the cover 611*a* and the piezo film 621, and the initial shape of the piezo film 621 can be adjusted. Accordingly, in the initial state, appropriate adjustment of the position can be performed so as not to output a signal from the piezo film 621 by some impact (operating vibration of the machine itself, a misalignment of the setting position of the ink receiving member 611, or the like). Appropriate adjustment of the position of the piezo film 621 to the ink droplet landing position is successful in obtaining high response property in the operating state, so that the changes of the landing of fine ink droplets can be detected with high accuracy.

The rotating operation of the screws 641*a*, 661*a*, 681*a* by the adjusting part 641 may be performed manually or automatically. In the case of automatically performing the rotating operation, for example, a feed screw mechanism may be applied, in which a ball screw or the like is used as the screws 641*a*, 661*a*, 681*a* in the adjusting part 641. That is, for example, in the case of adjusting the initial shape of the piezo film 621, the configuration is such that the value of rotation amounts corresponding to shape of the piezo film 621 is prestored in the nonvolatile memory which is under the control of the CPU, and the driving force from the drive source which can be controlled by the predetermined control device can be transmitted to the screws 641*a*, 661*a*, 681*a*. Thus, the driving force from the drive source can be controlled based on the stored data in the nonvolatile memory. Thereby, the rotation amount can be automatically adjusted to adjust the position of the maximum projecting portion of the curved outer periphery, so that the initial shape of the piezo film 621 can be adjusted.

FIG. 7 shows a control block diagram for controlling the ink jet printer 1A of the first embodiment. As shown in FIG. 7, the control system comprises a control unit 101 and a nozzle clogging detection circuit 201.

In the control unit 101, a CPU (Central Processing Unit) 111 as a judging section, a ROM (Read Only Memory) 121, a RAM (Random Access Memory) 131, an I/O (Input/Output) 141, a various machines control unit 151, I/F 161, a drive circuit 171 as a drive section and the like are connected to a system bus 181, and the control unit 101 is connected to the nozzle clogging detection circuit 201 through the I/F 161.

The nozzle clogging detection circuit 201 comprises a shape correction circuit 211, an amplifier circuit 221, a filter circuit 231, a peak hold part 241 as a sampling section, an A/D conversion circuit 251 or the like.

The CPU 111 reads out a system program, various processing programs and data stored in the ROM 121, expanding them in the RAM 131, and performs a central control of operations of the whole ink jet printer 1A according to the programs expanded. That is, the CPU 101 performs a timing control of the whole system, storing and accumulation controls of data with the use of the RAM 131, an output of print data to each head module, an input-output control of an operating portion which is not shown, an interface (I/F) to other applications, or an operation control.

To realize the first embodiment, a maximum voltage value, a count number or an output cycle as a judgmental standard of the nozzle clogging judging operation is appropriately set to judge nozzle clogging. When the control unit 101 judges that nozzle clogging exists, the maintenance part 501 is controlled to drive to solve nozzle clogging.

When the maximum voltage value is used as the judgmental standard for nozzle clogging, a maximum voltage value $V_{max}$ of a sampling detected signal Sd' to be described later which is stored in the RAM 131 is calculated for each jetting operation, and each maximum voltage value $V_{max}$ is compared with the standard voltage value $V_0$ to judge nozzle clogging.

When the count number is used as the judgmental standard for nozzle clogging, nozzle clogging is judged by counting the number of the sampling detected signals Sd' which are not less than the predetermined standard voltage value $V_0$, and comparing the count number N which was counted with the number of ink droplet jetting operations n.

When the output cycle is used as the judgmental standard, a standard cycle T0 as an output cycle of an ink jet signal $S_{m1}$ is compared with each detected cycle T1 as an output cycle of the sampling detected signal Sd' to judge nozzle clogging.

The ROM 121 stores a program or a system program for driving the ink jet printer 1A, various programs corresponding to the system, data necessary for processing with the various processing programs.

To realize the first embodiment, the ROM 121 stores the standard voltage value $V_0$, which is the maximum voltage value of the sampling detected signal Sd' when ink droplets are properly jetted onto the ink droplet landing surface S1, the predetermined number of ink droplet jetting operations n, and a delay time $t_d$ to be described later.

The RAM 131 is a temporally storing region for programs, input or output data, parameters read out from the ROM 121 in various processing controlled and executed by the CPU 111.

To realize the first embodiment, the RAM 131 temporally stores the sampling detected signal Sd' input from the A/D conversion circuit 251 through the I/F, the maximum voltage values $V_{max}$ calculated by the CPU 111, the count number N which was found by counting the number of the sampling detected signals Sd' not less than the predetermined standard voltage value $V_0$, and the standard cycle T0 of the ink jet signal $S_{m1}$ and the detected cycles T1 of the sampling detected signal Sd' which are clocked by a timer or the like, in chronological order.

The I/O 141 is for input and output of data between the control unit 101 and a control unit of each portion. To realize the first embodiment, the I/O 141 is connected to a shape correction control unit for controlling the shape of the piezo film 621 and a maintenance control unit for controlling the operations of the maintenance part 501, and also connected to control units such as an ink supply/waste fluid control unit, a waste ink control unit or the like.

The various machines control unit 151 is connected to a paper feed control unit for controlling various rollers and the paper pick up device 12 of the paper feed part 10, a carrying control unit for controlling various rollers of the carrying part 20, and a sensor control unit for driving various sensors provided in the ink jet printer 1A and the like, each of which operates based on the instructions from the CPU 111.

The drive circuit 171 calculates the ink jet signal $S_{m1}$ for jetting ink droplets from the nozzle jet openings by driving the nozzles of each head module of each head unit 311, 321, 331, 341, and a sampling signal $S_s$ which is delayed from the ink jet signal $S_{m1}$ by the time it takes for ink droplets jetted from the nozzle jet openings land on the ink droplet landing surface S1 (hereinafter, referred as delay time $t_d$), based on the print data and a jet drive signal $S_{m0}$ from the CPU 111.

The calculated ink jet signal $S_{m1}$ is output to the nozzles of each head module, and the sampling signal $S_s$ is output to the peak hold part 241.

The delay time $t_d$ is determined based on the drive waveform condition of the ink jet signal $S_{m1}$.

The drive waveform condition is determined based on the ink type to be jetted (for example, water-based ink, oil-based ink, ultraviolet curable ink, solid ink or the like), the jetting method (piezo system using piezoelectric elements, thermal system using a heater, or the like), a head configuration or the like.

The shape correction circuit 211 adjusts the output signal from the piezo film 621 based on the instructions from the shape correction control unit to make the piezo vibration signal Sd to be output constant within the range of the preset initial value in a case where the piezo film 621 is in the initial condition.

The piezo vibration signal Sd as a detection signal output from the piezo film 621 is amplified and adjusted by the amplifier circuit 221, and is subjected to filtering out noise with the filter circuit 231. The denoised piezo vibration signal Sd is input to the peak hold part 241.

The peak hold part 241 extracts the piezo vibration signal Sd input from the filter circuit 231 based on the sampling signal $S_s$ input from the drive circuit 171. The extracted piezo vibration signal Sd is, as the sampling detected signal Sd', subjected to A/D conversion by the A/D conversion circuit 251 to be stored in the RAM 13 through the I/F 161.

Figure 8:
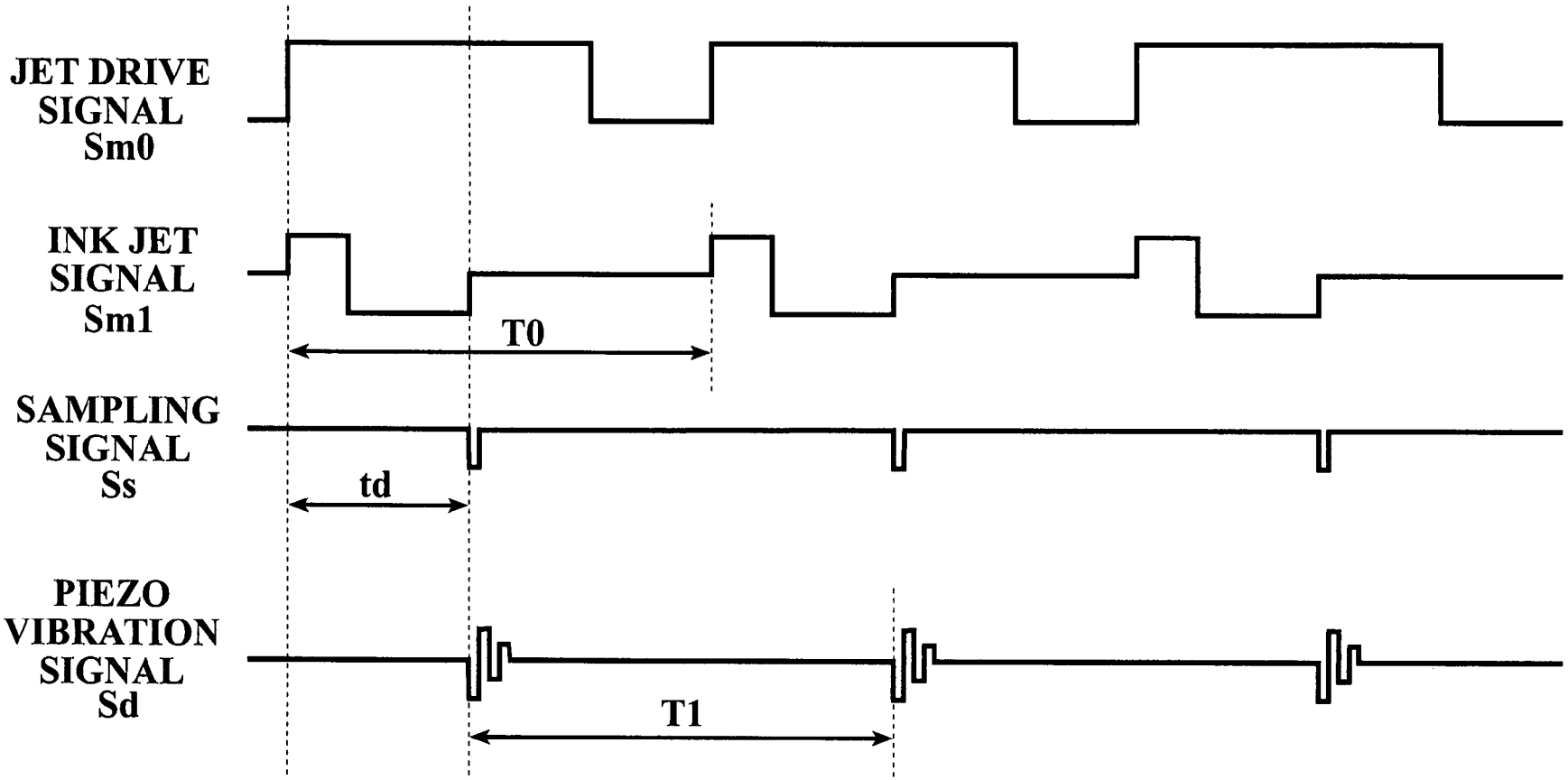
FIG. 8 is a time chart of an operation of jetting an ink droplet from a nozzle jet opening.

FIG. 8 shows an example of a time chart of the operation to jet ink droplets from the nozzle jet openings.

As shown in FIG. 8, there are shown the jet drive signal $S_{m0}$ as the instruction signal of the ink droplet jetting operation, which is output from the CPU 111 to the drive circuit 171, the ink jet signal $S_{m1}$ and the sampling signal $S_s$, which are output from the drive circuit 171 based on the jet drive signal $Sm_0$ to the head of the head module 31*a* and the peak hold part 240, respectively, and the piezo vibration signal Sd output from the piezo film 621 based on the ink jet signal $S_{m1}$.

After the jet drive signal $S_{m0}$ is output, the ink jet signal $S_{m1}$ is output. When the delay time $t_d$ passes after the output of the ink jet signal $S_{m1}$, the sampling signal $S_s$ is output. Also, when the delay time $t_d$ passes, ink droplets land onto the ink droplet landing surface S1, so that the piezo vibration signal Sd is output. The piezo vibration signal Sd is extracted based on the sampling signal $S_s$, and the nozzle clogging judging operation is performed.

When there is no nozzle clogging, the standard cycle T0 of the ink jet signal $S_{m1}$ equals to the detected cycle T1 of the piezo vibration signal Sd.

Next, description will be made for the nozzle clogging judging operation performed by the control unit 101.

Figure 9:
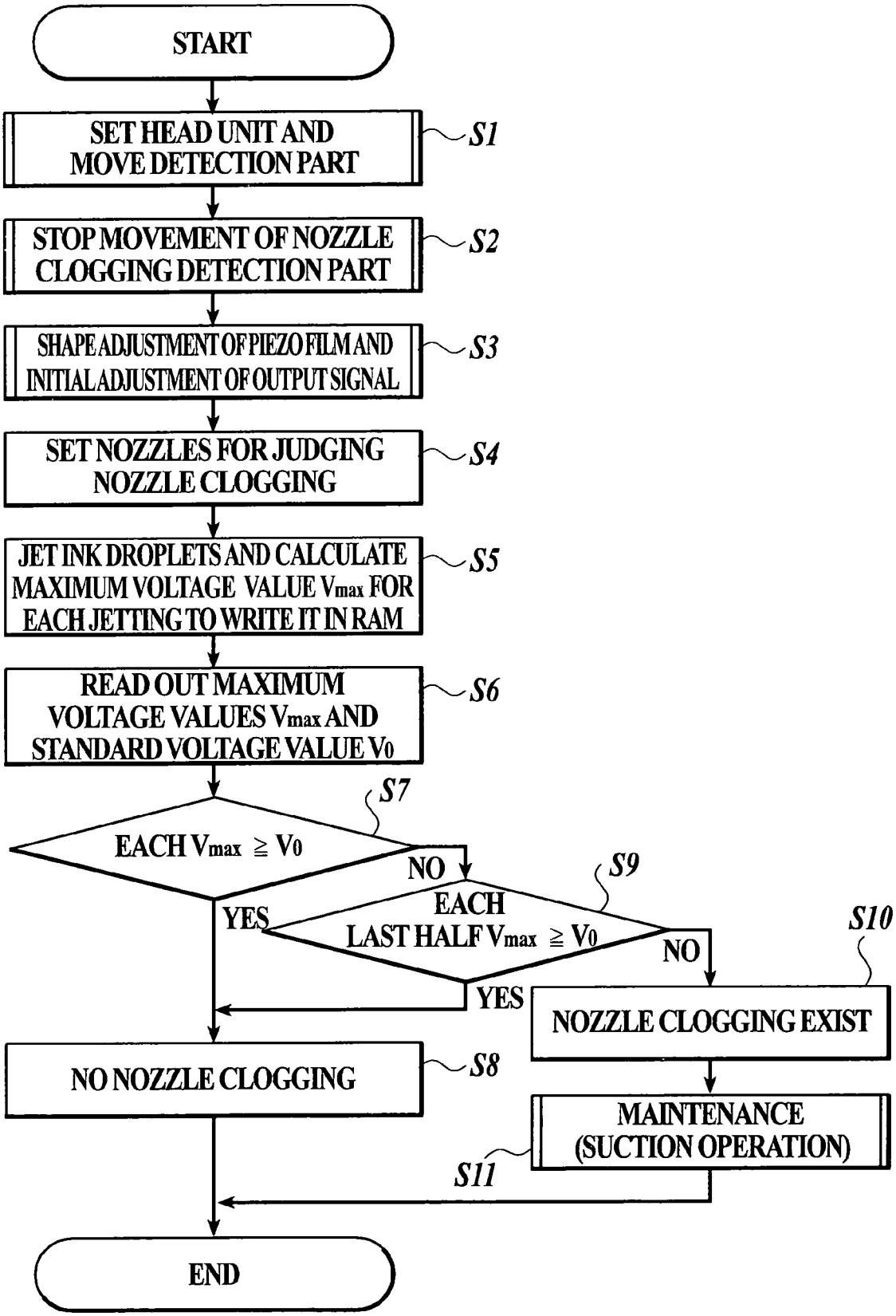
FIG. 9 is a flow chart of a nozzle clogging judging operation in a case where a judgmental standard in the first embodiment is a maximum voltage value.
Figure 10:
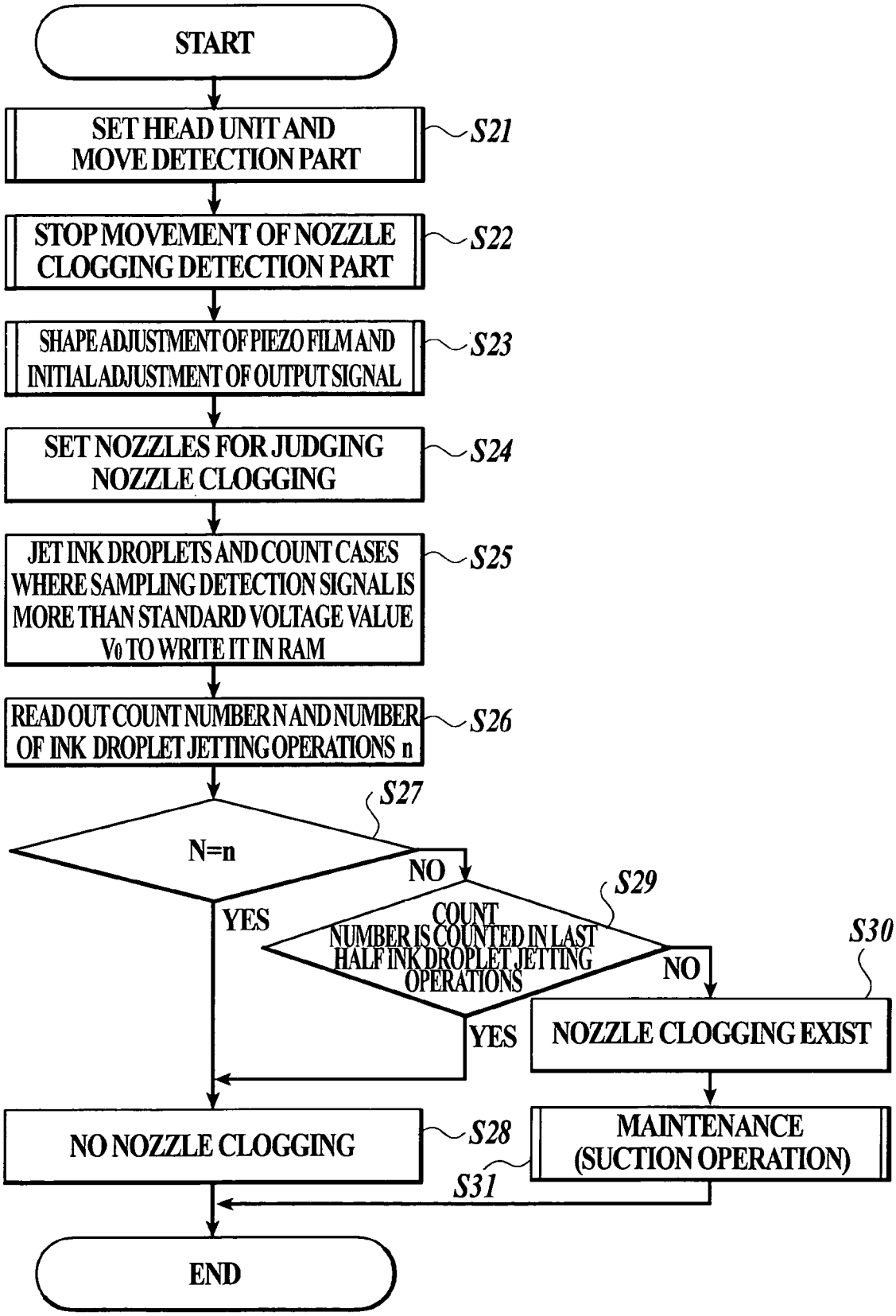
FIG. 10 is a flow chart of the nozzle clogging judging operation in a case where the judgmental standard in the first embodiment is a count number.
Figure 11:
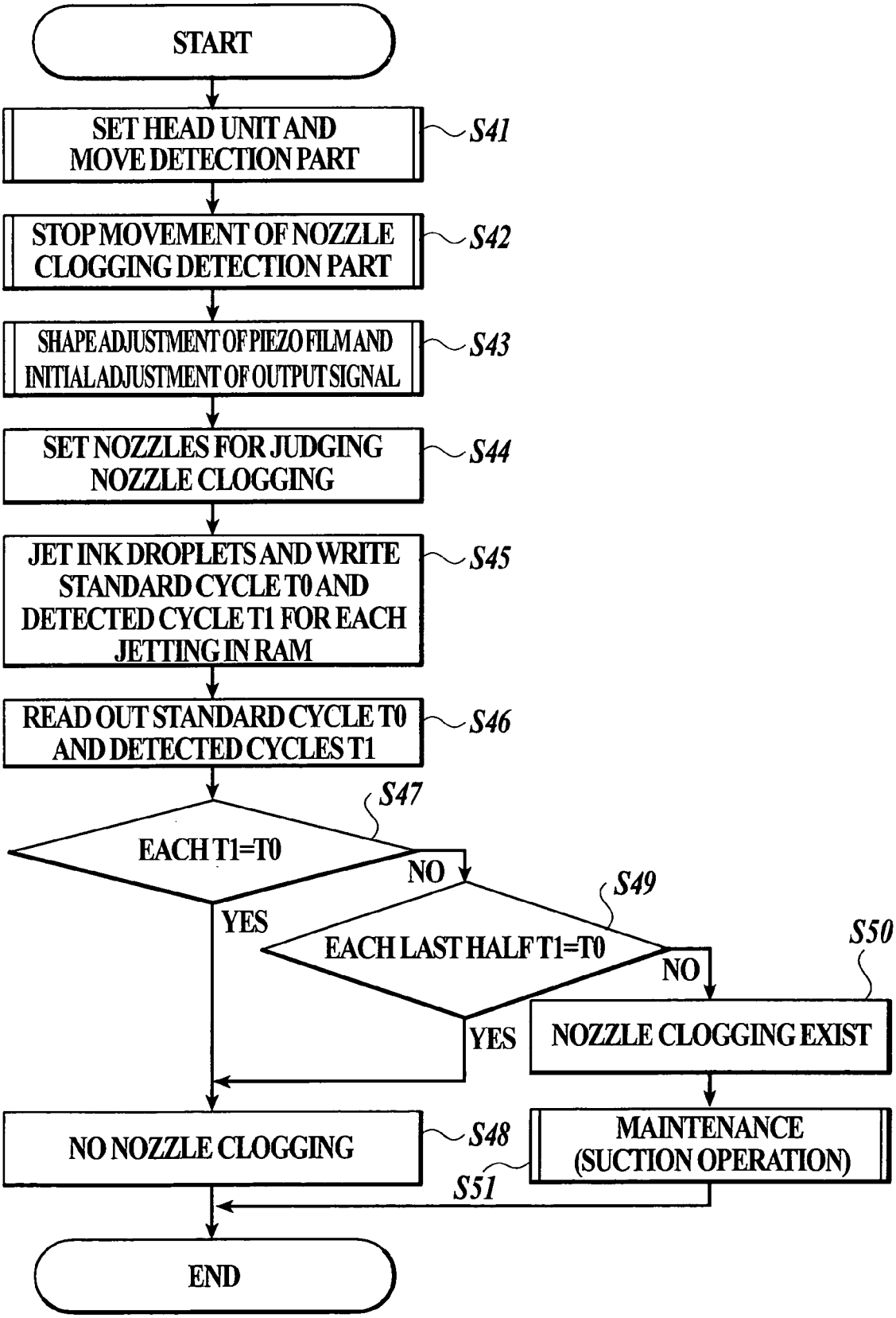
FIG. 11 is a flow chart of the nozzle clogging judging operation in a case where the judgmental standard in the first embodiment is an output cycle.

FIGS. 9 to 11 show flow charts of the nozzle clogging judging operation of the first embodiment.

FIG. 9 shows a flow chart in a case where the nozzle clogging judging operation is performed based on the maximum voltage value $V_{max}$ of the sampling detected signal Sd' as a judgmental standard.

The head unit which is subjected to the nozzle clogging judgment is set. Thereafter, the nozzle clogging detection part 601 is moved to a predetermined position below the set head unit (Step S1).

After the nozzle clogging detection part 601 was moved to the predetermined position, mechanical vibration of the nozzle clogging detection part 601 is stopped (Step S2).

After the nozzle clogging detection part stopped moving, the shape of the piezo film 621 is adjusted. Also, the output signal from the piezo film 621 is adjusted so that the piezo vibration signal Sd to be output from the piezo film 621 is constant within the range of the preset initial value (Step S3).

After the initial setting of the output signal from the piezo film 621, nozzles for judging nozzle clogging are set (Step S4).

The ink jet signal $S_{m1}$ is output to the set nozzles, and then ink droplets are jetted. When the ink droplets jetted land on the ink droplet landing surface S1, the piezo vibration signal Sd is output from the piezo film 621, and the sampling detected signal Sd' is stored in the RAM 131 based on the sampling signal $S_s$. The maximum voltage value $V_{max}$ of the sampling detected signal Sd' is calculated for each ink droplet jetting operation to be stored in the RAM 131 (Step S5).

When the ink droplet jetting operation from the set nozzles is performed as many times as the number of ink droplet jetting operations n, all maximum voltage values $V_{max}$ of the ink droplet jetting operations stored in the RAM 131 in chronological order, and the standard voltage value $V_0$ stored in the ROM 121 are read out to the CPU 111 (Step S6).

In the judgment step (S7) as the judgment section, a judgment is made whether each maximum voltage value $V_{max}$ of the ink droplet jetting operations which was read out is not less than the standard voltage value $V_0$.

When each maximum voltage value $V_{max}$ is not less than the standard voltage value $V_0$ (Step S7; Yes), the ink droplet jetting operations are judged to be normal, therefore, a judgment is made that there is no nozzle clogging (Step S8).

When not all the maximum voltage values $V_{max}$ are not less than the standard voltage value $V_0$ (Step S7; No), a judgment is made whether each maximum voltage value $V_{max}$ in the last half of the ink droplet jetting operations is not less than the standard voltage value $V_0$ (Step S9).

When each maximum voltage value $V_{max}$ in the last half of the ink droplet jetting operations is not less than the standard voltage value $V_0$ (Step S9; Yes), the ink droplet jetting operations are judged to be normal, and a judgment is made that there is no nozzle clogging (Step S8).

When not all the maximum voltage values $V_{max}$ in the last half of the ink droplet jetting operations are not less than the standard voltage value $V_0$ (Step S9; No), the ink droplet jetting operations are judged to be abnormal, and a judgment is made that nozzle clogging exists (Step S10).

When the judgment was made that nozzle clogging exists, the maintenance operation for solving the nozzle clogging (for example, suction operation or the like) is performed to the head module having the nozzle jet openings which need the maintenance (Step S11).

Ink droplets are jetted from the nozzle jet openings predetermined times, calculating the maximum voltage value $V_{max}$ of the sampling detected signal Sd' based on landing of the ink droplets for each ink droplet jetting operation, and comparing each maximum voltage value $V_{max}$ with the standard voltage value $V_0$. When not all the maximum voltage values $V_{max}$ are not less than the standard voltage value $V_0$, a judgment is made that ink droplets are not jetted from the set nozzle jet openings (that is, nozzle clogging exists). Further, due to the structural feature of the ink jet head, there is a case that ink jetting is not performed for the initial stage of the ink droplet jetting operations, and is started after repeating ink droplet jetting operation for a few times, so that ink droplets are jetted in the middle or last half ink droplet detection operations to detect the maximum voltage values $V_{max}$. Even in such the case, a judgment can be made that there is no nozzle clogging, thereby enabling to properly performing the maintenance operation only in the case when the maintenance operation is needed.

The nozzle clogging judgment operation shown in FIG. 10 is the case where a judgment is made based on the count number N of the sampling detected signals Sd' as the judgmental standard. Steps S21 to S24 shown in FIG. 10 are same as Steps S1 to S4 shown in FIG. 9, therefore, the explanations thereof are omitted here.

The ink jet signal $S_{m1}$ is output to the set nozzles, and then ink droplets are jetted. When the ink droplets jetted land on the ink droplet landing surface S1, the piezo vibration signal Sd is output from the piezo film 621, and the sampling detected signal Sd' is stored in the RAM 131 based on the sampling signal $S_s$. The case where the sampling detected signal Sd' is not less than the standard voltage value $V_0$ is counted in the ink droplet jetting operations (Step S25).

When the ink droplet jetting operation from the set nozzles is performed as many times as the number of ink droplet jetting operations n, the count number N which was determined by counting a sampling detected signal Sd' which is not less than the standard voltage value $V_0$ in the sampling detected signals Sd' stored in the RAM 131 in chronological order, and the number of ink droplet jetting operations n which is set in the ROM 121 are read out to the CPU 111 (Step S26).

In the judgmental step (S27) as the judgmental section, a judgment is made whether the count number N is equal to the number of ink droplet jetting operations n.

When the count number N is equal to the number of ink droplet jetting operations n (Step S27; Yes), the ink droplet jetting operations are judged to be normal, and a judgment is made that there is no nozzle clogging (Step S28).

When the count number N is not equal to the number of ink droplet jetting operations n (Step S27; No), a judgment is made whether the count was made in the last half ink droplet jetting operations (Step S29).

When the count number N is counted in the last half operations (Step S29; Yes), the ink droplet jetting operations are judged to be normal, thereby, a judgment is made that there is no nozzle clogging (Step S28).

When the count number N is not counted in the last half operations (Step S29; No), the ink droplet jetting operations are judged to be abnormal, thereby, a judgment is made that nozzle clogging exists (Step S30).

When the judgment was made that nozzle clogging exists, the maintenance operation for solving the nozzle clogging (for example, suction operation or the like) is performed to the head module having the nozzle jet openings which need the maintenance (Step S31).

Ink droplets are jetted from the nozzle jet openings as many times of the number of ink droplet jetting operations n, and the case where the sampling detected signal Sd' based on landing of the ink droplets in each jetting operation is not less than the standard voltage value $V_0$ is counted. The count number N counted is compared with the number of ink droplet jetting operations n. When the count number N is not equal to the number of ink droplet jetting operations n, a judgment can be made that ink droplets are not jetted from the set nozzle jet openings (that is, nozzle clogging exists). Further, due to the structural feature of the ink jet head, there is a case that ink jetting is not performed for the initial stage of the ink droplet jetting operations, and is started after repeating ink droplet jetting operation for a few times, so that ink droplets are jetted in the middle or in the last half ink droplet detection operations to be counted. Even in such the case, a judgment can be made that there is no nozzle clogging, thereby enabling to properly performing the maintenance operation only in the case when the maintenance operation is needed.

The nozzle clogging judgment operation shown in FIG. 11 is the case where a judgment is made based on the output cycle (detected cycle T1) of the sampling detected signal Sd' output as the judgmental standard. Steps S41 to S44 shown in FIG. 10 are same as Steps S1 to S4 shown in FIG. 9, therefore the explanations thereof are omitted here.

The ink jet signal $S_{m1}$ is output to the set nozzles, and then ink droplets are jetted. When the ink droplets jetted land on the ink droplet landing surface S1, the piezo vibration signal Sd is output from the piezo film 621, and the sampling detected signal Sd' is stored in the RAM 131 based on the sampling signal $S_s$. The standard cycle T0 of the ink jet signal $S_{m1}$ and the detected cycle T1 of the sampling detected signal Sd' for each ink droplets jetting operation are clocked to be stored in the RAM 131. The ink droplet jetting operation is performed as many times as the predetermined number of ink droplet jetting operations n (Step S45).

When the ink droplet jetting operation from the set nozzles is performed as many times as the predetermined number of ink droplet jetting operations n, the detected cycles T1 and the standard cycles T0 stored in chronological order in the RAM 131 are read out to the CPU 111 (Step S46).

In the judgmental step (S47) as a judgmental section, a judgment is made whether each detected cycle T1 of the ink droplet jetting operations which was read out is equal to the standard cycle T0.

When each detected cycle T1 is equal to the standard cycle T0 (Step S47; Yes), the ink droplet jetting operations are judged to be normal, therefore, a judgment is made that there is no nozzle clogging (Step S48).

When not all the detected cycles T1 are equal to the standard cycle T0 (Step S47; No), a judgment is made whether each detected cycle T1 in the last half ink droplet jetting operations is equal to the standard cycle T0 (Step S49).

When each detected cycle T1 in the last half ink droplet jetting operations is equal to the standard cycle T0 (Step S49; Yes), the ink droplet operations are judged to be normal, therefore, a judgment is made that there is no nozzle clogging (Step S48).

When not all the detected cycles T1 in the last half ink droplet jetting operations are equal to the standard cycle T0 (Step 49; No), the ink droplet jetting operations are judged to be abnormal, therefore, a judgment is made that nozzle clogging exists (Step 50).

When the judgment was made that nozzle clogging exists, a maintenance operation (for example, suction operation or the like) for solving the nozzle clogging is performed to the head module having the nozzle jet openings which need maintenance (Step S51).

Ink droplets are jetted from the nozzle jet openings as many times as the predetermined number of ink droplet jetting operations n, detecting the detected cycle T1 and the standard cycle T0 based on the landing of the ink droplets for each jetting operation, and comparing each detected cycle T1 with the standard cycle T0. When not all the detected cycles T1 are not equal to the standard cycle T0, a judgment can be made that ink droplets are not jetted from the set nozzle jet openings (that is, nozzle clogging exists). Further, due to the structural feature of the ink jet head, there is a case where ink jetting is not performed for the initial stage of the ink droplet jetting operations, and is started after repeating ink droplet jetting operation for a few times, so that ink droplets are jetted in the middle or in the last half ink droplet detection operations to detect the detected cycles T1. Even in such the case, a judgment can be made that there is no nozzle clogging, thereby enabling to properly performing the maintenance operation only in the case when the maintenance is needed.

The nozzles for judging nozzle clogging may be set by the head module, the nozzle line, the nozzle, or the combination thereof.

In the first embodiment, the explanation was made where nozzle clogging is judged by appropriately setting each of the judgmental standards (maximum voltage value, count number, output cycle) shown in FIGS. 9, 10, 11 by the control unit 101, however, nozzle clogging may be judged by a combination of the judgmental standards.

The piezo film 621 mounted to face in the ink droplet jetting direction of the nozzles, and the ink droplet receiving part, which is interposed between the nozzles and the piezo film 621, for receiving ink droplets jetted from the nozzles and transmitting the impact force generated when ink droplets land are provided. Further, the nozzle clogging detection part 601 for outputting the piezo vibration signal Sd based on electric charge from the piezo film 621, the peak hold part 241 for extracting the piezo vibration signal Sd based on the sampling signal $S_s$ which is delayed from the ink jet signal $S_{m1}$, and the control unit 101 for judging nozzle clogging based on the sampling detection signal Sd' extracted from the peak hold part 241. Thereby, the landing of in droplets is detected by using the piezo film 621, enabling to detect nozzle clogging with easy structure, which results in decreasing the cost for the apparatus.

In the first embodiment, the screw is used as a position adjusting section for adjusting the maximum projecting portion of the curved outer periphery of the piezo film to the ink droplet landing position, however the supporting part 631 may be electrically moved by using a motor with high positioning accuracy such as a stepping motor or the like. In the case of electrically adjusting the position by using the motor or the like, the supporting part 631 is controlled to be positioned where there is no response from the piezo film in the state that ink droplets are not jetted, and be positioned where high cyclical response from the piezo film can be obtained in the state that ink droplets are jetted.

Second Embodiment

The second embodiment will be explained referring to the drawings.

The configuration will be explained first.

Figure 12:
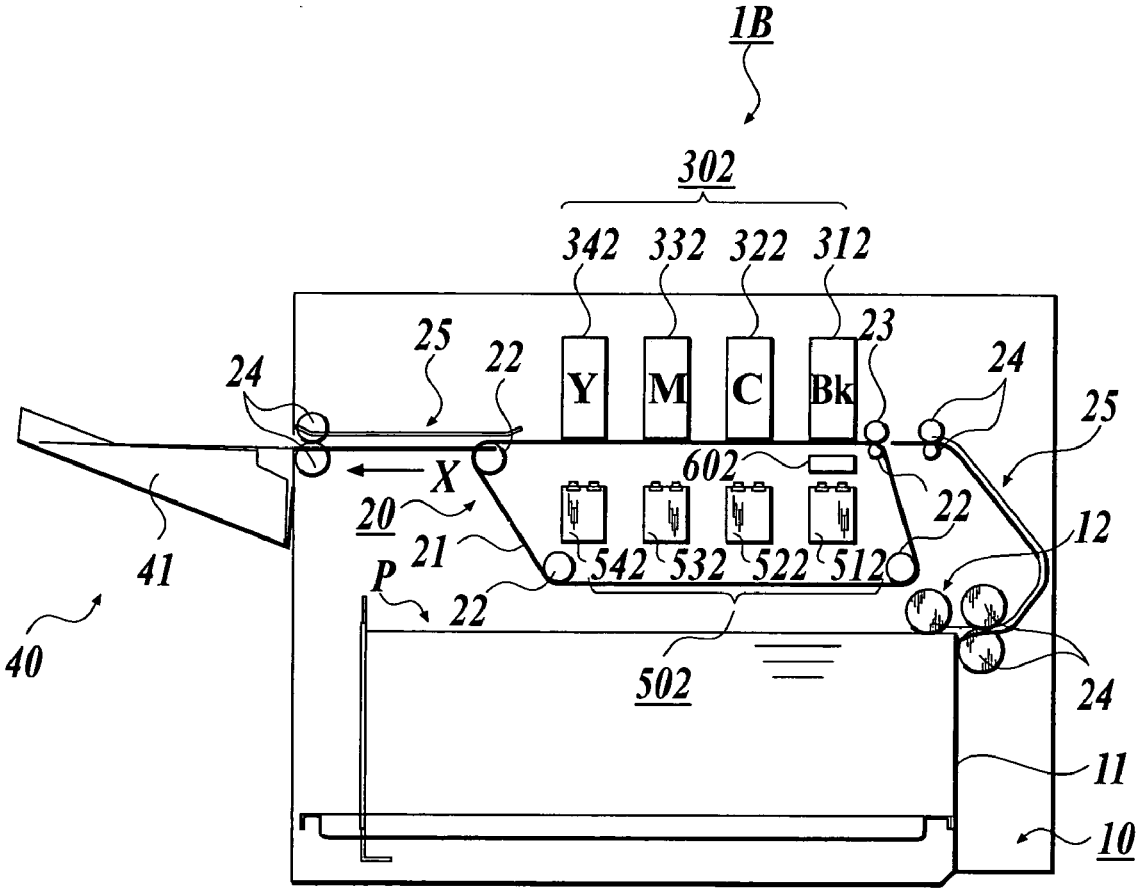
FIG. 12 is a schematic view of an inside of an ink jet printer 1B in the second embodiment.

FIG. 12 shows a schematic view of the inside of an ink jet printer 1B of a long line head type along the width direction of a recording medium in the second embodiment.

In the configuration of the ink jet printer 1B in the second embodiment, the component that is same as in the first embodiment will be given the same reference numeral and the explanations thereof will be omitted, thus only the component with different function will be explained. Specifically, the head unit part 301, the maintenance part 501 and the nozzle clogging detection part 601 in the first embodiment correspond to a head unit part 302, a maintenance part 502 and a nozzle clogging detection part 602 in the second embodiment, respectively.

The head unit part 302 comprises line head type unit heads 312, 322, 332, 342 at the portion near the upper portion of the carrying belt 21, for jetting each ink color of black (Bk), cyan (C), magenta (M) and yellow (Y) onto the recording medium P in this order along the carrying direction X, each of which comprises a plurality of nozzle jet openings (not shown) disposed in an inline arrangement. Each head unit 312, 322, 332, 342 is arranged such that the long nozzle-plates which are fixedly disposed along almost all the width of the width direction of the recording medium P face the periphery of the carrying belt 21.

The recording medium P on which an image is formed by jetting ink droplets from each head unit 312, 322, 332, 342 is discharged from the paper discharge part 40 in order.

The maintenance part 502 is provided at the lower side of the head unit 302 to face thereto across a portion near the lower portion of the upper surface of the carrying belt 21. The maintenance part 502 comprises a plurality of cap units 512, 522, 532, 542 for capping the nozzle jet openings, a suction pump which is not shown, and a waste ink tank.

Each cap unit 512, 522, 532, 542 is provided to correspond to each head unit 312, 322, 332, 342. Each cap unit is movable between a capping position for capping the nozzle jet openings of each head module corresponding thereto and a separated position where each cap unit is separated from the nozzle jet openings. Coupled to each cap unit 512, 522, 532, 542 is a suction pump and an air communicating valve or the like for suctioning fluid in a space which is formed after each cap is moved to each capping position and the whole nozzle jet openings are covered by a rubber member or the like to shutter off the outside air and be sealed. That is, the air and the ink inside the space are suctioned by the suction pump. The ink suctioned by the suction pump is discharged to the waste ink tank. The configuration of the suction pump, the air communicating valve, the waste ink tank and the like are same as those of the earlier technique, therefore the detailed descriptions thereof are omitted here.

In the second embodiment, explanation will be made to an example, in which a suction operation which is a representative of a maintenance method is adopted as a method to solve nozzle clogging. However, a flashing operation may be adopted, in which electrical signals are given to the heads, jetting ink droplets, and flashing foreign materials or the like adhered to the nozzle jet openings and the nozzle-plates.

Further, a mechanism for performing a wiping operation to wipe unnecessary ink droplets adhered to the nozzle-plates after the suction operation or the flashing operation may be provided.

The nozzle clogging detection part 602 is provided at the lower portion of the head unit 302 to face thereto across the portion near the lower portion of the upper surface of the carrying belt 21, and is arranged along almost all the width of the recording medium P in the width direction to correspond to the nozzles of each head unit. Also, the nozzle clogging detection part 602 is movable to the predetermined position corresponding to each head unit 312, 322, 332, 342.

Figure 13:
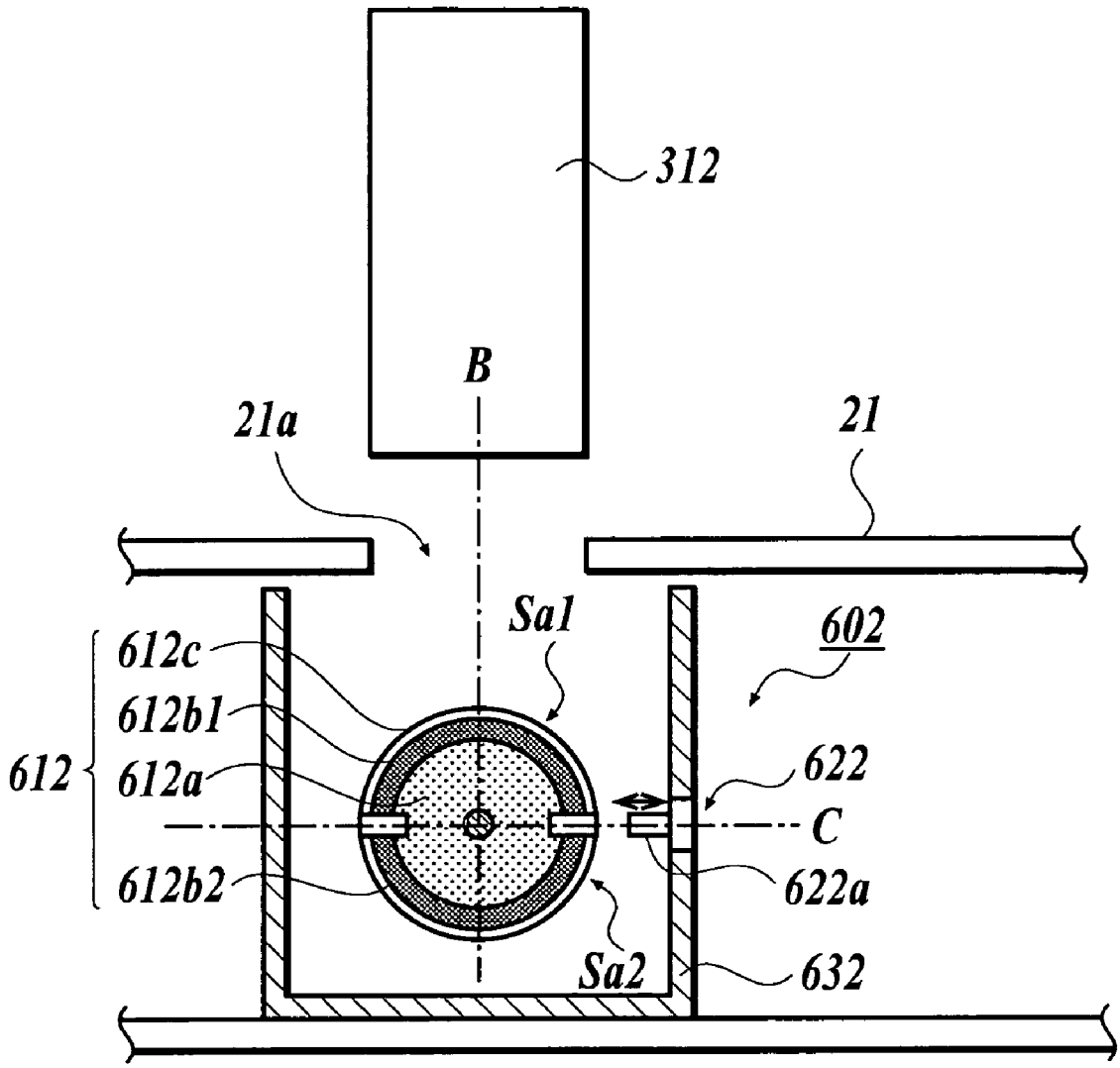
FIG. 13 is an end view of a nozzle clogging detection part 602.

FIG. 13 shows an end view of the nozzle clogging detection part 602.

FIG. 13 shows a state where the nozzle clogging detection part 602 has not received ink droplets from the nozzle jet openings of the head unit 312 (initial state). As shown in FIG. 13, the nozzle clogging detection part 602 comprises an ink droplet detection part 612 as an ink droplet detection section, a cleaning part 622 as a first cleaning section, a waste ink tray 632 and the like.

The ink droplet detection part 612 comprises an elastic member 612*a* as an elastic member, a first piezo film 612*b*1 and a second piezo film 612*b*2 as a film like piezoelectric element, a protective film 612*c* as a protective member and the like, and is formed in cylindrical shape. The axis direction of this cylinder is parallel to the inline arrangement direction of the nozzles, and the cylinder extends to make ink droplets jetted from the nozzles land thereon and is provided to be rotatable counterclockwise in the circumferential direction.

The ink droplet detection part 612 also comprises first and second ink droplet landing surfaces Sa1, Sa2, which correspond to the first and second piezo film 612*b*1, 612*b*2, respectively. In the case of detecting the landing of ink droplets, the ink droplet detection part 612 is controlled to rotate so that one of the first and the second ink droplet landing surfaces Sa1, Sa2 receives the ink droplets from the ink droplet coming direction.

The elastic member 612*a* is formed with an elastic body such as urethane, sponge, resin or the like, and is filled in the inside of the first and the second piezo films 612*b*1, 612*b*2. This configuration realizes the electrical insulation between the first and the second piezo films 612*b*1, 612*b*2, enabling to change the shape by a small impact force while protecting them from the impact force generated by jetting ink droplets.

The first and the second piezo films 612*b*1, 612*b*2 which are electrically insulated with each other has approximately half cylindrical shape, respectively, so that they are combined to have approximately cylindrical shape.

In the second embodiment, the piezoelectric effect of the first and the second piezo films 612*b*1, 612*b*2 is used to detect the landing of ink droplets. Each of the first and the second piezo films 612*b*1, 612*b*2 has approximately half cylindrical shape. Thus, in the case of detecting the landing of ink droplets, the ink droplet detection part 612 is controlled such that the ink droplets jetted from the nozzle jet openings land onto the position of ½ of the first or the second piezo films 612*b*1, 612*b*2 in the circumferential direction, therefore, sensitivity and directivity of the first and the second piezo films 621*b*1, 612*b*2 can be improved.

The first and the second piezo film 621*b*1, 612*b*2 used in the second embodiment may be any piezoelectric element as long as the piezoelectric element is formed in a film shape, which is easy to thin even when it has a large size, with piezoelectric effect and improved productivity, having excellent flexibility, impact-resistance, chemical stability or the like in comparison with an earlier developed piezoelectric ceramic or the like, and has a better output response to impact or shape changing, wide frequency characteristics or the like.

The protective film 612*c* is a water proof thin film and is provided to cover the outer peripheral side of the first and the second piezo films 612*b*1, 612*b*2.

By providing the protective film 612*c*, the fist and the second piezo films 612*b*1, 612*b*2 can be protected not to directly contact the heated ink even when the ink which has high viscosity in room temperature is heated to be jetted. Further, it is successful in suppressing the shape changes of the piezo film itself by the heated ink or changes of ambient temperature, thereby enabling to improve detection accuracy of a piezo vibration signal to be described later for judging nozzle clogging.

The cleaning part 622 comprises a blade 622*a* which slidably contacts the outer periphery of the ink droplet detection part 612.

The blade 622*a* is formed to be movable in a radial direction C of the ink droplet detection part 612, and is disposed at a position to face the rotation direction of the ink droplet detection part 612.

The tip portion of the blade 622*a* is separated from the outer peripheral side of the ink droplet detection part 612 when the ink droplet detection part 612 is receiving ink droplets, and slidably contacts the outer peripheral side of the ink droplet detection part 612 when the ink droplet detection part 612 is being rotated before and/or after receiving ink droplets.

The tip portion of the blade 622*a* of the cleaning part 622 is movable to slidably contact the outer peripheral side of the ink droplet detection part 612 when the ink droplet detection part 612 is rotated, so that ink droplets or foreign materials adhered to the outer peripheral side of the ink droplet detection part 612 can be wiped out.

The blade 622*a* is preferably made of material with high water shedding when the ink used is a water-based ink, that is, it is preferable to use a material which is adapted to the property of the ink to be used for forming the blade 622*a*.

In the second embodiment, the blade 622*a* provided in the cleaning part 622 is disposed at a position to face the rotation direction (counterclockwise direction) of the ink droplet detection part 612, however, in the case where the ink droplet detection part 612 is rotated clockwise, the blade 622*a* can be disposed at a position opposing to the position of the blade 622*a* in FIG. 13. Further, in the case where the ink droplet detection part 612 is rotatable clockwise and counterclockwise, the blade 622*a* may be disposed at both positions opposing each other across the ink droplet detection part 612, and is not limited as long as that the blades are positioned to oppose each other in the rotation direction of the ink droplet detection part 612.

The waste ink tray 632 collets the ink droplets which were wiped out by the cleaning part 622 to discharge them to the waste ink tank which is not shown.

Figure 14:
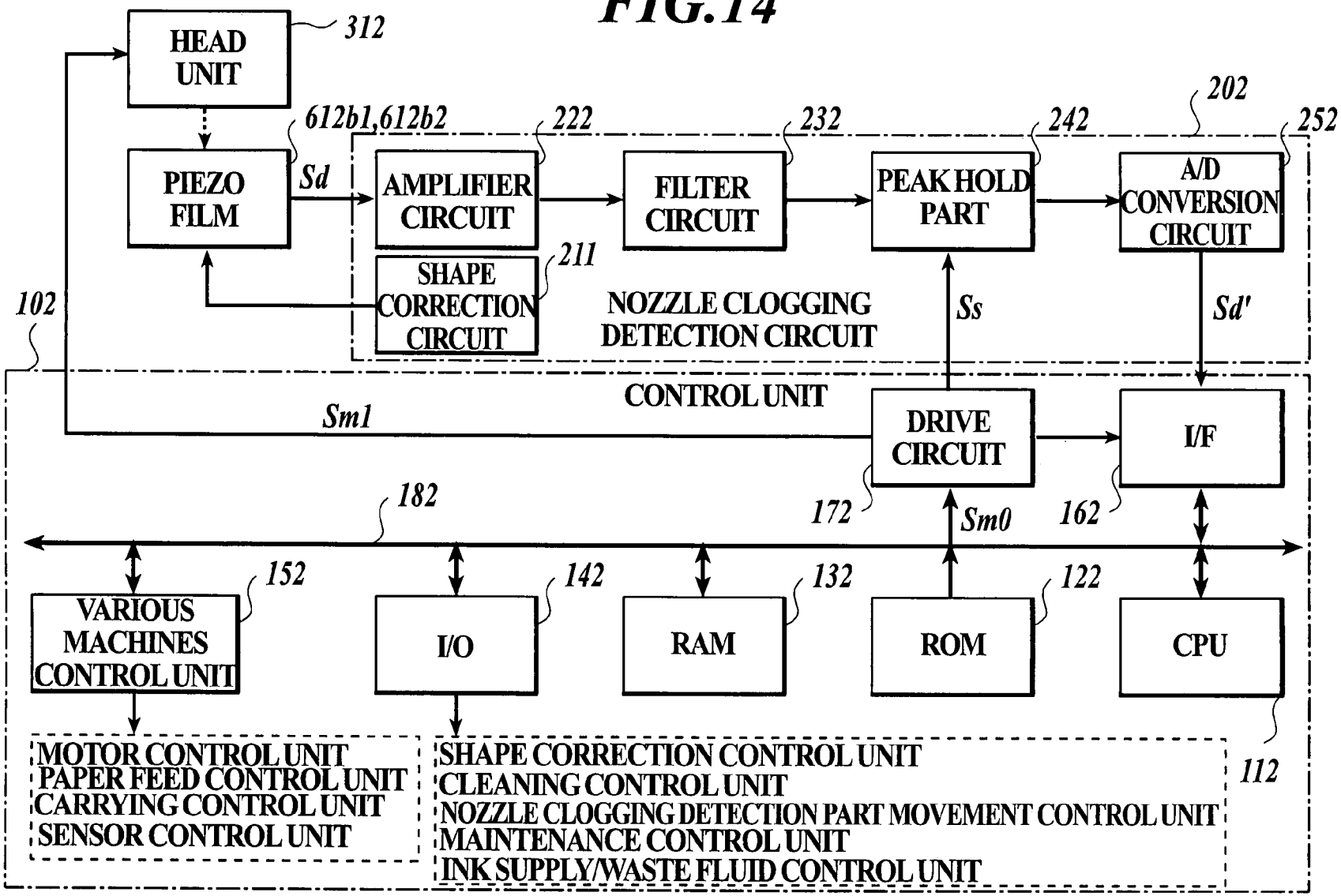
FIG. 14 is a control block diagram for controlling the ink jet printer 1B in the second embodiment.

FIG. 14 shows a control block diagram for controlling the ink jet printer 1B of the second embodiment. As shown in FIG. 14, the control system comprises a control unit 102 and a nozzle clogging detection circuit 202.

In the control unit 102, a CPU 112 as a control section and judging section, a ROM 122, a RAM 132, an I/O 142, a various machines control unit 152, I/F 162, a drive circuit 172 as a drive section and the like are connected to a system bus 182, and the control unit 102 is connected to the nozzle clogging detection circuit 202 through the I/F 162.

The nozzle clogging detection circuit 202 comprises a shape correction circuit 212, an amplifier circuit 222, a filter circuit 232, a peak hold part 242 as a sampling section, an A/D conversion circuit 252 or the like.

The CPU 112 reads out a system program, various processing programs and data stored in the ROM 122, expanding them in the RAM 132, and performs a central control of operations of the whole ink jet printer 1B according to the programs expanded. That is, the CPU 102 performs a timing control of the whole system, storing and accumulation controls of data with the use of the RAM 132, an output of print data to each head unit, an input-output control of an operating portion which is not shown, an interface (I/F) to other applications, or an operation control.

To realize the second embodiment, when performing the nozzle clogging judging operation, the position of the ink droplet detection part 612 in the circumferential direction is changed so that ink droplets jetted from the nozzles land on the position of ½ of the first or the second piezo films 612*b*1, 612*b*2 in the circumferential direction. Also, various motors and the like are controlled to rotate the ink droplet detection part 612 by a half-turn counterclockwise before and/or after receiving ink droplets.

When the ink droplet detection part 612 is rotated, various motors are controlled so that the tip portion of the blade 622*a* slidably contacts the outer peripheral side of the ink droplet detection part 612.

As a judgmental standard of the nozzle clogging judging operation, a maximum voltage value, a count number and an output cycle are appropriately set to judge nozzle clogging. When the control unit 102 judges that nozzle clogging exists, the maintenance part 502 is controlled to drive to solve nozzle clogging.

When the maximum voltage value is used as the judgmental standard for nozzle clogging, a maximum voltage value $V_{max}$ of a sampling detected signal Sd' to be described later which is stored in the RAM 132 is calculated for each jetting operation, and each maximum voltage value $V_{max}$ is compared with the standard voltage value $V_0$ to judge nozzle clogging.

When the count number is used as the judgmental standard for nozzle clogging, nozzle clogging is judged by counting the number of the sampling detected signals Sd' which are not less than the predetermined standard voltage value $V_0$, and comparing the count number N which was counted with the number of ink droplet jetting operations n.

When the output cycle is used as the judgmental standard, a standard cycle T0 as an output cycle of an ink jet signal $S_{m1}$ is compared with each detected cycle T1 as an output cycle of the sampling detected signal Sd' to judge nozzle clogging.

The ROM 122 stores a program or a system program for driving the ink jet printer 1B, various programs corresponding to the system, data necessary for processing with the various processing programs.

To realize the second embodiment, the ROM 122 stores the standard voltage value $V_0$, which is the maximum voltage value of the sampling detected signal Sd' when ink droplets are properly jetted onto the first ink droplet landing surface Sa1 or the second ink droplet landing surface Sa2, the predetermined number of ink droplet jetting operations n, and a delay time $t_d$ to be described later.

The RAM 132 is a temporally storing region for programs, input or output data, parameters read out from the ROM 122 in various processing controlled and executed by the CPU 112.

To realize the second embodiment, the RAM 132 temporally stores the sampling detected signal Sd' input from the A/D conversion circuit 252 through the I/F, the maximum voltage values $V_{max}$ calculated by the CPU 112, the count number N which was found by counting the number of the sampling detected signals Sd' not less than the predetermined standard voltage value $V_0$, and the standard cycle T0 of the ink jet signal $S_{m1}$ and the detected cycles T1 of the sampling detected signal Sd' which are clocked by a timer or the like, in chronological order.

The I/O 142 is for input and output of data between the control unit 102 and a control unit of each portion. To realize the second embodiment, the I/O 142 is connected to a shape correction control unit for controlling the shape of the piezo film 612*b*, a cleaning control unit for controlling the actuation of the cleaning part 622 and rotationally driving the ink droplet detection part 612, a nozzle clogging detection part movement control unit for moving the nozzle clogging detection part 622 to the predetermined position at the lower side of the head unit which is subjected to the nozzle clogging judgment, and a maintenance control unit for controlling the operations of the maintenance part 502. The I/O 142 is also connected to control units such as an ink supply/waste fluid control unit, a waste ink control unit or the like.

The various machines control unit 152 is connected to a motor control unit for controlling a motor which rotationally drive the ink droplet detection part 612, a paper feed control unit for controlling various rollers and the paper pick up device 12 of the paper feed part 10, a carrying control unit for controlling various rollers of the carrying part 20, and a sensor control unit for driving various sensors provided in the ink jet printer 1B and the like, each of which operates based on the instructions from the CPU 112.

The drive circuit 172 calculates the ink jet signal $S_{m1}$ for jetting ink droplets from the nozzle jet openings by driving the nozzles of each head unit 312, 322, 332, 342, and a sampling signal $S_s$ which is delayed from the ink jet signal $S_{m1}$ by the time it takes for ink droplets jetted from the nozzle jet openings land on the first ink droplet landing surface Sa1 or the second ink droplet landing surface Sa2 (hereinafter, referred as delay time $t_d$), based on the print data and a jet drive signal $S_{m0}$ from the CPU 112.

The calculated ink jet signal $S_{m1}$ is output to the nozzles of each head unit 312, 322, 332, 342, and the sampling signal $S_s$ is output to the peak hold part 242.

The delay time $t_d$ is determined based on the drive waveform condition of the ink jet signal $S_{m1}$.

The drive waveform condition is determined based on the ink type to be jetted (for example, water-based ink, oil-based ink, ultraviolet curable ink, solid ink or the like), the jetting method (piezo system using piezoelectric elements, thermal system using a heater, or the like), a head configuration or the like.

The shape correction circuit 212 adjusts the output signal from the first piezo film 612*ba* or the second piezo film 612*b*2 based on the instructions from the shape correction control unit to make the piezo vibration signal Sd to be output constant within the range of the preset initial value in a case where the ink droplet detection part 612 does not receive ink droplets and is in resting state (initial condition).

The piezo vibration signal Sd as a detection signal output from the first piezo film 621*b*1 or the second piezo film 621*b*2 is amplified and adjusted by the amplifier circuit 222, and is subjected to filtering out noise with the filter circuit 232. The denoised piezo vibration signal Sd is input to the peak hold part 242.

The peak hold part 242 extracts the piezo vibration signal Sd' input from the filter circuit 231 based on the sampling signal $S_s$ input from the drive circuit 172. The extracted piezo vibration signal Sd is, as the sampling detected signal Sd', subjected to A/D conversion by the A/D conversion circuit 252 to be stored in the RAM 132 through the I/F 162.

In the second embodiment, an example of a time chart of the jet drive signal $S_{m0}$ as the instruction signal of the ink droplet jetting operation, which is output from the CPU 112 to the drive circuit 172, the ink jet signal $S_{m1}$ and the sampling signal $S_s$, which are output from the drive circuit 172 based on the jet drive signal $S_{m0}$ to the head of the head unit 312 and the peak hold part 241, respectively, and the piezo vibration signal Sd output from the first piezo film 612*b*1 or the second piezo film 612*b*2 based on the ink jet signal $S_{m1}$ are almost same as those shown in FIG. 8 in the first embodiment, therefore the explanations and the drawings are omitted here.

Next, description will be made for the nozzle clogging judging operation performed by the control unit 102.

Figure 15:
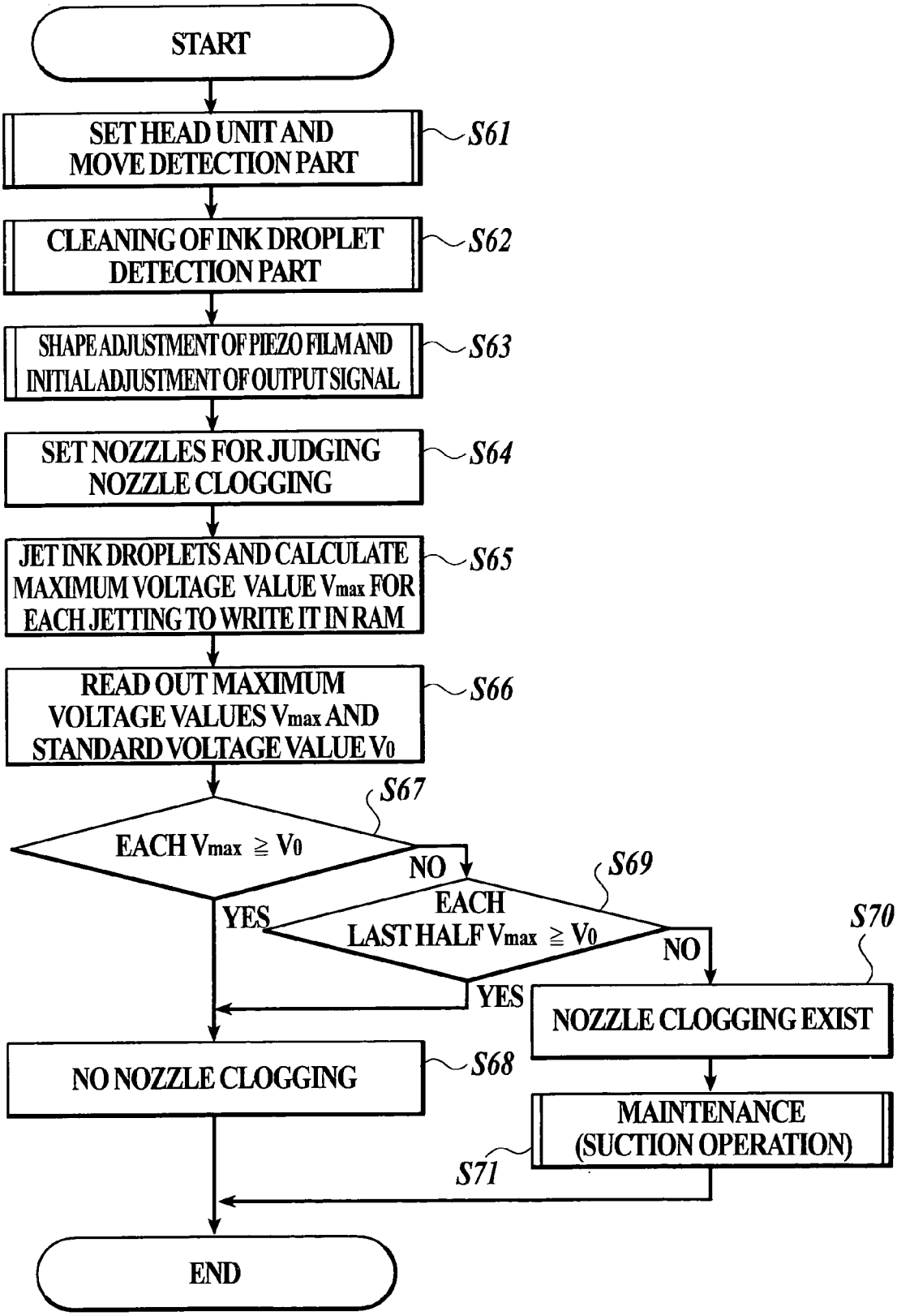
FIG. 15 is a flow chart of a nozzle clogging judging operation in a case where a judgmental standard in the second embodiment is a maximum voltage value.
Figure 16:
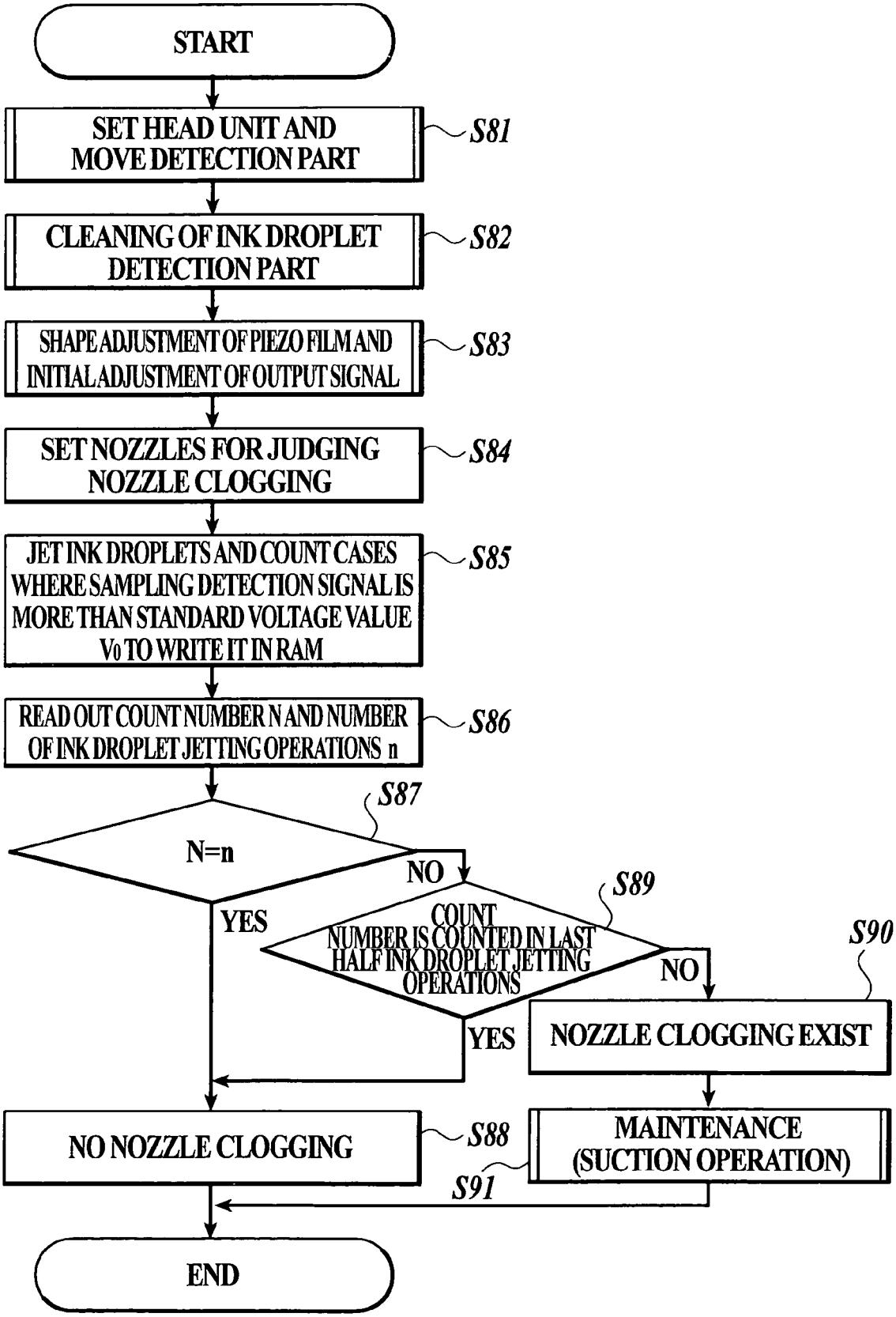
FIG. 16 is a flow chart of the nozzle clogging judging operation in a case where the judgmental standard in the second embodiment is a count number.
Figure 17:
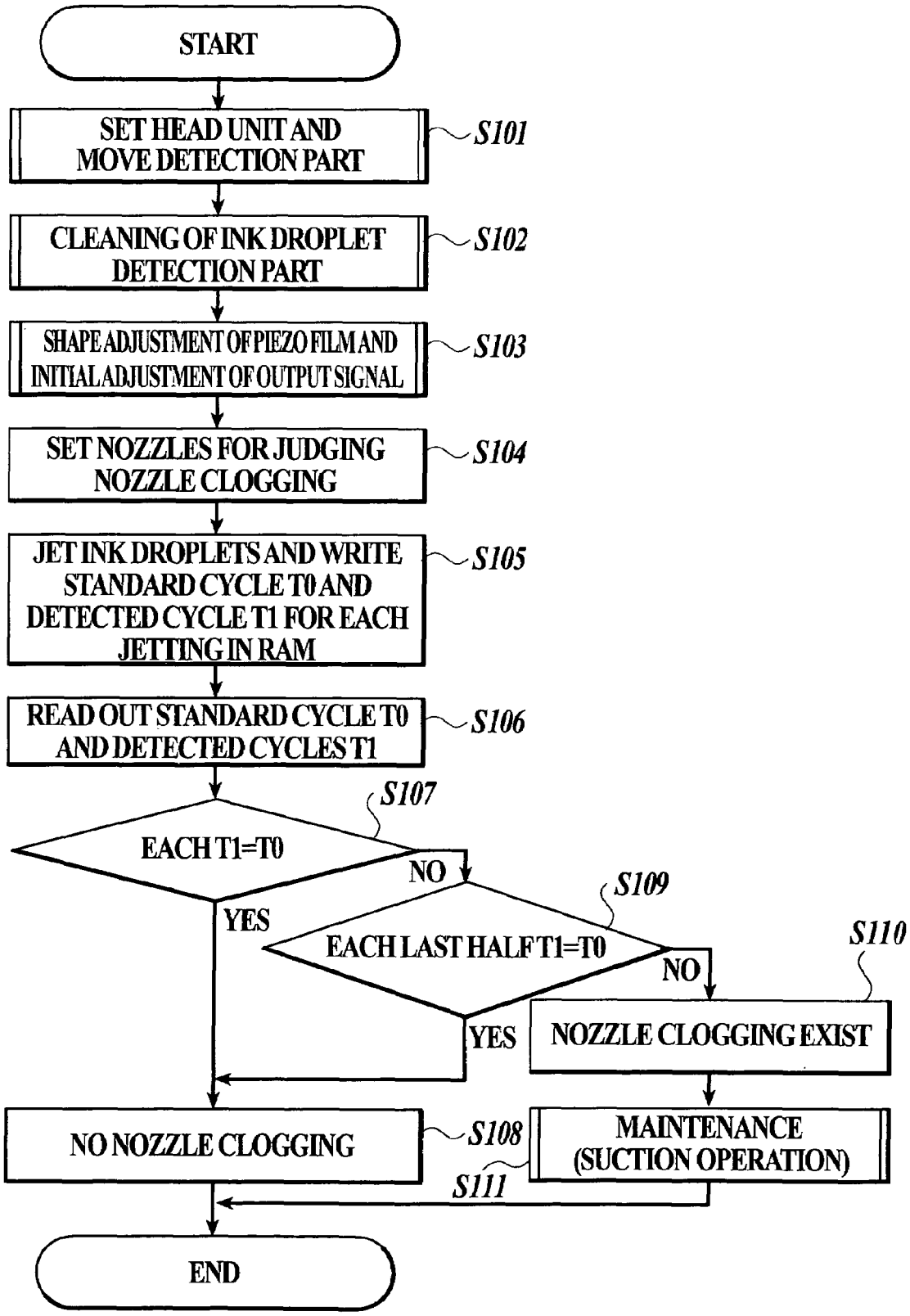
FIG. 17 is a flow chart of the nozzle clogging judging operation in a case where the judgmental standard in the second embodiment is an output cycle.

FIGS. 15 to 17 show flow charts of the nozzle clogging judging operation of the second embodiment.

FIG. 15 shows a flow chart in a case where the nozzle clogging judging operation is performed based on the maximum voltage value $V_{max}$ of the sampling detected signal Sd' as a judgmental standard.

The head unit which is subjected to the nozzle clogging judgment is set. Thereafter, the nozzle clogging detection part 602 is moved to a predetermined position below the set head unit (Step S61).

After the nozzle clogging detection part 602 was moved to the predetermined position, cleaning of the ink droplet detection part 612 is performed and mechanical vibration of the nozzle clogging detection part 602 is stopped (Step S62).

After the cleaning of the ink droplet detection part 612, the shape of the piezo film disposed ahead in the ink droplet jetting direction B is adjusted. Also, the output signal adjusted so that the piezo vibration signal Sd to be output from the piezo film is constant within the range of the preset initial value (Step S63).

After the initial setting of the output signal from the piezo film, nozzles for judging nozzle clogging are set (Step S64).

The ink jet signal $S_{m1}$ is output to the set nozzles, and then ink droplets are jetted. When the ink droplets jetted land on the ink droplet landing surface which is disposed ahead in the ink droplet jetting direction B, the piezo vibration signal Sd is output from the piezo film, and the sampling detected signal Sd' is stored in the RAM 132 based on the sampling signal $S_s$. The maximum voltage value $V_{max}$ of the sampling detected signal Sd' is calculated for each ink droplet jetting operation to be stored in the RAM 132 (Step S65).

Steps S66 to S71 in FIG. 15 are same as Steps S6 to S11 in FIG. 9, therefore the explanations thereof are omitted.

Ink droplets are jetted from the nozzle jet openings predetermined times, calculating the maximum voltage value $V_{max}$ of the sampling detected signal Sd' based on the landing of the ink droplets for each ink droplet jetting operation, and comparing each maximum voltage value $V_{max}$ with the standard voltage value $V_0$. When not all the maximum voltage values $V_{max}$ are not less than the standard voltage value $V_0$, a judgment is made that ink droplets are not jetted from the set nozzle jet openings (that is, nozzle clogging exists). Further, due to the structural feature of the ink jet head, there is a case that ink jetting is not performed for the initial stage of the ink droplet jetting operations, and is started after repeating ink droplet jetting operation for a few times, so that ink droplets are jetted in the last half ink droplet detection operations to detect the maximum voltage values $V_{max}$. Even in such the case, a judgment can be made that there is no nozzle clogging, thereby enabling to properly performing the maintenance operation only in the case when the maintenance operation is needed.

The nozzle clogging judgment operation shown in FIG. 16 is the case where a judgment is made based on the count number N of the sampling detected signals Sd' as the judgmental standard. Steps S81 to S84 shown in FIG. 16 are same as Steps S61 to S64 shown in FIG. 15, therefore the explanations thereof are omitted.

The ink jet signal $S_{m1}$ is output to the set nozzles, and then ink droplets are jetted. When the ink droplets jetted land on the ink droplet landing surface disposed ahead in the ink droplet jetting direction B, the piezo vibration signal Sd is output from the piezo film, and the sampling detected signal Sd' is stored in the RAM 132 based on the sampling signal $S_s$. The case where the sampling detected signal Sd' is not less than the standard voltage value $V_0$ is counted in the ink droplet jetting operations (Step S85).

Steps S86 to S91 in FIG. 16 are same as Steps S26 to S31 in FIG. 10, therefore the explanations thereof are omitted.

Ink droplets are jetted from the nozzle jet openings as many times as the number of ink droplet jetting operations n, and the case where the sampling detected signal Sd' based on the landing of the ink droplets in each jetting operation is not less than the standard voltage value $V_0$ is counted. The count number N counted is compared with the number of ink droplet jetting operations n. When the count number N is not equal to the number of ink droplet jetting operations n, a judgment can be made that ink droplets are not jetted from the set nozzle jet openings (that is, nozzle clogging exists). Further, due to the structural feature of the ink jet head, there is a case that ink jetting is not performed for the initial stage of the ink droplet jetting operations, and is started after repeating ink droplet jetting operation for a few times, so that ink droplets are jetted in the last half ink droplet detection operations to be counted. Even in such the case, a judgment can be made that there is no nozzle clogging, thereby enabling to properly performing the maintenance operation only in the case when the maintenance operation is needed.

The nozzle clogging judgment operation shown in FIG. 17 is the case where a judgment is made based on the output cycle (detected cycle T1) of the sampling detected signal Sd' output as the judgmental standard. Steps S101 to S104 shown in FIG. 17 are same as Steps S61 to S64 shown in FIG. 15, therefore the explanations thereof are omitted here.

The ink jet signal $S_{m1}$ is output to the set nozzles, and then ink droplets are jetted. When the ink droplets jetted land on the ink droplet landing surface disposed ahead in the ink droplet jetting direction B, the piezo vibration signal Sd is output from the piezo film, and the sampling detected signal Sd' is stored in the RAM 132 based on the sampling signal $S_s$. The standard cycle T0 of the ink jet signal $S_{m1}$ and the detected cycle T1 of the sampling detected signal Sd' for each ink droplets jetting operation are clocked to be stored in the RAM 132. The ink droplet jetting operation is performed as many times as the predetermined number of ink droplet jetting operations n (Step S105).

Steps S106 to S111 in FIG. 17 are same as Steps S46 to S51 in FIG. 11, therefore the explanations thereof are omitted.

Ink droplets are jetted from the nozzle jet openings as many times as the predetermined number of ink droplet jetting operations n, detecting the detected cycle T1 and the standard cycle T0 based on the landing of the ink droplets for each jetting operation, and comparing each detected cycle T1 with the standard cycle T0. When not all the detected cycles T1 are not equal to the standard cycle T0, a judgment can be made that ink droplets are not jetted from the set nozzle jet openings (that is, nozzle clogging exists). Further, due to the structural feature of the ink jet head, there is a case where ink jetting is not performed for the initial stage of the ink droplet jetting operations, and is started after repeating ink droplet jetting operation for a few times, so that ink droplets are jetted in the last half ink droplet detection operations to detect the detected cycle T1. Even in such the case, a judgment can be made that there is no nozzle clogging, thereby enabling to properly performing the maintenance operation only in the case when the maintenance is needed.

The cleaning operation on the outer peripheral side of the ink droplet detection part 612 will be explained next.

Figure 18:
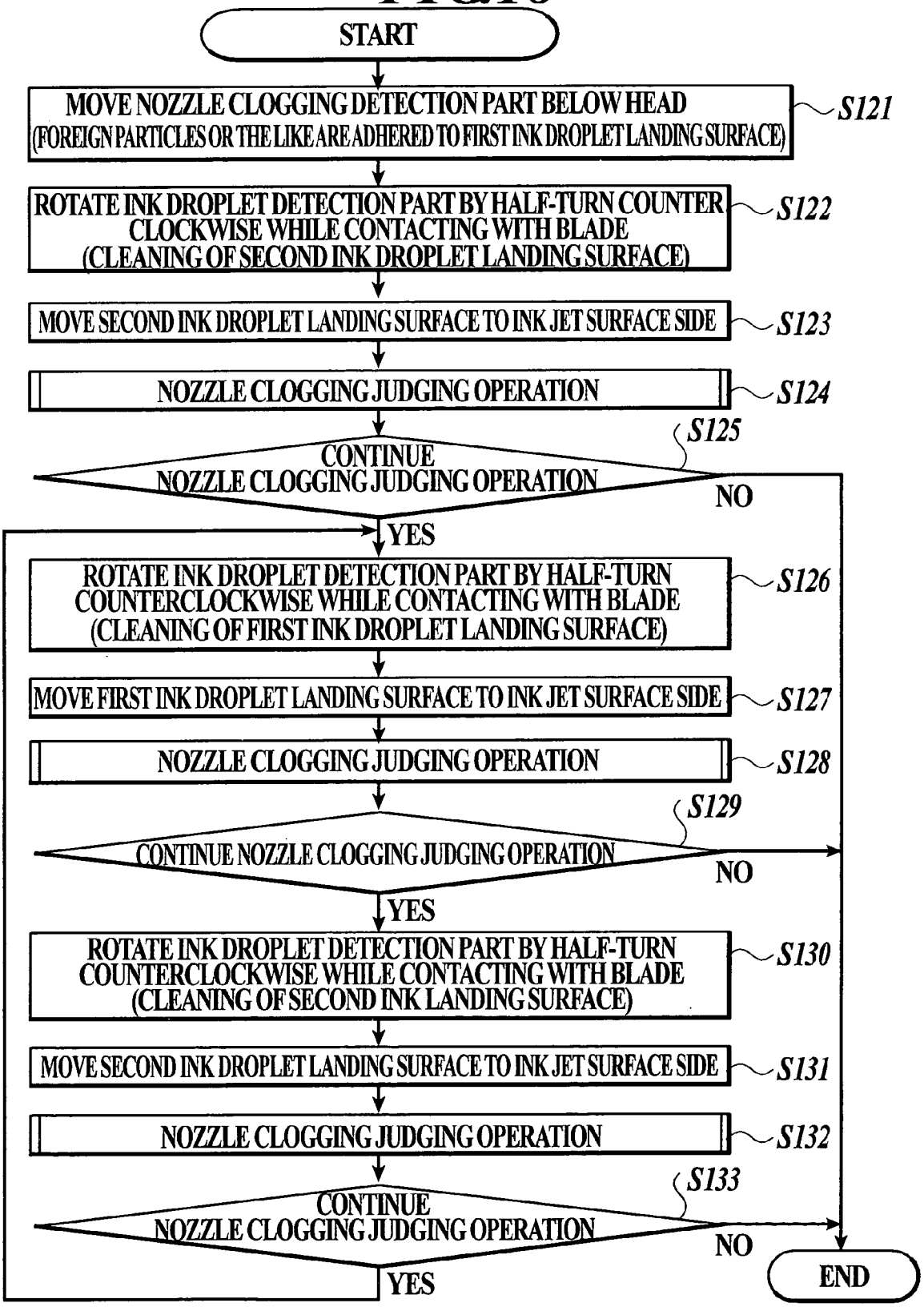
FIG. 18 is a flow chart of a cleaning operation in the second embodiment.

FIG. 18 shows a flow chart of the cleaning operation in the second embodiment.

FIGS. 19A to 19G show the operating states of the nozzle clogging detection part 602 by end views and schematic plan views as seen from the ink droplet jetting direction B of the nozzle clogging detection part 602.

A head unit which is subjected to the nozzle clogging judgment is set and the nozzle clogging detection part 602 is moved to the predetermined position below the set head unit (for example, Step S61 in FIG. 15) (Step S121).

Figures 19A, 19B, 19C, 19D, 19E, 19F, 19G:
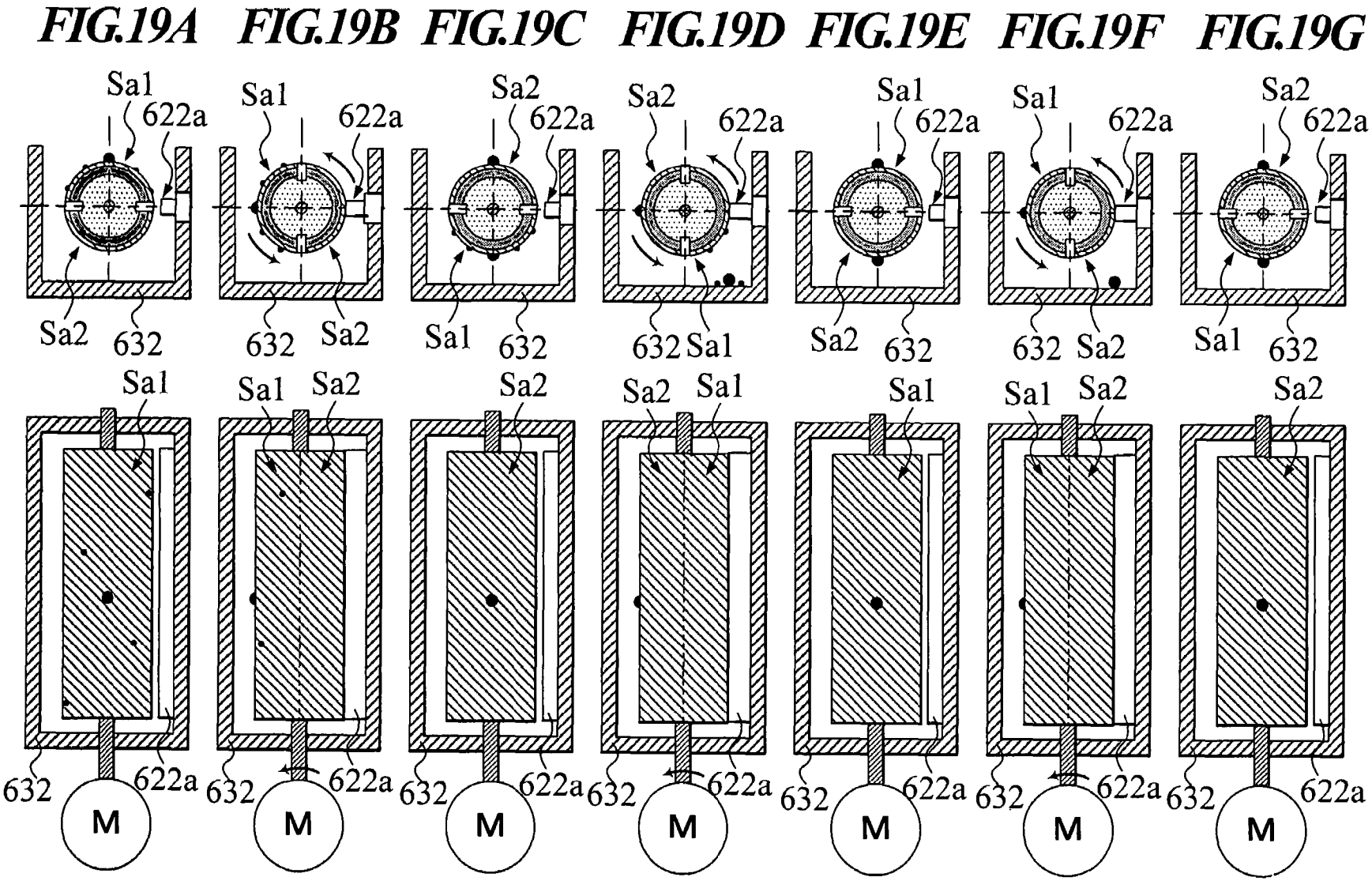
FIG. 19A is a view of the nozzle clogging detection part 602 in a state that foreign particles are adhered to a first ink droplet landing surface Sa1 of an ink droplet detection part 612.
FIG. 19B is a view of the nozzle clogging detection part 602 in a state that the ink droplet detection part 612 is rotated counterclockwise while a blade 622*a* slidably contacting the outer peripheral side of the ink droplet detection part 612.
FIG. 19C is a view of the nozzle clogging detection part 602 in a state that a second ink droplet landing surface Sa2 of the ink droplet detection part 612 which was subjected to cleaning receives an ink droplet.
FIG. 19D is a view of the nozzle clogging detection part 602 in a state that the ink droplet detection part 612 is rotated counterclockwise while the blade 622*a* slidably contacting the outer peripheral side of the ink droplet detection part 612.
FIG. 19E is a view of the nozzle clogging detection part 602 in a state that the first ink droplet landing surface Sa1 of the ink droplet detection part 612 which was subjected to cleaning receives an ink droplet.
FIG. 19F is a view of the nozzle clogging detection part 602 in a state that ink droplet detection part 612 is rotated counterclockwise while the blade 622*a* slidably contacting the outer peripheral side of the ink droplet detection part 612.
FIG. 19G is a view of the nozzle clogging detection part 602 in a state that the second ink droplet landing surface Sa2 of the ink droplet detection part 612 which was subjected to cleaning receives an ink droplet.

As shown in FIG. 19A, in the nozzle clogging detection part 602 moved to the lower side of the head unit, ink droplets, foreign materials such as foreign particles, dust or the like may adhere to the ink droplet landing surface of the ink droplet detection part 612 which faces ahead in the ink droplet jetting direction B (the first ink droplet landing surface Sa1 in this embodiment). In such the state, the landing of ink droplets cannot be properly detected. Thus, as shown in FIG. 19B, the ink droplet detection part 612 is rotated by a half-turn counterclockwise in the state that the blade 622*a* slidably contacts with the outer peripheral side of the ink droplet detection part 612 (Step S122).

When the ink droplet detection part 612 was rotated by a half-turn counterclockwise, the seconds ink droplet landing surface Sa2 which was subjected to the cleaning process by the blade 622*a* emerges ahead in the ink droplet jetting direction B. Then, the blade 622*a* is separated from the outer periphery and the position of ½ of the second ink droplet landing surface Sa2 in the circumferential direction is adjusted to the position to face the ink droplet coming direction (Step S123).

As shown in FIG. 19C, the second ink droplet landing surface Sa2 which was subjected to the cleaning process receives ink droplets, and above described various judgments of nozzle clogging are performed (Step S124).

A judgment is made whether to continue the nozzle clogging judging operation (Step S125). In the case where the nozzle clogging judging operation is not continued (Step S125; No), the cleaning operation is finished.

As shown in FIG. 19D, in the case where the next nozzle clogging judging operation is continued after the second ink droplet landing surface Sa2 received the ink droplets and the nozzle clogging judging operation was finished (Step S125; Yes), the ink droplet detection part 612 is rotated by a half-turn counterclockwise in the state that the blade 622*a* slidably contact the outer peripheral side, and ink droplets or foreign materials such as foreign particles or dust adhered to the first ink droplet landing surface Sa1 are wiped out, which are collected by the waste ink tray 632 to be discharged to the waste ink tank which is not shown (Step S126).

When the ink droplet detection part 612 was rotated by a half-turn counterclockwise, the first ink droplet landing surface Sa1 which was subjected to the cleaning process emerges ahead in the ink droplet jetting direction B. The blade 622*a* is separated from the outer periphery, and the position of ½ of the first piezo film 612*b*1 in the circumferential direction is adjusted to the position to face the ink droplet coming direction (Step S127).

As shown in FIG. 19E, the first ink droplet landing surface Sa1 which was subjected to the cleaning process receives ink droplets, and above described various judgments of nozzle clogging are performed (Step S128).

A judgment is made whether to continue the nozzle clogging judging operation (Step S129). In the case where the nozzle clogging judging operation is not continued (Step S129; No), the cleaning operation is finished.

As shown in FIG. 19F, in the case where the next nozzle clogging judging operation is continued after the first ink droplet landing surface Sa1 received the ink droplets and the nozzle clogging judging operation was finished (Step S129; Yes), the ink droplet detection part 612 is rotated by a half-turn counterclockwise in the state that the blade 622*a* slidably contact the outer peripheral side, and ink droplets or foreign materials such as foreign particles or dust adhered to the second ink droplet landing surface Sa2 are wiped out, which are collected by the waste ink tray 632 to be discharged to the waste ink tank which is not shown (Step S130).

When the ink droplet detection part 612 was rotated by a half-turn counterclockwise, the second ink droplet landing surface Sa2 which was subjected to the cleaning process emerges ahead in the ink droplet jetting direction B. The blade 622*a* is separated from the outer periphery, and the position of ½ of the second piezo film 612*b*2 in the circumferential direction is adjusted to the position to face the ink droplet coming direction (Step S131).

As shown in FIG. 19G, the second ink droplet landing surface Sa2 which was subjected to the cleaning process receives ink droplets, and above described various judgments of nozzle clogging are performed (Step S132).

A judgment is made whether to continue the nozzle clogging judging operation (Step S133). In the case where the nozzle clogging judging operation is not continued (Step S133; No), the cleaning operation is finished. In the case where the nozzle clogging judging operation is continued (Step S133; Yes), the operation is returned to Step S126.

By providing the cleaning part 622 for cleaning the ink droplet detection part 612 before and after judging nozzle clogging, the signal by the landing of ink droplets can be detected with high accuracy, thereby enabling to improve the judging accuracy of nozzle clogging.

In the second embodiment, the explanation was made for the head line type ink jet printer comprising a plurality of nozzles disposed in the inline arrangement along the whole width of the width direction of the recording medium P, however when a line head type ink jet printer in which a plurality of head modules comprising a plurality of nozzles are formed is applied, the present invention can be applied by comprising the nozzle clogging detection part 602 corresponding to each head module, resulting in obtaining the same effect.

In the second embodiment, the explanation was made where nozzle clogging is judged by appropriately setting each of the judgmental standards (maximum voltage value, count number, output cycle) shown in FIGS. 15, 16, 17 by the control unit 102, however, nozzle clogging may be judged by a combination of the judgmental standards.

In the second embodiment, the explanation was made where the ink droplet detection part 612 is rotated by a half-turn counterclockwise to perform the cleaning process every half periphery, however, the whole periphery may be cleaned by giving one revolution of the ink droplet detection part 612 or the ink droplet detection part 612 may be rotated by a half-turn a plurality times.

Also, the explanation was made to perform the nozzle clogging judging operation by using the first and the second ink droplet landing surfaces Sa1, Sa2 of the ink droplet detection part 612 alternately, however, one of the surfaces Sa1, Sa2 may be used for judging nozzle clogging, and the other one may be used as a spare.

Third Embodiment

The third embodiment will be explained referring to the drawings.

The configuration will be explained first.

Figure 20:
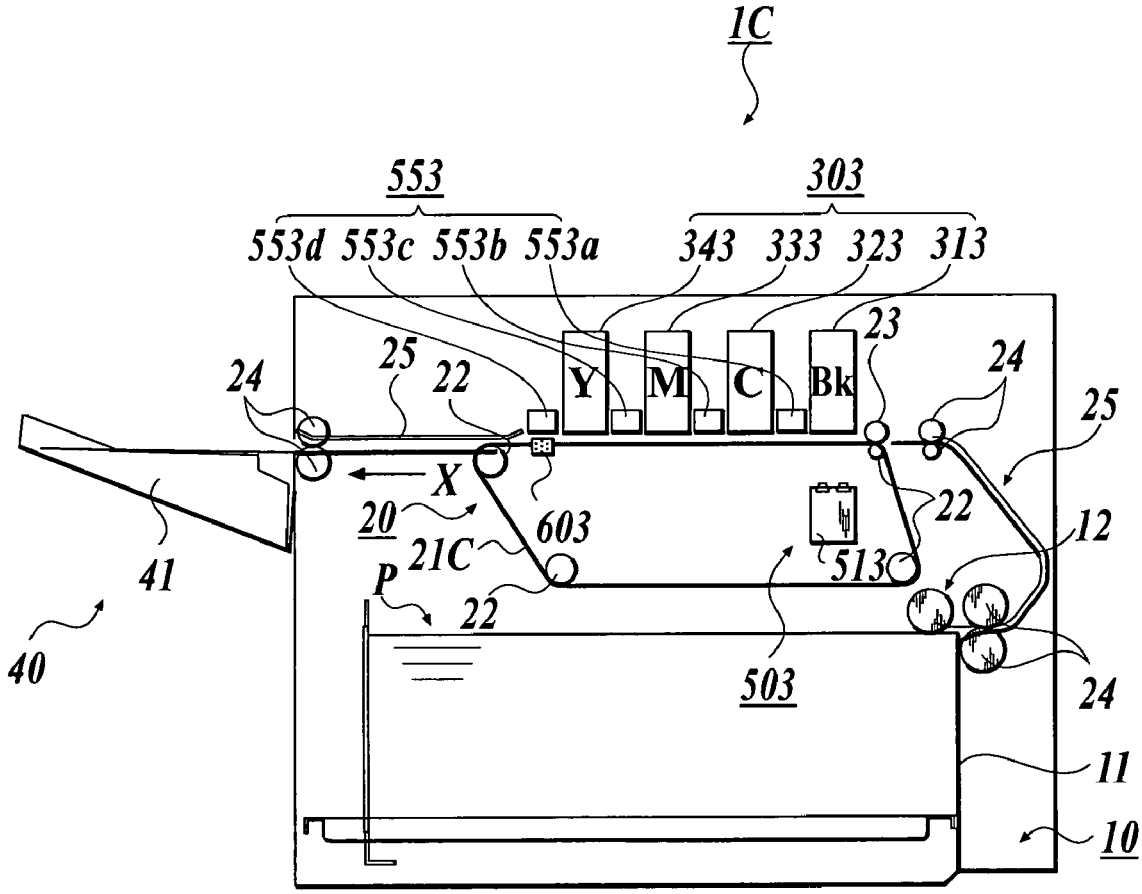
FIG. 20 is a schematic view of the inside of an ink jet printer 1C in the third embodiment.

FIG. 20 shows a schematic view of the inside of an ink jet printer 1C of a long line head type along the width direction of a recording medium in the third embodiment.

In the configuration of the ink jet printer 1C in the third embodiment, the component that is same as in the first embodiment will be given the same reference numeral and the explanations thereof will be omitted, thus only the component with different function will be explained. Specifically, the carrying belt 21, the head unit part 301, the maintenance part 501 and the nozzle clogging detection part 601 in the first embodiment correspond to a carrying belt 21C for carrying a recording medium, a head unit part 303, a maintenance part 503 as a maintenance section and a nozzle clogging detection part 603 as an ink droplet detection section in the second embodiment, respectively. Also, the ink jet printer 1C comprises a cleaning part 553 as a second cleaning section.

The carrying belt 21C is a circular shaped belt for carrying the recording medium P in a horizontal direction while supporting it in a plane state, and is movably tensioned by the plurality of tension rollers 22. The carrying belt 21C is provided with an opening part 563 so that a nozzle clogging detection part 603 to be described later is movable and a cap unit 513 covers nozzle jet openings. There are provided an encoder film and an encoder sensor at the end portion of the carrying belt 21C to enable the opening part 563 to be positioned at the lower side of the nozzle jet openings when judging nozzle clogging or performing maintenance operation, thereby the position of the opening part 563 can be detected based on the detection signal from the encoder sensor (not shown).

The head unit part 303 comprises line head type unit heads 313, 323, 333, 343 as an ink jet section at the portion near the upper portion of the carrying belt 21C, for jetting each ink color of black (Bk), cyan (C), magenta (M) and yellow (Y) onto the recording medium P in this order along the carrying direction X, each of which comprises a plurality of nozzle jet openings (not shown) disposed in an inline arrangement. Each head unit 313, 323, 333, 343 is arranged such that the long nozzle-plates which are fixedly disposed along almost all the width of the width direction of the recording medium P face the periphery of the carrying belt 21C.

The recording medium P on which an image is formed by jetting ink droplets from each head unit 313, 323, 333, 343 is discharged from the paper discharge part 40 in order.

The maintenance part 503 is provided at the lower side of the head unit 303 to face thereto across a portion near the lower portion of the upper surface of the carrying belt 21C. The maintenance part 503 comprises a cap unit 513 for capping the nozzle jet openings, a waste ink tank, and a suction pump which is not shown.

The cap unit 513 is commonly provided for the head unit 313, 323, 333, 343. The cap unit 513 is movable between a capping position for capping the nozzle jet openings of each head unit 313, 323, 333, 343 and a separated position where the cap unit 513 is separated from the nozzle jet openings. Coupled to the cap unit 513 is a suction pump and an air communicating valve or the like for suctioning fluid in a space which is formed after the cap is moved to the capping position and the whole nozzle jet openings are covered by a rubber member or the like to shutter off the outside air and be sealed. That is, the air and the ink inside the space are suctioned by the suction pump. The ink suctioned by the suction pump is discharged to the waste ink tank 573. The configuration of the suction pump, the air communicating valve and the like are same as those of the earlier technique, therefore the detailed descriptions thereof are omitted here.

In the cleaning part 553, cleaning units 553*a*, 553*b*, 553*c*, 553*d* are fixedly provided near the upper portion of the carrying belt 21C in this order along the carrying direction X, which correspond to head units 313, 323, 333, 343, respectively. Each cleaning unit 553*a*, 553*b*, 553*c*, 553*d* removes ink droplets which remain on the protective film of the nozzle clogging detection part 603 after detecting ink droplets.

In the third embodiment, explanation will be made to an example, in which a suction operation is adopted as a method to solve nozzle clogging. However, a flashing operation may be adopted, in which electrical signals are given to the heads, jetting ink droplets, and flashing foreign materials or the like adhered to the nozzle jet openings and the nozzle-plates.

Further, a mechanism for performing a wiping operation to wipe unnecessary ink droplets adhered to the nozzle-plates after the suction operation or the flashing operation may be provided.

The nozzle clogging detection part 603 is provided at the end portion of the carrying belt 21C, which is on the downstream side of the opening part 563 in a carrying direction of the carrying belt 21C, and extends in a direction parallel to a nozzle arrangement direction to be fixed to the carrying belt 21C. Also, the nozzle clogging detection part 603 is movable to the predetermined position corresponding to each head unit 313, 323, 333, 343.

Figure 21:
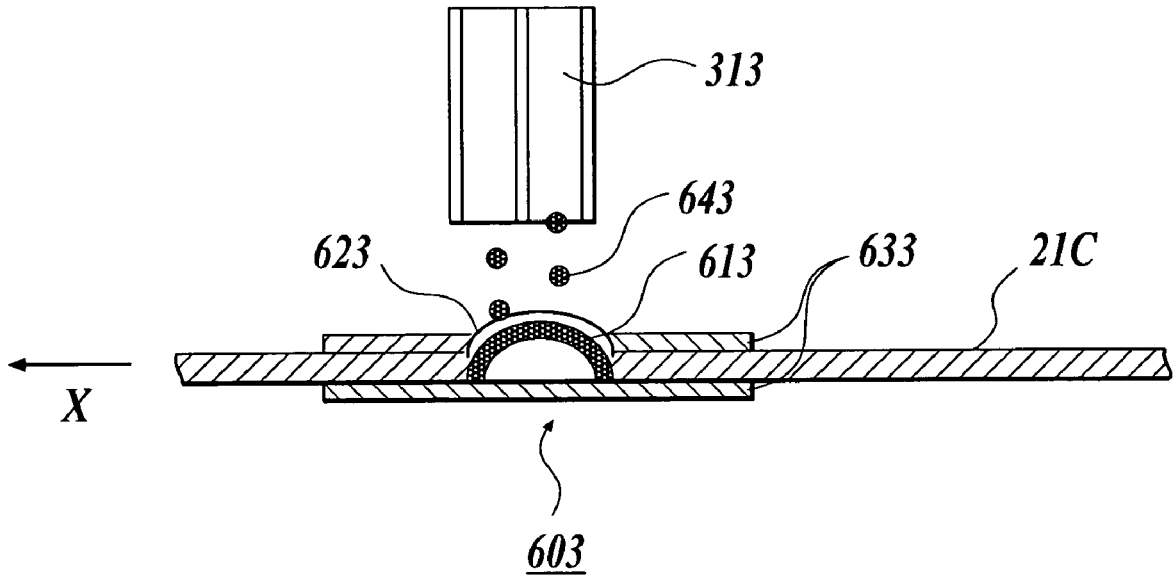
FIG. 21 is an end view of a nozzle clogging detection part 603.

FIG. 21 shows an end view of the nozzle clogging detection part 603.

As shown in FIG. 21, the nozzle clogging detection part 603 comprises a piezo film 613, a protective film 623 and a fixing member 633.

The piezo film 613 is curved into an approximately half cylinder, and is attached to the carrying belt 21C.

In the third embodiment, the piezoelectric effect of the piezo films 613 is used to detect the landing of ink droplets. To further improve sensitivity and directivity of the piezo film 613, the piezo film 613 is curved into an approximately half cylinder, and when receiving ink droplets, the maximum projecting portion of the curved outer periphery receives ink droplets 643 jetted from the ink droplet coming direction.

The piezo film 613 used in the third embodiment may be any piezoelectric element so long as the piezoelectric element is formed in a film shape, which is easy to thin even when it has a large size, with piezoelectric effect and improved productivity, having excellent flexibility, impact-resistance, chemical stability or the like in comparison with an earlier developed piezoelectric ceramic or the like, and has a better output response to impact or shape changing, wide frequency characteristics or the like.

The protective film 623 is a water proof thin film, which is disposed on the outer peripheral side of the piezo film 613. By providing the protective film 623, the piezo films 613 can be protected not to directly contact the heated ink even when the ink which has high viscosity in room temperature is heated to be jetted. Further, it is successful in suppressing the shape changes of the piezo film itself by the heated ink or changes of ambient temperature, thereby enabling to improve detection accuracy of a piezo vibration signal to be described later for judging nozzle clogging.

The fixing member 633 is an elastic member to fix the piezo film 613 and the protective film 623 to the carrying belt 21C.

Figure 22A:
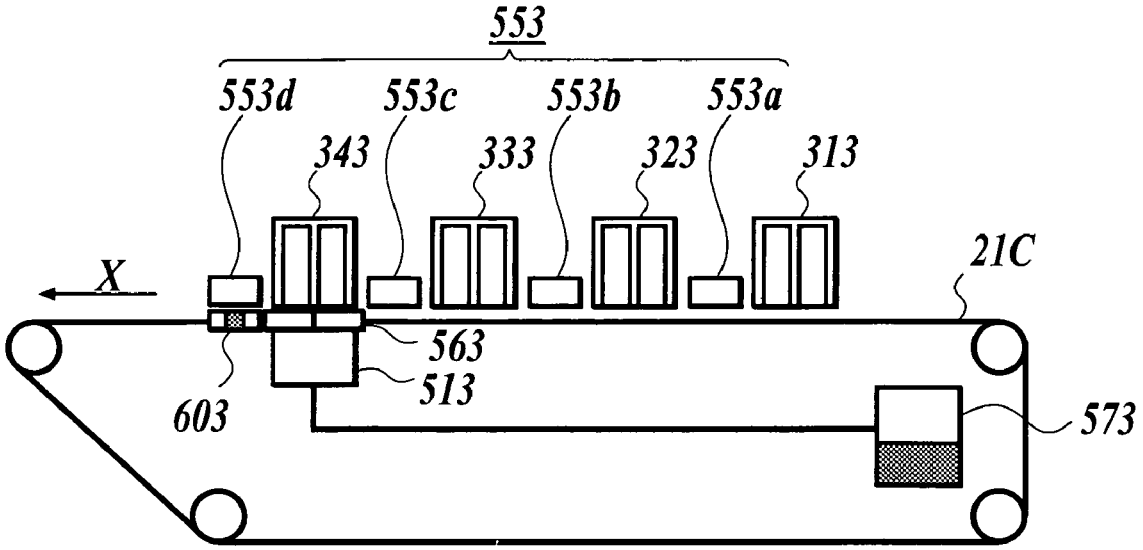
FIG. 22A is an end view of a head unit part 603, a maintenance part 503, and the nozzle clogging detection part 603.
Figure 22B:
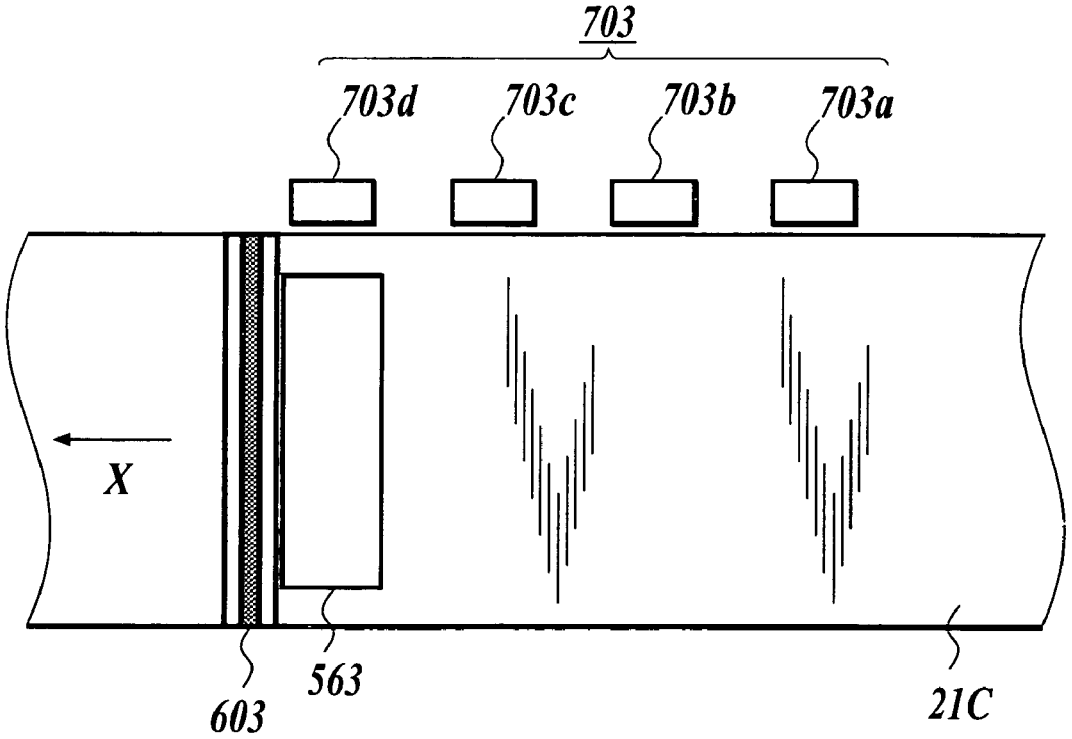
FIG. 22B is a view of a carrying belt 21C, an opening part 563, the nozzle clogging detection part 603, a sensor signal picking up part 703 as seen from an ink droplet jetting direction (from above the carrying belt 21C)

FIGS. 22A and 22B show detailed configurations of the head unit part 303, the maintenance part 503, and the nozzle clogging detection part 603.

FIG. 22A is an end view of the head unit part 303, the maintenance part 503, and the nozzle clogging detection part 603.

Further, the maintenance part 503 comprises a cleaning part 553 as a cleaning section, an opening part 563 and a waste ink tank 573.

The opening part 563 is formed in the carrying belt 21C to be close to the nozzle clogging detection part 603, and is for attaching a cap unit 513 to each head unit 313, 323, 333, 343 which was judged to have nozzle clogging after detecting nozzle clogging. The opening part 563 is movable along the carrying direction X as the carrying belt 21C moves. In the third embodiment, one cap unit 513 is provided, so that only one opening part 563 is formed.

The waste ink tank 573 is provided near a lower portion of the upper surface of the carrying belt 21C, and is for storing waste ink suctioned when the cap unit 513 is attached to each head unit 313, 323, 333, 343 to perform the suction operation.

FIG. 22B is a view of the carrying belt 21C, the opening part 563, the nozzle clogging detection part 603, a sensor signal picking up part 703 as seen from the ink droplet jetting direction (from above the carrying belt 21C).

The sensor signal picking up part 703 comprises sensor signal picking up units 703*a*, 703*b*, 703*c*, 703*d*, which correspond to head units 313, 323, 333, 343, respectively. Each sensor signal picking up unit 703*a*, 703*b*, 703*c*, 703*d* is fixedly provided on the right side of the carrying belt 21C along the carrying direction X.

Each sensor signal picking up unit 703*a*, 703*b*, 703*c*, 703*d* comprises a contact type connector for picking up the piezo vibration signal Sd as a detection signal of the ink droplets 643 output from the nozzle clogging detection part 603. The connector is movable so that each sensor signal picking up unit 703*a*, 703*b*, 703*c*, 703*d* is prevented from contacting with the nozzle clogging detection part 603 after the ink droplet detection operation or during the normal image recording operation, therefore carrying accuracy is not deteriorated and carrying load is not increased. The connector may be divided into upper and lower parts.

Figure 23:
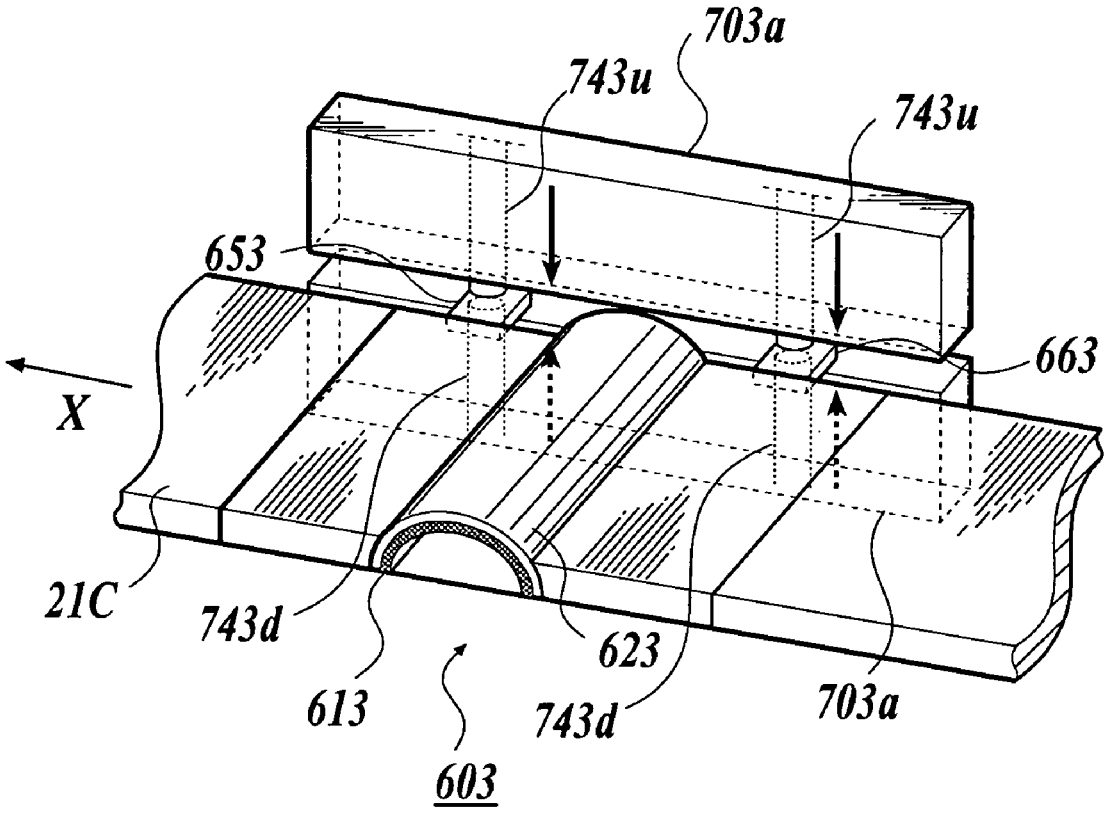
FIG. 23 is a schematic view of the nozzle clogging detection part 603 and the sensor signal picking up unit 703*a* when detecting an ink droplet.

FIG. 23 shows configurations of the nozzle clogging detection part 603 and the sensor signal picking up unit 703*a* when detecting ink droplets.

The nozzle clogging detection part 603 moves along the carrying direction X when detecting ink droplets, and is disposed at the lower side of one of the head units 313, 323, 333, 343 which is subjected to the nozzle clogging detection. When the ink droplets 643 are jetted, a voltage signal is output from sensor signal output terminals 653, 663. The output voltage signals are input to sensor signal input terminals 743*u*, 743*d* provided to the inside of the sensor signal picking up unit 703*a*.

The sensor signal picking up unit 703*a* is divided into upper and lower parts so that adverse effect to the recording operation such as deterioration of image quality or the like due to the damage of the sensor signal output terminals 653, 663 or the sensor signal input terminals 743*u*, 743*d*, deterioration of carrying accuracy, and increase of carrying load after the ink droplet detection operation or during the normal image recording operation can be avoided.

The sensor signal picking up units 703*u*, 743*d* are connector members divided into upper and lower parts, and are provided to be movable in up and down direction. When picking up the ink droplet detection signal, the sensor signal input terminal 743*u* which is the upper connector terminal and the sensor signal input terminal 743*d* which is the lower connector terminal are moved downward and upward, respectively, to make the sensor signal output terminals 653, 663 contact the sensor signal input terminals 743*u*, 743*d*. Thereby, electric signals can be fetched, and the piezo vibration signal Sd of the ink droplets 643 can be detected. The sensor signal input terminals 743*u*, 743*d* may be configured such that sockets are plugged into the sensor signal output terminals 653, 663, and may be removed to the other position when the ink droplet detection operation is not performed.

The configurations of the nozzle clogging detection part 603 and the sensor signal picking up units 703*b*, 703*c*, 703*d* when detecting ink droplets are same as the nozzle clogging detection part 603 and the sensor signal picking up unit 703*a* when detecting ink droplets, so that the explanations and drawings are omitted.

Figure 24:
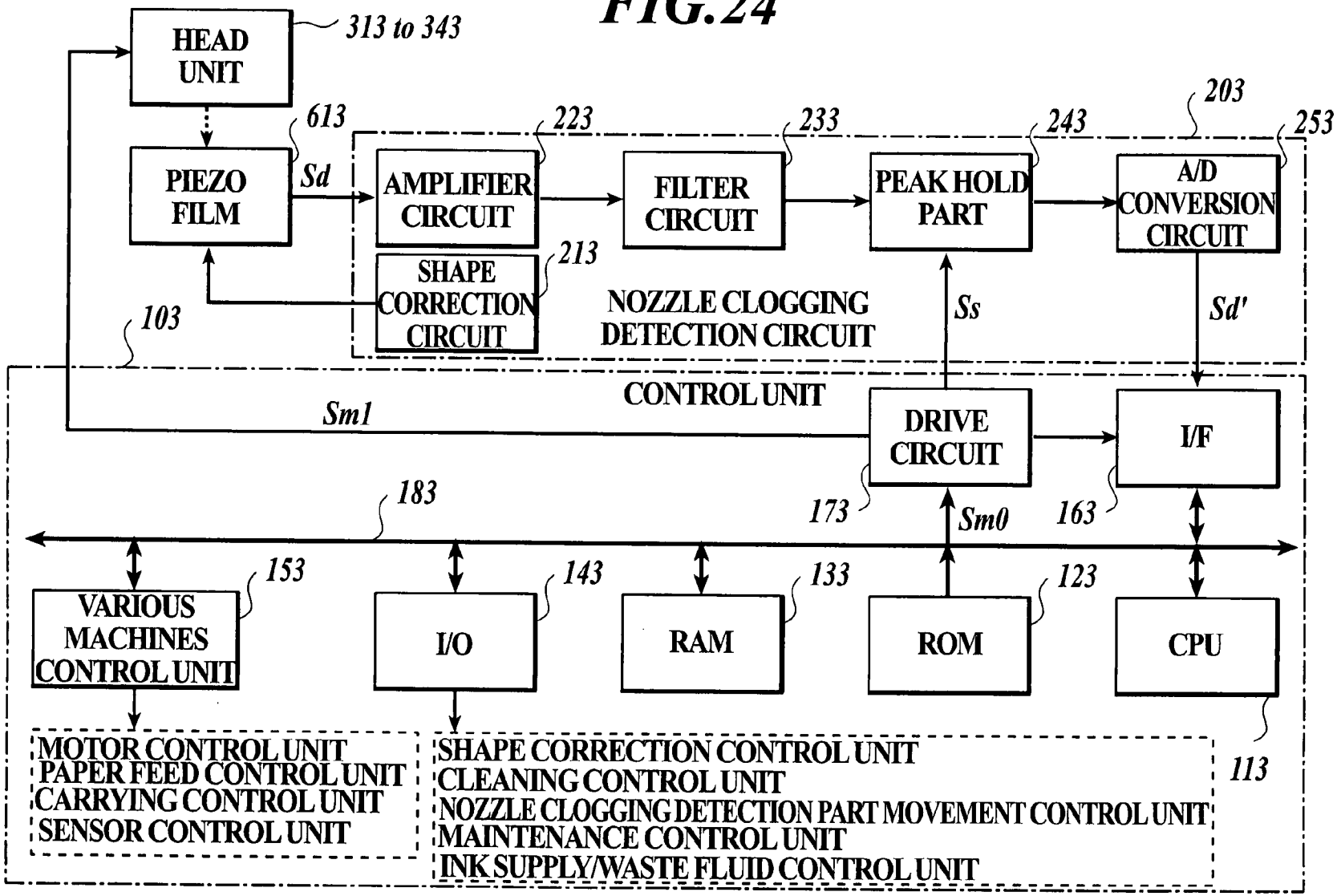
FIG. 24 is a control block diagram for controlling the ink jet printer 1C in the third embodiment.

FIG. 24 shows a control block diagram for controlling the ink jet printer 1C of the third embodiment. As shown in FIG. 24, the control system comprises a control unit 103 and a nozzle clogging detection circuit 203.

In the control unit 103, a CPU 113 as a drive control section and judging section, a ROM 123, a RAM 133 as a storing section, an I/O 143, a various machines control unit 153, I/F 163, a drive circuit 173 as a drive section and the like are connected to a system bus 183, and the control unit 103 is connected to the nozzle clogging detection circuit 203 through the I/F 163.

The nozzle clogging detection circuit 203 comprises a shape correction circuit 213, an amplifier circuit 223, a filter circuit 233, a peak hold part 243 as a sampling section, an A/D conversion circuit 253 or the like.

The CPU 113 reads out a system program, various processing programs and data stored in the ROM 123, expanding them in the RAM 133, and performs a central control of operations of the whole ink jet printer 1*c* according to the programs expanded. That is, the CPU 103 performs a timing control of the whole system, storing and accumulation controls of data with the use of the RAM 133, an output of print data to each head unit, an input-output control of an operating portion which is not shown, an interface (I/F) to other applications, or an operation control.

As a judgmental standard of the nozzle clogging judging operation, a maximum voltage value, a count number and an output cycle are appropriately set to judge nozzle clogging. When the control unit 103 judges that nozzle clogging exists, the maintenance part 503 is controlled to drive to solve nozzle clogging.

When the maximum voltage value is used as the judgmental standard for nozzle clogging, a maximum voltage value $V_{max}$ of a sampling detected signal Sd' to be described later which is stored in the RAM 133 is calculated for each jetting operation, and each maximum voltage value $V_{max}$ is compared with the standard voltage value $V_0$ to judge nozzle clogging.

When the count number is used as the judgmental standard for nozzle clogging, nozzle clogging is judged by counting the number of the sampling detected signals Sd' which are not less than the predetermined standard voltage value $V_0$, and comparing the count number N which was counted with the number of ink droplet jetting operations n.

When the output cycle is used as the judgmental standard, a standard cycle T0 as an output cycle of an ink jet signal $S_{m1}$ is compared with each detected cycle T1 as an output cycle of the sampling detected signal Sd' to judge nozzle clogging.

The ROM 123 stores a program or a system program for driving the ink jet printer 1C, various programs corresponding to the system, data necessary for processing with the various processing programs.

To realize the third embodiment, the ROM 123 stores the standard voltage value $V_0$, which is the maximum voltage value of the sampling detected signal Sd' when ink droplets 643 are properly jetted onto the nozzle clogging detection part 603, and the predetermined number of ink droplet jetting operations n.

The RAM 133 is a temporally storing region for programs, input or output data, parameters read out from the ROM 123 in various processing controlled and executed by the CPU 113.

To realize the third embodiment, the RAM 133 temporally stores the sampling detected signal Sd' input from the A/D conversion circuit 253 through the I/F, the maximum voltage values $V_{max}$ calculated by the CPU 113, the count number N which was found by counting the number of the sampling detected signals Sd' not less than the predetermined standard voltage value $V_0$, and the standard cycle T0 of the ink jet signal $S_{m1}$ and the detected cycles T1 of the sampling detected signal Sd' which are clocked by a timer or the like, in chronological order.

The I/O 143 is for input and output of data between the control unit 103 and a control unit of each part. To realize the third embodiment, the I/O 143 is connected to a shape correction control unit for correcting and controlling the sensor signal which is output based on the initial shape of the piezo film 613, a cleaning control unit for controlling the actuation of the cleaning part 553, a nozzle clogging detection part movement control unit for moving the nozzle clogging detection part 603 to the predetermined position at the lower side of the head unit which is subjected to the nozzle clogging judgment, and a maintenance control unit for controlling the operations of the maintenance part 503. The I/O 143 is also connected to control units such as an ink supply/waste fluid control unit, a waste ink control unit or the like.

The various machines control unit 153 is connected to a motor control unit for driving and controlling the carrying belt 21C, a paper feed control unit for controlling various rollers and the paper pick up device 12 of the paper feed part 10, a carrying control unit for controlling various rollers of the carrying part 20, and a sensor control unit for driving various sensors provided in the ink jet printer 1C or the like. Thus, the nozzle clogging detection part 603 is moved to the lower side of each head unit 313, 323, 333, 343 when detecting nozzle clogging, and to the lower side of each cleaning unit 553*a*, 553*b*, 553*c*, 553*d* when performing cleaning, or the recording medium is carried, based on the instructions from the CPU 113.

The drive circuit 173 calculates the ink jet signal $S_{m1}$ for jetting ink droplets from the nozzle jet openings by driving the nozzles of each head unit 313, 323, 333, 343, and a sampling signal $S_s$ which is delayed from the ink jet signal $S_{m1}$ by the time it takes for ink droplets jetted from the nozzle jet openings land on the nozzle clogging detection part 603 (hereinafter, referred as delay time $t_d$), based on the print data and a jet drive signal $S_{m0}$ from the CPU 113.

The calculated ink jet signal $S_{m1}$ is output to the nozzles of each head unit 313, 323, 333, 343, and the sampling signal $S_s$ is output to the peak hold part 243.

The delay time $t_d$ is determined based on the drive waveform condition of the ink jet signal $S_{m1}$.

The drive waveform condition is determined based on the ink type to be jetted (for example, water-based ink, oil-based ink, ultraviolet curable ink, solid ink or the like), the jetting method (piezo system using piezoelectric elements, thermal system using a heater, or the like), a head configuration or the like.

The shape correction circuit 213 adjusts the output signal from the piezo film 613 based on the instructions from the shape correction control unit to make the piezo vibration signal Sd to be output constant within the range of the preset initial value in a case where the nozzle clogging detection part 603 does not receive ink droplets and in resting state (initial condition).

The piezo vibration signal Sd output from the piezo film 613 is amplified and adjusted by the amplifier circuit 223, and is subjected to filtering out noise with the filter circuit 233. The denoised piezo vibration signal Sd is input to the peak hold part 243.

The peak hold part 243 extracts the piezo vibration signal Sd input from the filter circuit 233 based on the sampling signal $S_s$ input from the drive circuit 173. The extracted piezo vibration signal Sd is, as the sampling detected signal Sd', subjected to A/D conversion by the A/D conversion circuit 253 to be stored in the RAM 133 through the I/F 163.

In the third embodiment, an example of a time chart of the jet drive signal $S_{m0}$ as the instruction signal of the ink droplet jetting operation, which is output from the CPU 113 to the drive circuit 173, the ink jet signal $S_{m1}$ and the sampling signal $S_s$, which are output from the drive circuit 173 based on the jet drive signal $S_{m0}$ to the head of the head unit 313 and the peak hold part 243, respectively, and the piezo vibration signal Sd output from the piezo film 613 based on the ink jet signal $S_{m1}$ are almost same as those shown in FIG. 8 in the first embodiment, therefore the explanations and the drawings are omitted here.

Next, description will be made for the nozzle clogging judging operation performed by the control unit 103.

Figure 25:
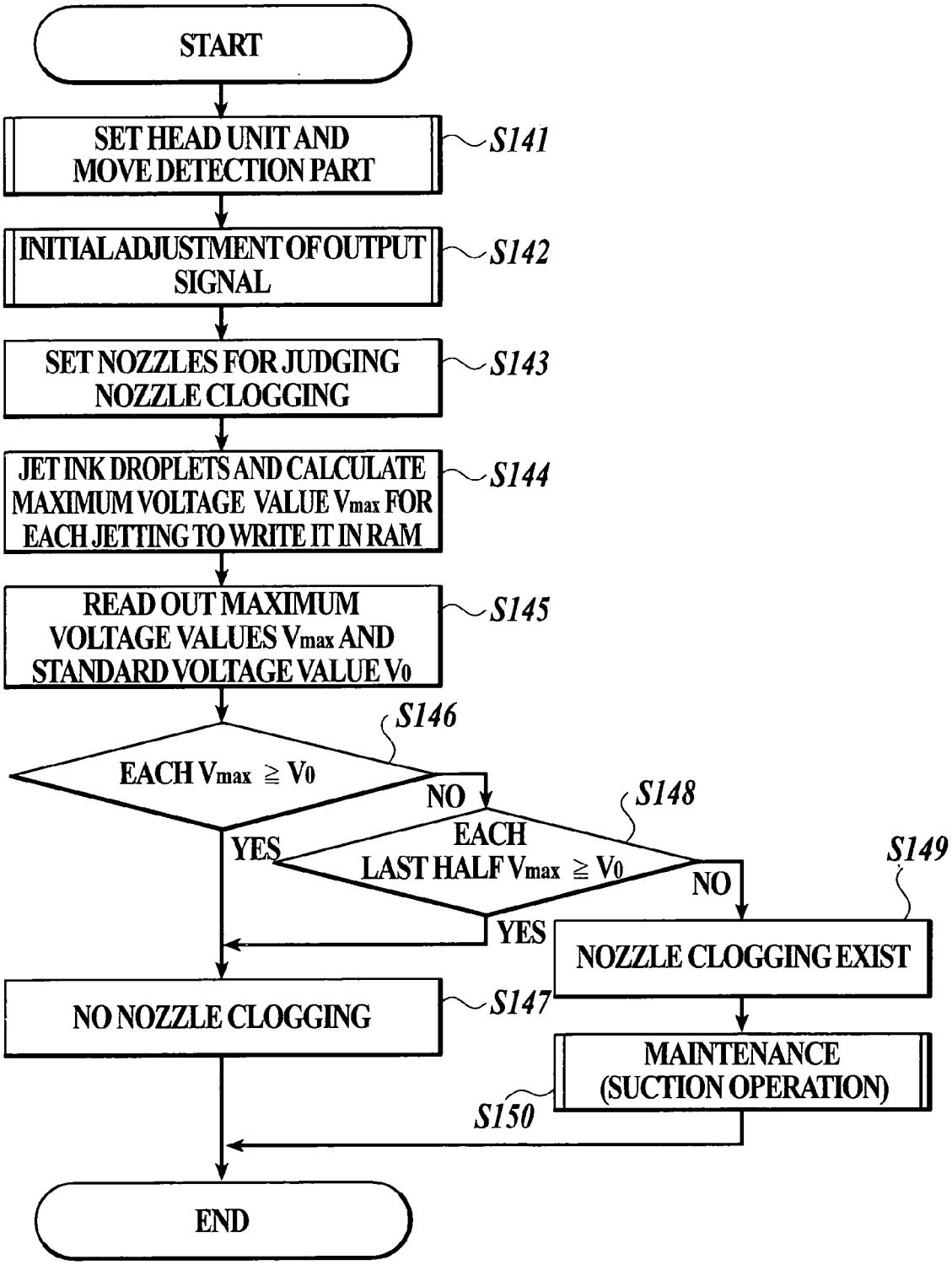
FIG. 25 is a flow chart of a nozzle clogging judging operation in a case where a judgmental standard in the third embodiment is a maximum voltage value.
Figure 26:
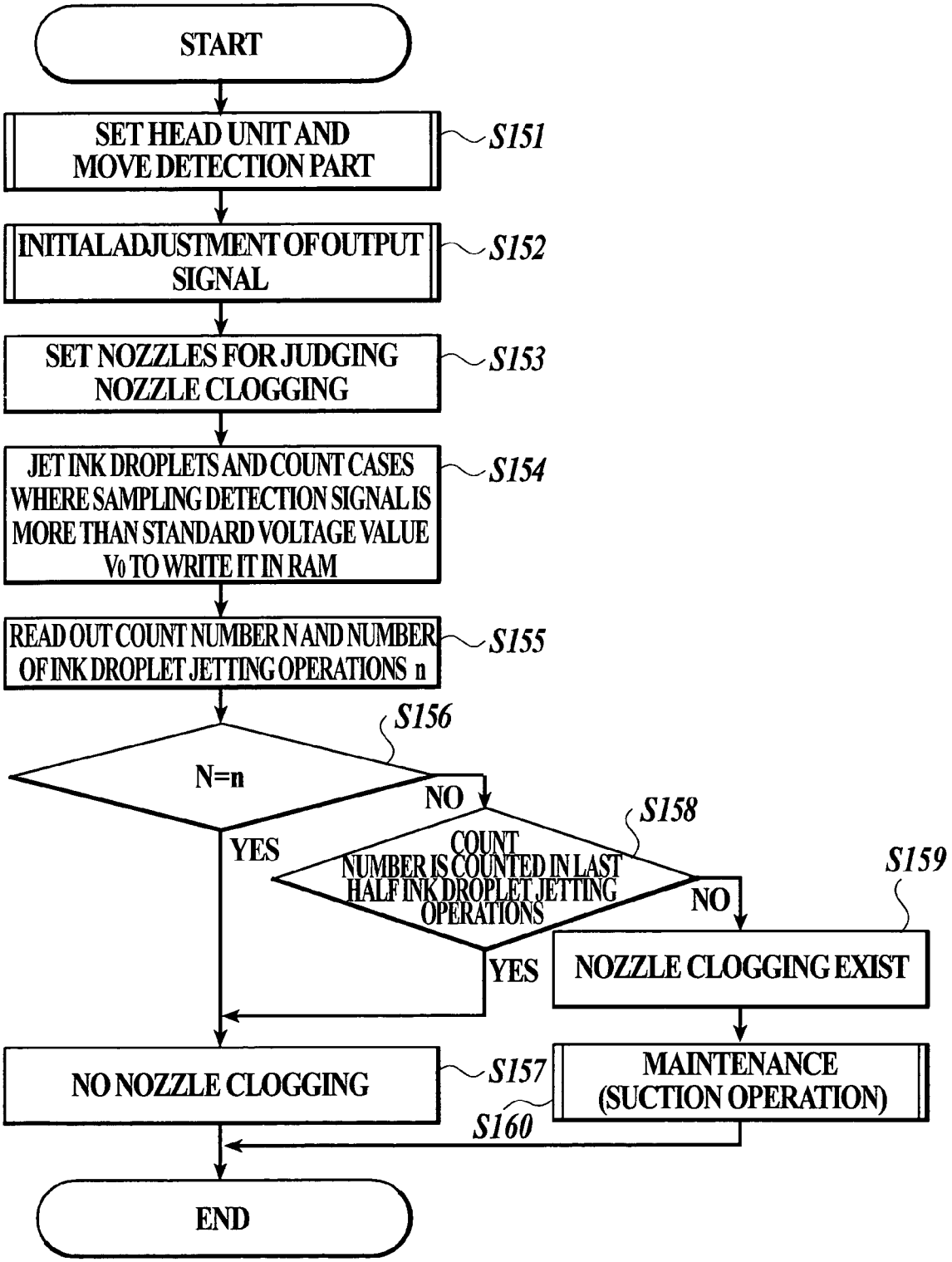
FIG. 26 is a flow chart of the nozzle clogging judging operation in a case where the judgmental standard in the third embodiment is a count number.
Figure 27:
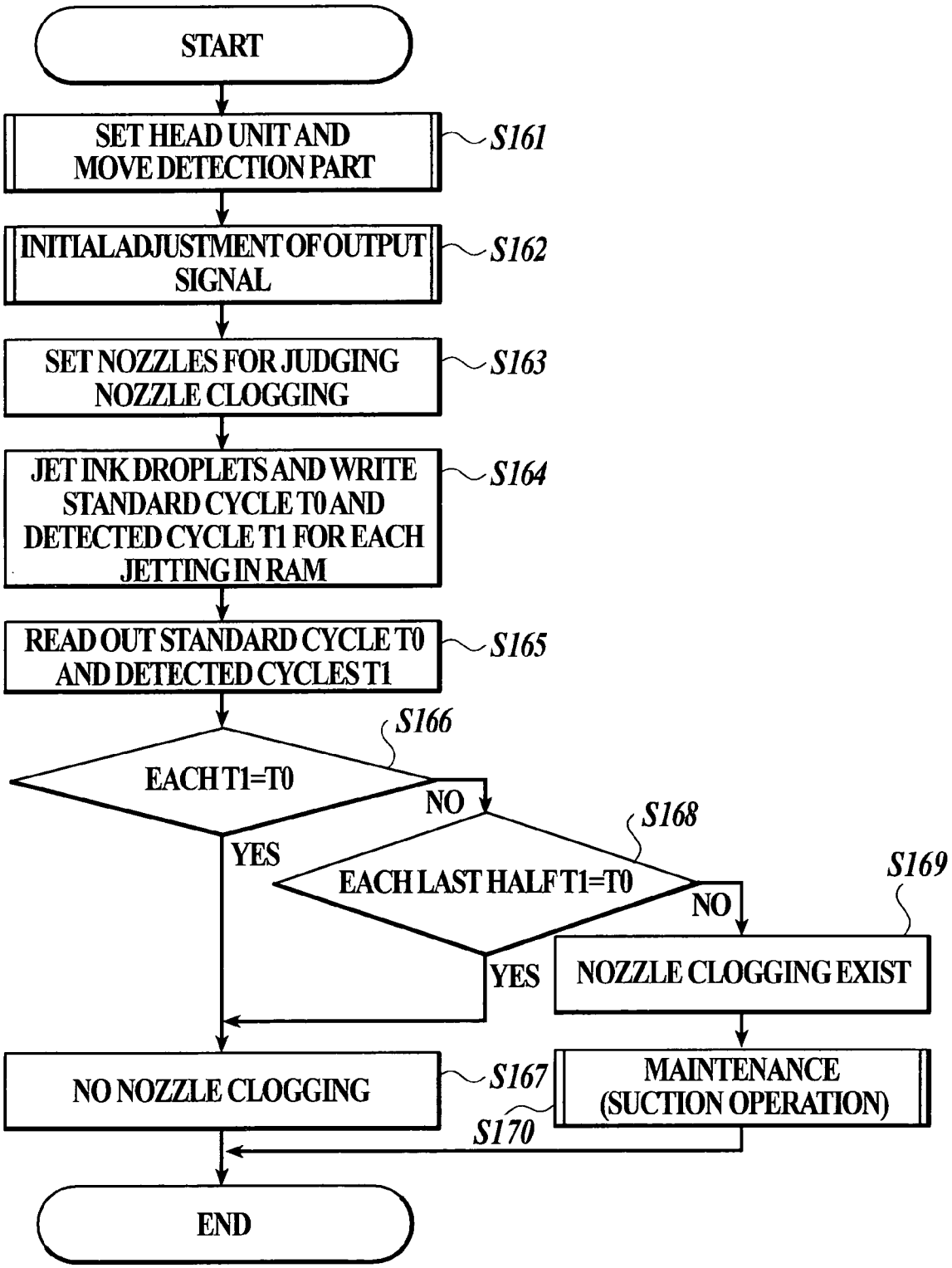
FIG. 27 is a flow chart of the nozzle clogging judging operation in a case where the judgmental standard in the third embodiment is an output cycle.

FIGS. 25 to 27 show flow charts of the nozzle clogging judging operation of the third embodiment.

FIG. 25 shows a flow chart in a case where the nozzle clogging judging operation is performed based on the maximum voltage value $V_{max}$ of the sampling detected signal Sd' as a judgmental standard.

The head unit which is subjected to the nozzle clogging judgment is set. Thereafter, the nozzle clogging detection part 603 is moved to a predetermined position below the set head unit (Step S141).

After the nozzle clogging detection part 603 was moved to the predetermined position, the output signal adjusted so that the piezo vibration signal Sd to be output from the piezo film 613 of the nozzle clogging detection part 603 disposed ahead in the ink droplet jetting direction is constant within the range of the preset initial value (Step S142).

After the initial setting of the output signal from the piezo film, nozzles for judging nozzle clogging are set (Step S143).

The ink jet signal $S_{m1}$ is output to the set nozzles, and then ink droplets are jetted. When the ink droplets jetted land on the ink droplet landing surface which is disposed ahead in the ink droplet jetting direction, the piezo vibration signal Sd is output from the piezo film, and the sampling detected signal Sd' is stored in the RAM 133 based on the sampling signal $S_s$. The maximum voltage value $V_{max}$ of the sampling detected signal Sd' is calculated for each ink droplet jetting operation to be stored in the RAM 133 (Step S144).

Steps S145 to S150 in FIG. 25 are same as Steps S6 to S11 in FIG. 9, therefore the explanations thereof are omitted.

Ink droplets are jetted from the nozzle jet openings predetermined times, calculating the maximum voltage value $V_{max}$ of the sampling detected signal Sd' based on the landing of the ink droplets for each ink droplet jetting operation, and comparing each maximum voltage value $V_{max}$ with the standard voltage value $V_0$. When not all the maximum voltage values $V_{max}$ are less than the standard voltage value $V_0$, a judgment is made that ink droplets are not jetted from the set nozzle jet openings (that is, nozzle clogging exists). Further, due to the structural feature of the ink jet head for an ink jet printer, there is a case that ink jetting is not performed for the initial stage of the ink droplet jetting operations, and is started after repeating ink droplet jetting operation for a few times, so that ink droplets are jetted in the last half ink droplet detection operations to detect the maximum voltage values $V_{max}$. Even in such the case, a judgment can be made that there is no nozzle clogging, thereby enabling to properly performing the maintenance operation only in the case when the maintenance operation is needed.

The nozzle clogging judgment operation shown in FIG. 26 is the case where a judgment is made based on the count number N of the sampling detected signals Sd' as the judgmental standard. Steps S151 to S153 shown in FIG. 26 are same as Steps S141 to S143 shown in FIG. 25, therefore, the explanations thereof are omitted here.

The ink jet signal $S_{m1}$ is output to the set nozzles, and then ink droplets are jetted. When the ink droplets jetted land on the ink droplet landing surface disposed ahead in the ink droplet jetting direction, the piezo vibration signal Sd is output from the piezo film, and the sampling detected signal Sd' is stored in the RAM 133 based on the sampling signal $S_s$. The case where the sampling detected signal Sd' is not less than the standard voltage value $V_0$ is counted in the ink droplet jetting operations (Step S154).

Steps S155 to S160 in FIG. 26 are same as Steps S26 to S31 in FIG. 10, therefore the explanations thereof are omitted.

Ink droplets are jetted from the nozzle jet openings as many times as the number of ink droplet jetting operations n, and the case where the sampling detected signal Sd' based on the landing of the ink droplets in each jetting operation is not less than the standard voltage value $V_0$ is counted. The count number N counted is compared with the number of ink droplet jetting operations n. When the count number N is not equal to the number of ink droplet jetting operations n, a judgment can be made that ink droplets are not jetted from the set nozzle jet openings (that is, nozzle clogging exists). Further, due to the structural feature of the ink jet head, there is a case that ink jetting is not performed for the initial stage of the ink droplet jetting operations, and is started after repeating ink droplet jetting operation for a few times, so that ink droplets are jetted in the last half ink droplet detection operations to be counted. Even in such the case, a judgment can be made that there is no nozzle clogging, thereby enabling to properly performing the maintenance operation only in the case when the maintenance operation is needed.

The nozzle clogging judgment operation shown in FIG. 27 is the case where a judgment is made based on the output cycle (detected cycle T1) of the sampling detected signal Sd' output as the judgmental standard. Steps S161 to S163 shown in FIG. 27 are same as Steps S141 to S143 shown in FIG. 25, therefore the explanations thereof are omitted here.

The ink jet signal $S_{m1}$ is output to the set nozzles, and then ink droplets are jetted. When the ink droplets jetted land on the ink droplet landing surface disposed ahead in the ink droplet jetting direction, the piezo vibration signal Sd is output from the piezo film, and the sampling detected signal Sd' is stored in the RAM 133 based on the sampling signal $S_s$. The standard cycle T0 of the ink jet signal $S_{m1}$ and the detected cycle T1 of the sampling detected signal Sd' for each ink droplets jetting operation are clocked to be stored in the RAM 133. The ink droplet jetting operation is performed as many times as the predetermined number of ink droplet jetting operations n (Step S164).

Steps S165 to S170 in FIG. 27 are same as Steps S46 to S51 in FIG. 11, therefore the explanations thereof are omitted.

Ink droplets are jetted from the nozzle jet openings as many times as the predetermined number of ink droplet jetting operations n, detecting the detected cycle T1 and the standard cycle T0 based on the landing of the ink droplets for each jetting operation, and comparing each detected cycle T1 with the standard cycle T0. When not all the detected cycles T1 are not equal to the standard cycle T0, a judgment can be made that ink droplets are not jetted from the set nozzle jet openings (that is, nozzle clogging exists). Further, due to the structural feature of the ink jet head for an ink jet printer, there is a case where ink jetting is not performed for the initial stage of the ink droplet jetting operations, and is started after repeating ink droplet jetting operation for a few times, so that ink droplets are jetted in the last half ink droplet detection operations to detect the detected cycle T1. Even in such the case, a judgment can be made that there is no nozzle clogging, thereby enabling to properly performing the maintenance operation only in the case when the maintenance is needed.

FIGS. 28A to 30 show operation orders of a nozzle clogging judging operation as a first operation, a cleaning operation as a second operation and a maintenance operation as a third operation.

Performing the above described first to third operations in order is successful in detecting nozzle clogging of each head unit 313, 323, 333, 343, and solving the nozzle clogging. In the maintenance operation in the third embodiment, nozzle clogging is solved by the suction operation in which the cap unit 513 is used.

Figure 28A:
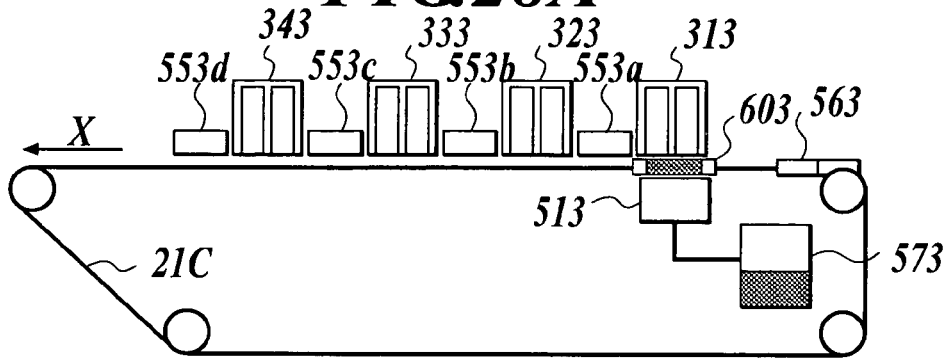
FIG. 28A is a view showing a state where the nozzle clogging detection part 603 is moved to a lower side of the head unit 313 in nozzle clogging detection and solving operations to the head unit part 303 in the third embodiment.
Figure 28B:
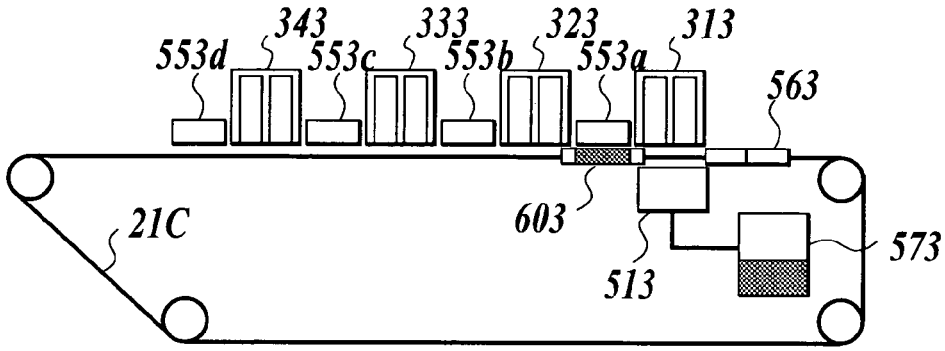
FIG. 28B is a view showing a state where the nozzle clogging detection part 603 is moved to a lower side of the cleaning unit 553*a* in the nozzle clogging detection and solving operations to the head unit part 303 in the third embodiment.
Figure 28C:
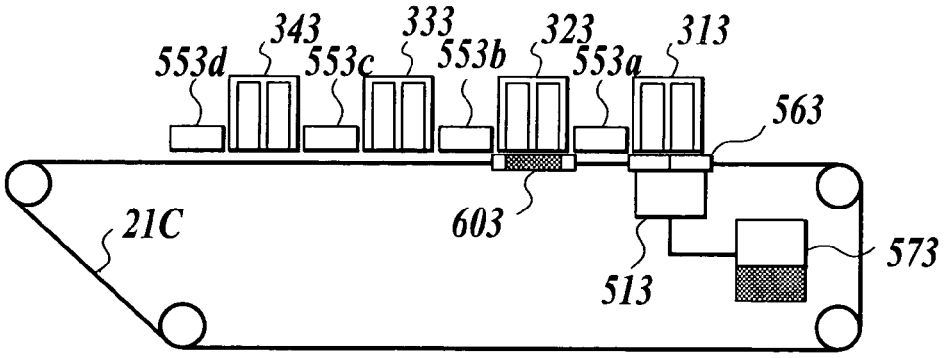
FIG. 28C is a view showing a state where the nozzle clogging detection part 603 is moved to a lower side of the head unit 323 in the nozzle clogging detection and solving operations to the head unit part 303 in the third embodiment.

The nozzle clogging detection part 603 is moved to the lower side of the head unit 313 along the carrying direction X, and thereafter, performs the nozzle clogging judging operation to the head unit 313 (refer to FIG. 28A).

After the nozzle clogging judging operation, the nozzle clogging detection part 603 is moved to the lower side of the cleaning unit 553*a*. Then, the cleaning unit 553*a* performs the cleaning operation to remove the ink droplets 643 adhered to the surface of the nozzle clogging detection part 603 (refer to FIG. 28B).

The cap unit 513 and the opening part 563 are moved to the lower side of the head unit 313. When the judgment was made that nozzle clogging exists in the nozzle clogging judging operation to the head unit 313, the cap unit 513 is attached to the head unit 313 to perform the suction operation for solving the nozzle clogging (refer to FIG. 28C). When the judgment was made that there is no nozzle clogging, the suction operation is not performed.

Next, the nozzle clogging detection part 603 is moved to the lower side of the head unit 323 to perform the nozzle clogging judging operation to the head unit 323.

Figure 28D:
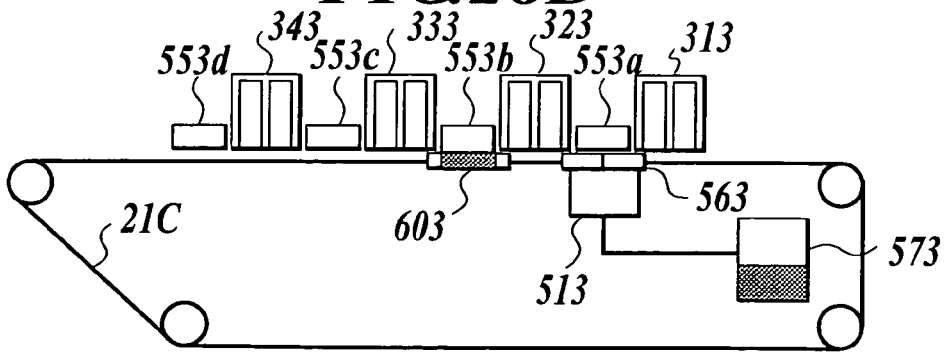
FIG. 28D is a view showing a state where the nozzle clogging detection part 603 is moved to a lower side of the cleaning unit 553*b* in the nozzle clogging detection and solving operations to the head unit part 303 in the third embodiment.

After the nozzle clogging judging operation, the nozzle clogging detection part 603 is moved to the lower side of the cleaning unit 553*b*. Then, the cleaning unit 553*b* performs the cleaning operation to remove the ink droplets 643 adhered to the surface of the nozzle clogging detection part 603. The cap unit 513 and the opening part 563 are moved to the lower side of the cleaning unit 553*a* (FIG. 28D).

The cap unit 513 and the opening part 563 are moved to the lower side of the head unit 323. When the judgment was made that nozzle clogging exists in the nozzle clogging detection operation to the head unit 323, the cap unit 513 is attached to the head unit 323 to perform the suction operation for solving the nozzle clogging (refer to FIG. 29A). When the judgment was made that there is no nozzle clogging, the suction operation is not performed.

Next, the nozzle clogging detection part 603 is moved to the lower side of the head unit 333 to perform the nozzle clogging judging operation to the head unit 333.

Figure 29A:
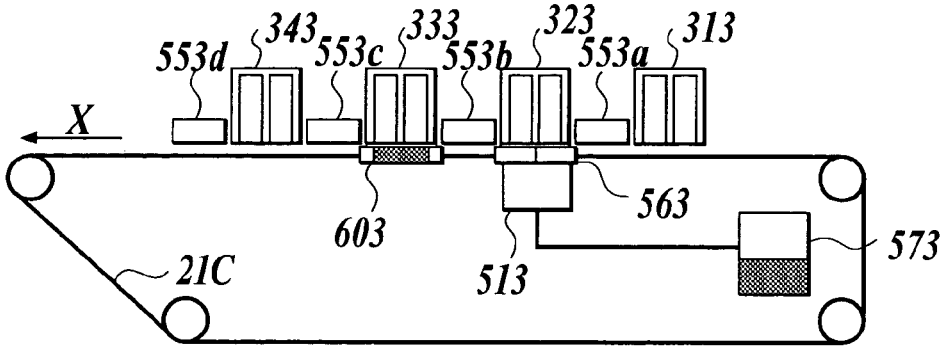
FIG. 29A is a view showing a state where the nozzle clogging detection part 603 is moved to a lower side of the head unit 333 in the nozzle clogging detection and solving operations to the head unit part 303 in the third embodiment.
Figure 29B:
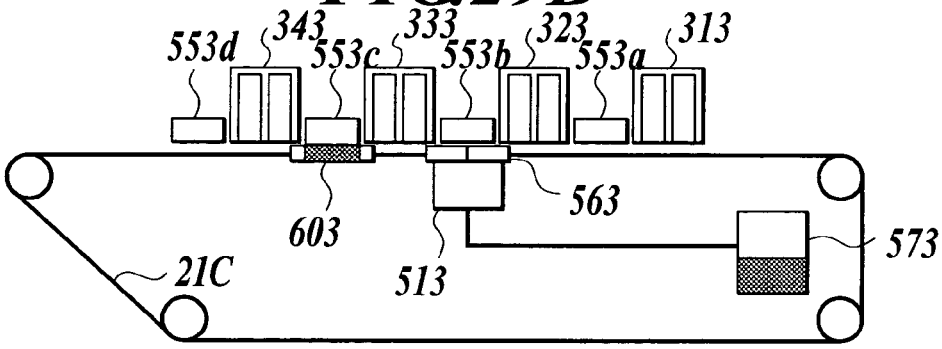
FIG. 29B is a view showing a state where the nozzle clogging detection part 603 is moved to a lower side of the cleaning unit 553*c* in the nozzle clogging detection and solving operations to the head unit part 303 in the third embodiment.
Figure 29C:
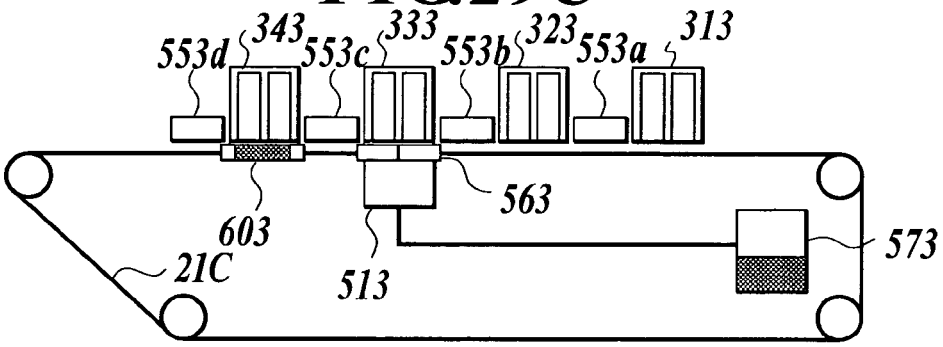
FIG. 29C is a view showing a state where the nozzle clogging detection part 603 is moved to a lower side of the head unit 343 in the nozzle clogging detection and solving operations to the head unit part 303 in the third embodiment.

After the nozzle clogging judging operation, the nozzle clogging detection part 603 is moved to the lower side of the cleaning unit 553*c*. Then, the cleaning unit 553*c* performs the cleaning operation to remove the ink droplets 643 adhered to the surface of the nozzle clogging detection part 603. The cap unit 513 and the opening part 563 are moved to the lower side of the cleaning unit 553*b* (FIG. 29B).

The cap unit 513 and the opening part 563 are moved to the lower side of the head unit 333. When the judgment was made that nozzle clogging exists in the nozzle clogging judging operation to the head unit 333, the cap unit 513 is attached to the head unit 333 to perform the suction operation for solving the nozzle clogging (refer to FIG. 29C). When the judgment was made that there is no nozzle clogging, the suction operation is not performed.

Next, the nozzle clogging detection part 603 is moved to the lower side of the head unit 343 to perform the nozzle clogging detection operation to the head unit 343.

Figure 29D:
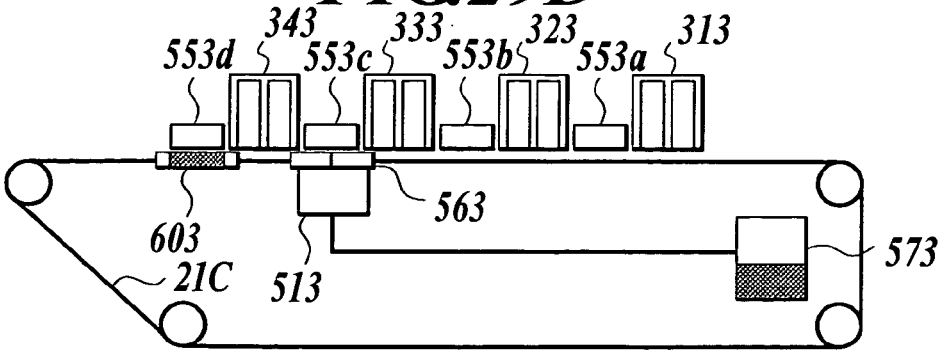
FIG. 29D is a view showing a state where the nozzle clogging detection part 603 is moved to a lower side of the cleaning unit 553*d* in the nozzle clogging detection and solving operations to the head unit part 303 in the third embodiment.
Figure 30:
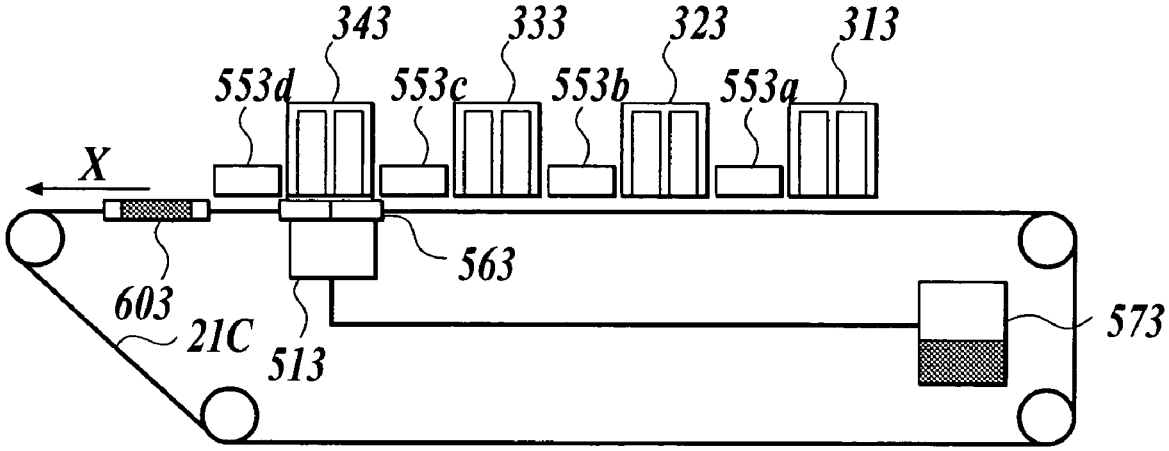
FIG. 30 is a view showing a state where the nozzle clogging detection part 603 is moved to a left end of an upper surface of the carrying belt 21C in the nozzle clogging detection and solving operations to the head unit part 303 in the third embodiment.

The nozzle clogging detection part 603 is moved to the lower side of the cleaning unit 553*d*. Then, the cleaning unit 553*d* performs the cleaning operation to remove the ink droplets 643 adhered to the surface of the nozzle clogging detection part 603. The cap unit 513 and the opening part 563 are moved to the lower side of the cleaning unit 553*c* (FIG. 29D).

The nozzle clogging detection part 603 is moved to the left end of the upper surface of the carrying belt 21C. The cap unit 513 and the opening part 563 are moved to the lower side of the head unit 343. When the judgment was made that nozzle clogging exits in the nozzle clogging detection operation to the head unit 343, the cap unit 513 is attached to the head unit 343 to perform the suction operation for solving the nozzle clogging (refer to FIG. 30). When the judgment was made that there is no nozzle clogging, the suction operation is not performed.

In the third embodiment, the carrying belt 21C is provided with the nozzle clogging detection part 603 and the opening part 563, so that the detection and solving operations of a jet failure of the nozzles in the plurality of head units, and the ink removing operation of the ink adhered to the nozzle clogging detection part 603 can be continuously performed, which results in effectively performing the jet failure detection and nozzle clogging solving operations.

Fourth Embodiment

The fourth embodiment will be explained referring to the drawings.

The configuration will be explained first.

Figure 31:
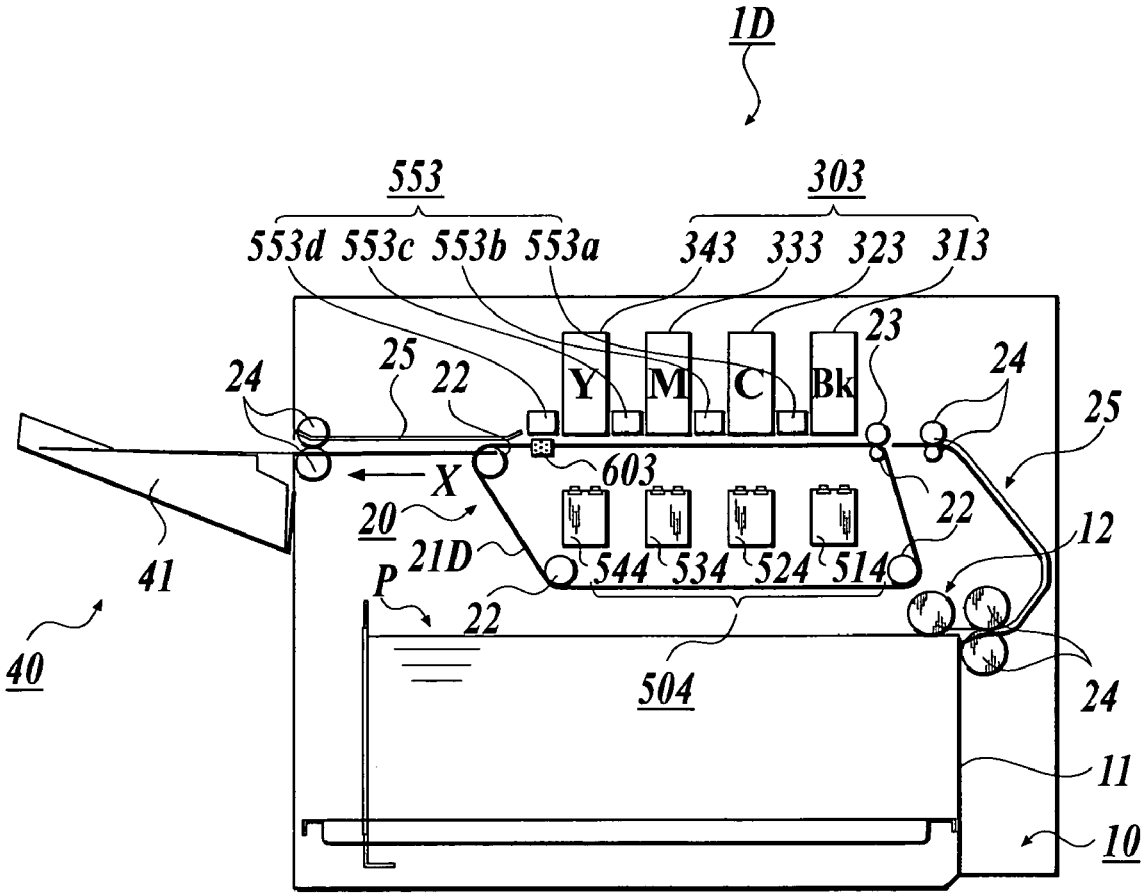
FIG. 31 is a schematic view of an inside of an ink jet printer 1D in the forth embodiment.

FIG. 31 shows a schematic view of the inside of an ink jet printer 1D of a long line head type along the width direction of a recording medium in the fourth embodiment.

In the configuration of the ink jet printer 1D in the fourth embodiment, the component that is same as in the third embodiment will be given the same reference numeral and the explanations thereof will be omitted, thus only the component with different function will be explained. Specifically, the maintenance part 503 is provided with one head unit 503 and one opening part 603, however, in the fourth embodiment, the maintenance part 504 is provided with four cap units 514, 524, 534, 544 and four openings to correspond to the number of the head units.

The nozzle clogging detection part 603 as an ink droplet detection section in the fourth embodiment is same as that in the third embodiment, therefore the drawings and explanations are omitted.

Figure 32A:
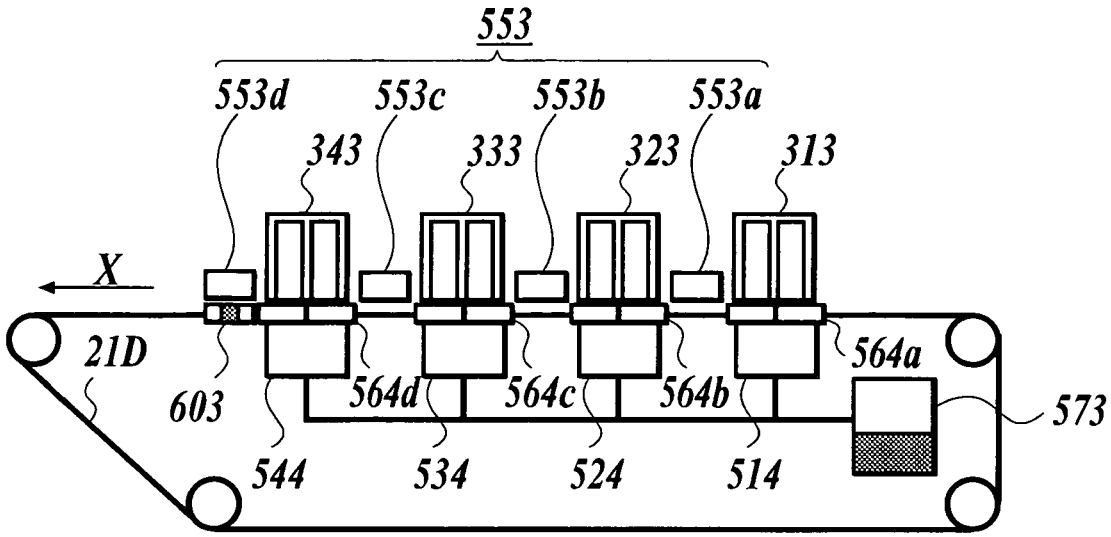
FIG. 32A is an end view of the head unit part 303, a maintenance part 504, and the nozzle clogging detection part 603.
Figure 32B:
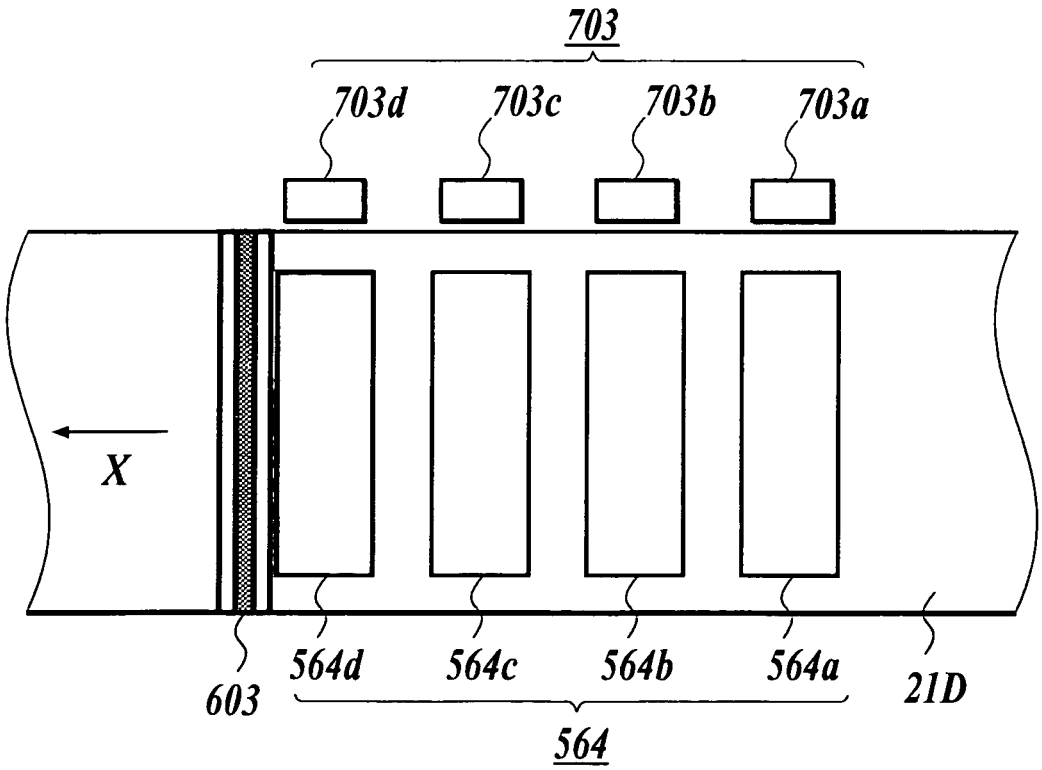
FIG. 32B is a view of a carrying belt 21D, an opening part 564, the nozzle clogging detection part 603, the sensor signal picking up part 703 as seen from an ink droplet jetting direction (from above the carrying belt 21D)

FIGS. 32A and 32B show detailed configurations of the head unit part 303, the maintenance part 504, the nozzle clogging detection part 603, and the sensor signal picking up part 703.

FIG. 32A is an end view of the head unit part 303, the maintenance part 504 as a maintenance section, and the nozzle clogging detection part 603.

The maintenance part 504 comprises cap units 514, 524, 534, 544, a cleaning part 553 as a second cleaning section, an opening part 564, and a waste ink tank 573.

The opening part 564 comprises four openings 564*a*, 564*b*, 564*c*, 564*d* corresponding to the head units 313, 323, 333, 343 as an ink jet section. The openings 564*a*, 564*b*, 564*c*, 564*d* are arranged in parallel in a carrying belt 21D as a recording medium carrying belt on the upstream side of the nozzle clogging detection part 603 with respect to the carrying direction X, and are opened for attaching the cap units 514, 524, 534, 544 to the head units 313, 323, 333, 343, respectively, when the judgment wad made that nozzle clogging exists. The openings 564*a*, 564*b*, 564*c*, 564*d* are movable along the carrying direction X with the movement of the carrying belt 21D.

In the fourth embodiment, explanation will be made to an example, in which a suction operation is adopted as a method to solve nozzle clogging. However, a flashing operation may be adopted, in which electrical signals are given to the heads, jetting ink droplets, and flashing foreign materials or the like adhered to the nozzle jet openings and the nozzle-plates.

Further, a mechanism for performing a wiping operation to wipe unnecessary ink droplets adhered to the nozzle-plates after the suction operation or the flashing operation may be provided.

FIG. 32B is a view of the carrying belt 21D, the opening part 564, the nozzle clogging detection part 603, and the sensor signal picking up part 703 when performing the suction operation, as seen from the ink droplet jetting direction.

The nozzle clogging detection part 603 is attached to the carrying belt 21D by the fixing member 633. The openings 564*a*, 564*b*, 564*c*, 564*d* are arranged in parallel in the carrying belt 21D on the upstream side of the nozzle clogging detection part 603 with respect to the carrying direction X, and are movable along the carrying direction X to be disposed adjacent to the left side of the fixedly provided sensor signal picking up units 703*a*, 703*b*, 703*c*, 703*d* in the width direction, respectively when performing the suction operation.

The schematic configurations of the nozzle clogging detection part 603 and the sensor signal picking up unit 703*a* when detecting nozzle clogging, the control block for controlling the ink jet printer 1D and the flow chart of the nozzle clogging judging operation in the fourth embodiment are same as those in the third embodiment, so that drawings and explanations are omitted.

Next, the nozzle clogging judging operation, the maintenance operation and the cleaning operation in the case where four cap units and four openings are provided to correspond to the number of the head units will be explained.

FIGS. 33A to 35 show operation orders of a nozzle clogging judging operation and a cleaning operation as a first operation, and a maintenance operation as a second operation.

Figure 33A:
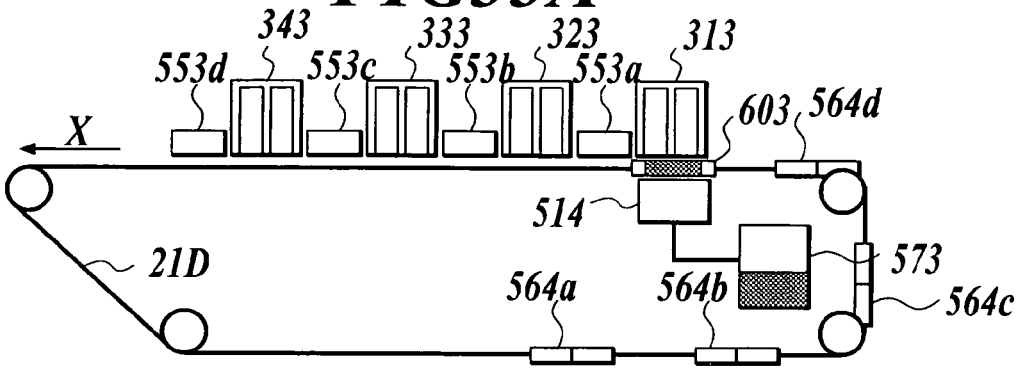
FIG. 33A is a view showing a state where the nozzle clogging detection part 603 is moved to a lower side of the head unit 313 in the nozzle clogging detection and solving operations to the head unit part 303 in the fourth embodiment.
Figure 33B:
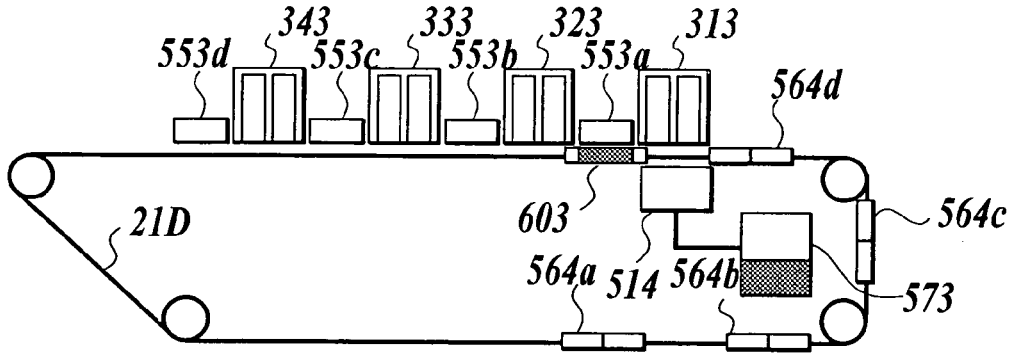
FIG. 33B is a view showing a state where the nozzle clogging detection part 603 is moved to a lower side of the cleaning unit 553*a* in the nozzle clogging detection and solving operations to the head unit part 303 in the fourth embodiment.

In the maintenance operation in the fourth embodiment, nozzle clogging is solved by the suction operation with the use of the cap units 514, 524, 435, 544. In FIGS. 33A and 34D, the cap units 524, 534, 544 are not shown.

Performing the above described first operation to each head unit 313, 323, 333, 343 in order is successful in judging whether a plurality of nozzle clogging exists in each head unit 313, 323, 333, 343, and thereafter, removing the ink droplets 643 adhered to the nozzle clogging detection part 603.

After the first operation to each head unit 313, 323, 333, 343 is completed, the above second operation is performed to each head unit 313, 323, 333, 343 at the same time, so that the nozzle clogging can be solved.

The nozzle clogging detection part 603 is moved to the lower side of the head unit 313 along the carrying direction X, and then performs the nozzle clogging judging operation to the head unit 313 (refer to FIG. 33A).

After the nozzle clogging judging operation, the nozzle clogging detection part 603 is moved to the lower side of the cleaning unit 553*a*. Then, the cleaning unit 553*a* performs the cleaning operation for removing the ink droplets 643 adhered to the surface of the nozzle clogging detection part 603 (refer to FIG. 33B).

Figure 33C:
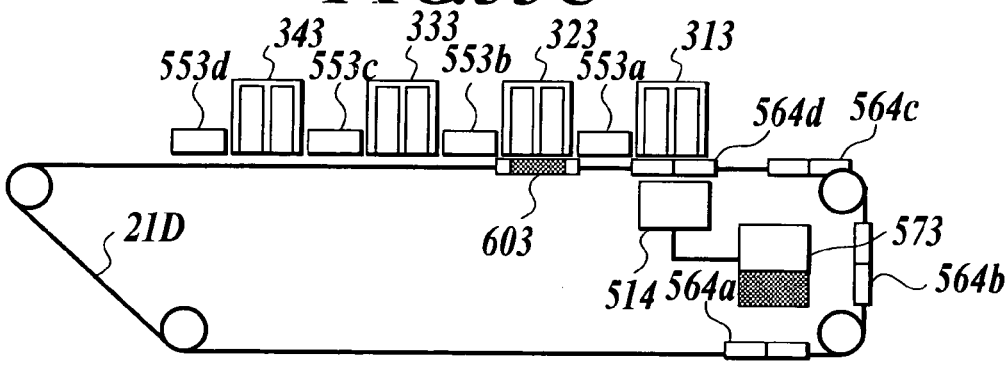
FIG. 33C is a view showing a state where the nozzle clogging detection part 603 is moved to a lower side of the head unit 323 in the nozzle clogging detection and solving operations to the head unit part 303 in the fourth embodiment.
Figure 33D:
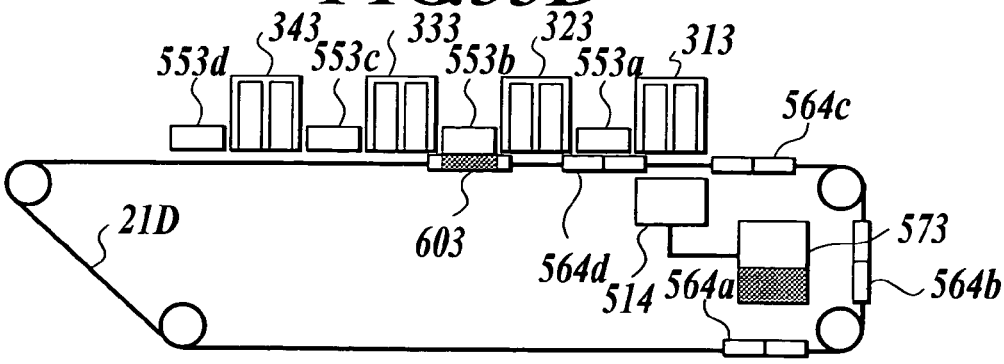
FIG. 33D is a view showing a state where the nozzle clogging detection part 603 is moved to a lower side of the cleaning unit 553*b* in the nozzle clogging detection and solving operations to the head unit part 303 in the fourth embodiment.

The nozzle clogging detection part 603 is moved to the lower side of the head unit 323 to perform the nozzle clogging judging operation to the head unit 323 (FIG. 33C).

After the nozzle clogging judging operation, the nozzle clogging detection part 603 is moved to the lower side of the cleaning unit 553*b*. Then, the cleaning unit 553*b* performs the cleaning operation for removing the ink droplets 643 adhered to the surface of the nozzle clogging detection part 603 (refer to FIG. 33D).

Figure 34A:
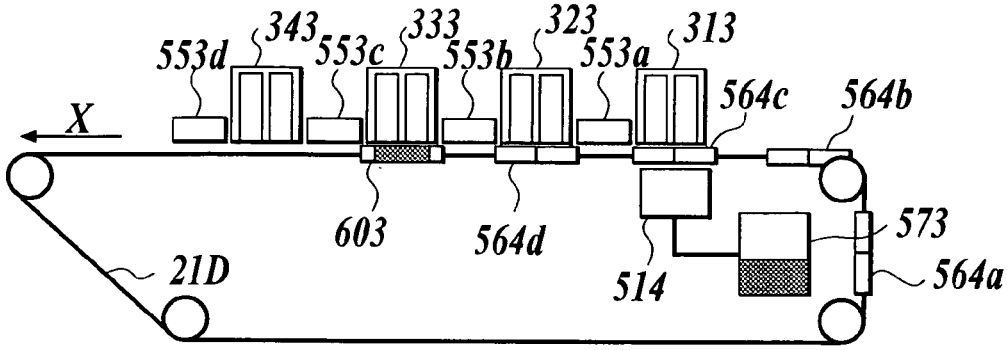
FIG. 34A is a view showing a state where the nozzle clogging detection part 603 is moved to a lower side of the head unit 333 in the nozzle clogging detection and solving operations to the head unit part 303 in the fourth embodiment.
Figure 34B:
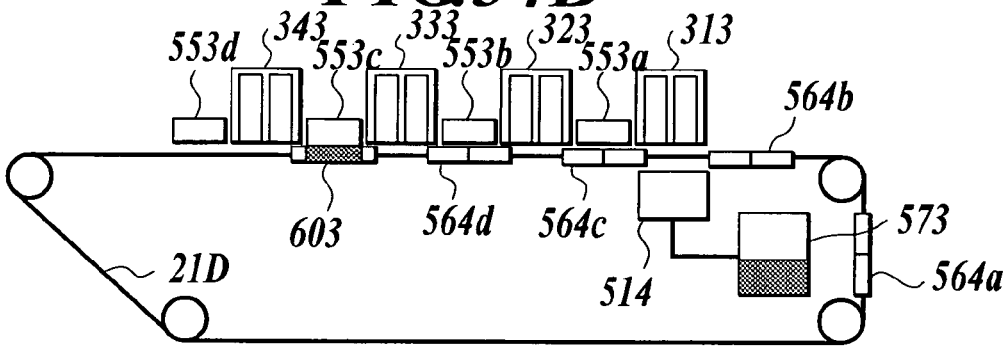
FIG. 34B is a view showing a state where the nozzle clogging detection part 603 is moved to a lower side of the cleaning unit 553*c* in the nozzle clogging detection and solving operations to the head unit part 303 in the fourth embodiment.

The nozzle clogging detection part 603 is moved to the lower side of the head unit 333 to perform the nozzle clogging judging operation to the head unit 333 (refer to FIG. 34A).

After the nozzle clogging judging operation, the nozzle clogging detection part 603 is moved to the lower side of the cleaning unit 553*c*. Then, the cleaning unit 553*c* performs the cleaning operation for removing the ink droplets 643 adhered to the surface of the nozzle clogging detection part 603 (refer to FIG. 34B).

Figure 34C:
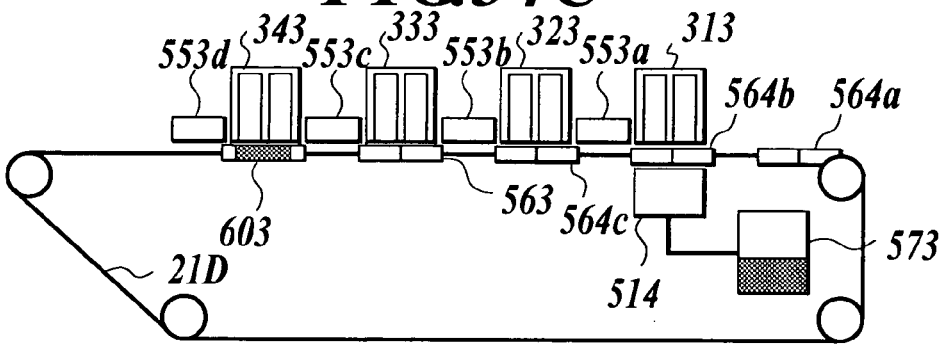
FIG. 34C is a view showing a state where the nozzle clogging detection part 603 is moved to a lower side of the head unit 343 in the nozzle clogging detection and solving operations to the head unit part 303 in the fourth embodiment.
Figure 34D:
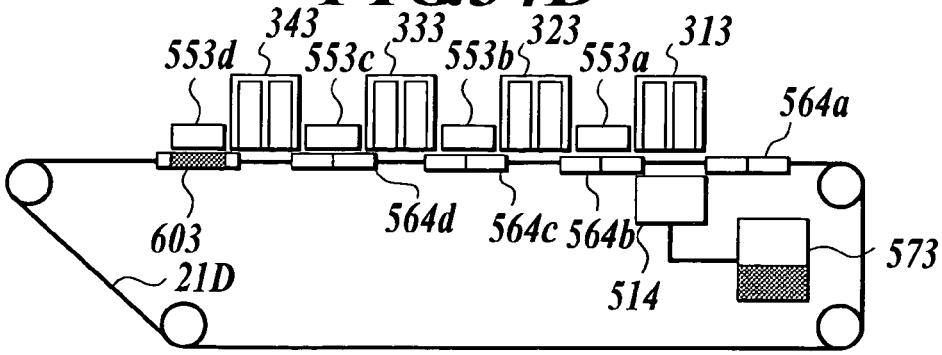
FIG. 34D is a view showing a state where the nozzle clogging detection part 603 is moved to a lower side of the cleaning unit 553*d* in the nozzle clogging detection and solving operations to the head unit part 303 in the fourth embodiment.
Figure 35:
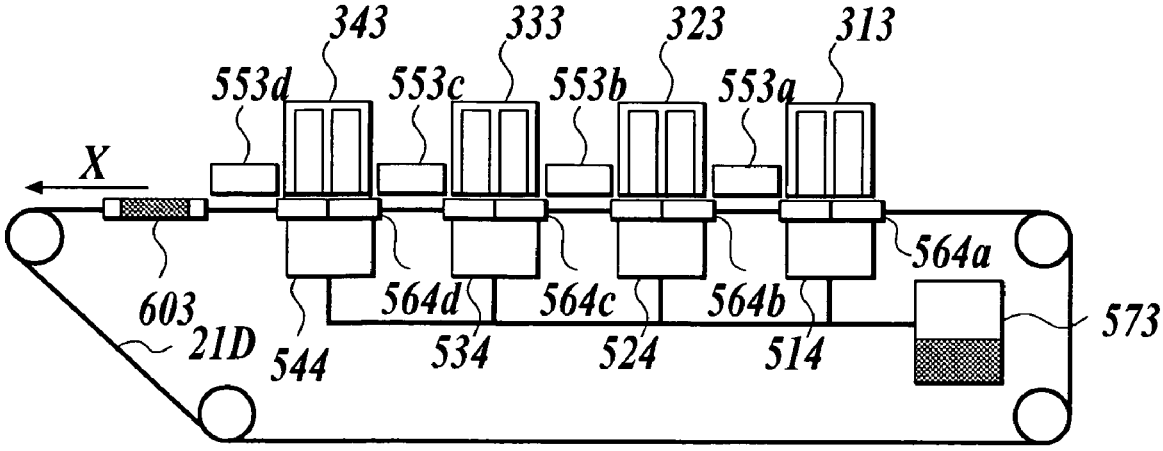
FIG. 35 is a view showing a state where the nozzle clogging detection part 603 is moved to a left end of an upper surface of the carrying belt 21D in the nozzle clogging detection and solving operations to the head unit part 303 in the fourth embodiment.

The nozzle clogging detection part 603 is moved to the lower side of the head unit 343 to perform the nozzle clogging judging operation to the head unit 343 (refer to FIG. 34C).

After the nozzle clogging judging operation, the nozzle clogging detection part 603 is moved to the lower side of the cleaning unit 553*d*. Then, the cleaning unit 553*d* performs the cleaning operation for removing the ink droplets 643 adhered to the surface of the nozzle clogging detection part 603 (refer to FIG. 34D).

After the cleaning of the nozzle clogging detection part 603, the cap units 514, 524, 534, 544 and the openings 564*a*, 564*b*, 564*c*, 564*d* are moved to the lower side of the corresponding head units 313, 323, 333, 343, respectively. Only to the head units which were judged that nozzle clogging exists, the corresponding cap unit 514, 524, 534 or 544 is attached to perform the suction operation (refer to FIG. 35).

By performing the suction operation to the head units which were judged to have nozzle clogging at the same time, the maintenance operation can be performed effectively.

The entire disclosure of Japanese Patent Application Nos. Tokugan 2003-410570 and Tokugan 2003-410583 which were filed on Dec. 9, 2003, Tokugan 2003-419353 which was filed on Dec. 17, 2003, and Tokugan 2003-430107 and Tokugan 2003-431218 which were filed on Dec. 25, 2003, including specification, claims, drawings and summary are incorporated herein by reference in its entirety.

What is claimed is:

1. An ink jet printer for recording an image on a recording medium by jetting ink from nozzles comprising:

an ink jet section which is provided with the nozzles; and an ink droplet detection section for detecting an impact force generated when an ink droplet jetted from the nozzles lands with a piezoelectric element film, which is provided ahead in an ink droplet jetting direction from the nozzles, wherein the piezoelectric element film is covered by a cover having an ink droplet landing surface for receiving ink droplets and a contact surface for transmitting the impact force by contacting the piezoelectric element film, and the piezoelectric element film is curved into approximately a half cylindrical shape and is disposed such that a maximum projecting portion of the curved outer periphery faces the ink droplet.

2. The printer of claim 1, wherein the piezoelectric element film is supported by a position adjusting section for adjusting the maximum projecting portion of the curved outer periphery to a landing position of the ink droplet jetted.

3. The printer of claim 2, wherein the position adjusting section allows an one end side of the piezoelectric element film in a curving direction to move to be close to or separated from an other end of the piezoelectric element film which is fixed, and adjusts the maximum projecting portion of the curved outer periphery to the landing position of the ink droplet jetted.

4. The printer of claim 2, wherein the position adjusting section allows an one end side of the piezoelectric element film in the curving direction and an other end side thereof to move in parallel in a same direction with an interval therebetween kept constant, and adjusts the maximum projecting portion of the curved outer periphery to the landing position of the ink droplet jetted.

5. The printer of claim 2, wherein the position adjusting section allows an one end side of the piezoelectric element film in the curving direction and an other end side thereof to relatively move to be close to or separated from each other, and adjusts the maximum projecting portion of the curved outer periphery to the landing position of the ink droplet jetted.

* * * * *